US008536087B2

(12) United States Patent
Harrison et al.

(10) Patent No.: US 8,536,087 B2
(45) Date of Patent: Sep. 17, 2013

(54) THERMOGRAPHIC IMAGING ELEMENT

(75) Inventors: Daniel Jude Harrison, Pittsford, NY (US); Barry L. Marginean, Scottsville, NY (US); John Przybylo, Buffalo, NY (US); Kathleen Lindstrom, Hamburg, NY (US); Natalie Soldwisch, Buffalo, NY (US)

(73) Assignee: International Imaging Materials, Inc., Amherst, NY (US)

( * ) Notice: Subject to any disclaimer, the term of this patent is extended or adjusted under 35 U.S.C. 154(b) by 268 days.

(21) Appl. No.: 13/080,048

(22) Filed: Apr. 5, 2011

(65) Prior Publication Data

US 2011/0251060 A1 Oct. 13, 2011

Related U.S. Application Data

(60) Provisional application No. 61/342,011, filed on Apr. 8, 2010.

(51) Int. Cl.
*B41M 5/42* (2006.01)

(52) U.S. Cl.
USPC ..... 503/201; 503/207; 503/226

(58) Field of Classification Search
None
See application file for complete search history.

(56) References Cited

U.S. PATENT DOCUMENTS

| | | | |
|---|---|---|---|
| 1,449,157 | A | 3/1923 | Willkie |
| 2,269,035 | A | 1/1942 | Neal |
| 2,299,991 | A | 10/1942 | Kallock |
| 2,519,660 | A | 8/1950 | James |
| 2,710,263 | A | 6/1955 | Clark |
| 2,739,909 | A | 3/1956 | Rosenthal |
| 2,854,350 | A | 9/1958 | Cordery |
| 2,859,351 | A | 11/1958 | Clark et al. |
| 2,962,382 | A | 11/1960 | Ives |
| 3,014,301 | A | 12/1961 | Grupe |
| 3,031,328 | A | 4/1962 | Larsen |
| 3,147,062 | A | 9/1964 | Glenn, Jr. |
| 3,152,904 | A | 10/1964 | Sorensen |
| 3,180,752 | A | 4/1965 | Bollinger |
| 3,201,364 | A | 8/1965 | Salyer |
| 3,265,524 | A | 8/1966 | Echeagaray |
| 3,308,073 | A | 3/1967 | Kepple |
| 3,320,089 | A | 5/1967 | Bourgeois |
| 3,347,675 | A | 10/1967 | Henn |
| 3,429,706 | A | 2/1969 | Shepard |
| 3,429,709 | A | 2/1969 | Merle Sid Masri |
| 3,438,776 | A | 4/1969 | Yudelson |

(Continued)

FOREIGN PATENT DOCUMENTS

| | | |
|---|---|---|
| EP | 1229503 | 8/2002 |
| GB | 1270632 | 4/1972 |

(Continued)

OTHER PUBLICATIONS

Von F.W. Billmeyer Jr., "Textbook of Polymer Science", 1962, p. 43, 2nd Edition, Interscience Publishers (A division of J. Wiley & Sons), New York, NY.

(Continued)

*Primary Examiner* — Bruce H Hess

(57) ABSTRACT

A thermographic substrate assembly comprised of a colorant and a flexible substrate. This assembly also contains a thermosensitive layer, and the thermosensitive layer contains a binder, a multiplicity of hollow sphere organic pigments, and a thermal solvent.

34 Claims, 8 Drawing Sheets

(56) References Cited

U.S. PATENT DOCUMENTS 3,442,682 A 5/1969 Fukawa
3,457,075 A 7/1969 Morgan
3,508,344 A 4/1970 Thomas
3,615,972 A 10/1971 Morehouse, Jr.
3,642,475 A 2/1972 Vrancken
3,664,981 A 5/1972 Mahlman
3,667,959 A 6/1972 Bojara
3,953,659 A 4/1976 Truitt
4,108,806 A 8/1978 Cohrs
4,168,980 A 9/1979 LaRossa
4,206,980 A 6/1980 Krueger
4,299,880 A 11/1981 Arens
4,318,937 A 3/1982 Ceintrey
4,337,616 A 7/1982 Downing
4,389,445 A 6/1983 Nakumura et al.
4,389,503 A 6/1983 Maxwell
4,418,098 A 11/1983 Maistrovich
4,427,836 A 1/1984 Kowalski
4,468,498 A 8/1984 Kowalski
4,481,352 A 11/1984 McConnell
4,483,889 A 11/1984 Andersson
4,497,851 A 2/1985 De Vroom
4,521,494 A 6/1985 Mani
4,522,654 A 6/1985 Chisvette
4,531,141 A 7/1985 Sagawa
4,536,218 A 8/1985 Ganho
4,539,256 A 9/1985 Shipman
4,563,415 A 1/1986 Brown
4,584,267 A 4/1986 Masukawa
4,590,154 A 5/1986 Hirai
4,594,154 A 6/1986 Bissardon
4,610,490 A 9/1986 Naito
4,675,705 A 6/1987 Marginean
4,729,687 A 3/1988 Arens
4,770,981 A 9/1988 Komamura
4,830,503 A 5/1989 Hoda
4,873,078 A 10/1989 Edmundson
4,880,465 A 11/1989 Loria
4,880,842 A 11/1989 Kowalski
4,886,744 A 12/1989 Arnost
4,949,698 A 8/1990 Burnham
4,952,479 A 8/1990 Aono
4,977,070 A 12/1990 Winslow
4,983,502 A 1/1991 Ohbayashi
5,071,823 A 12/1991 Matsushita
5,093,306 A 3/1992 Mukoyoshi
5,104,722 A 4/1992 Kojima
5,107,454 A 4/1992 Niki
5,108,834 A 4/1992 Asazuma
5,121,636 A 6/1992 Seiter
5,157,084 A 10/1992 Lee
5,158,924 A 10/1992 Konagaya
5,162,289 A 11/1992 Betts
5,223,545 A 6/1993 Kumar
5,271,990 A 12/1993 Kronzer
5,320,929 A 6/1994 Arnost
5,328,799 A 7/1994 Freedman
5,360,827 A 11/1994 Toda
5,389,129 A 2/1995 Jordan
5,429,869 A 7/1995 McGregor
5,436,108 A 7/1995 Freedman
5,436,109 A 7/1995 Bailey
5,451,559 A 9/1995 Smith
5,462,788 A 10/1995 Ohashi
5,470,688 A * 11/1995 Texter et al. ..... 430/203
5,474,996 A 12/1995 Caille
5,494,735 A 2/1996 Nitta
5,494,971 A 2/1996 Blankenship
5,521,253 A 5/1996 Lee
5,536,627 A 7/1996 Wang
5,569,347 A 10/1996 Wang
5,604,079 A 2/1997 Filosa
5,665,462 A 9/1997 Dewar
5,665,670 A 9/1997 Burberry
5,670,102 A 9/1997 Perman
5,677,043 A 10/1997 Hultman
5,716,900 A 2/1998 Kronzer
5,776,280 A 7/1998 Puckett
5,777,014 A 7/1998 Hopper
5,888,043 A 3/1999 Jatcko
5,888,283 A 3/1999 Mehta
5,891,476 A 4/1999 Reo
5,895,542 A 4/1999 Wadzinski
5,919,729 A 7/1999 Mori
5,935,904 A 8/1999 Shirai
5,977,263 A 11/1999 Phillips
5,985,076 A 11/1999 Misuda
5,985,424 A 11/1999 Dematte
5,997,741 A 12/1999 Shimoda
6,004,718 A 12/1999 Shinohara
6,007,594 A 12/1999 Kaczor
6,007,918 A 12/1999 Tan
6,008,157 A 12/1999 Takeuchi
6,013,409 A 1/2000 Chou
6,024,950 A 2/2000 Takada
6,031,021 A 2/2000 Kenny
6,031,556 A 2/2000 Tutt
6,034,704 A 3/2000 Stewart
6,040,267 A 3/2000 Mano
6,040,269 A 3/2000 Imoto
6,045,646 A 4/2000 Yoshikawa
6,051,097 A 4/2000 Higuchi
6,051,171 A 4/2000 Takeuchi
6,057,028 A 5/2000 Tan
6,060,124 A 5/2000 Ikegawa
6,075,927 A 6/2000 Sakai
6,075,965 A 6/2000 Tombs
6,077,594 A 6/2000 Roth
6,078,346 A 6/2000 Isobe
6,082,912 A 7/2000 Shimizu
6,083,610 A 7/2000 Hirose
6,083,872 A 7/2000 Adkins
6,084,623 A 7/2000 Shibasaki
6,086,700 A 7/2000 Valentini
6,086,987 A 7/2000 Yamanaka
6,102,534 A 8/2000 Herbert
6,103,389 A 8/2000 Tanaka
6,106,910 A 8/2000 Tan
6,108,456 A 8/2000 Yamamoto
6,113,342 A 9/2000 Smith
6,113,725 A 9/2000 Kronzer
6,114,088 A 9/2000 Wolk
6,116,709 A 9/2000 Hirabayashi
6,117,572 A 9/2000 Tidrow
6,118,467 A 9/2000 Park
6,120,637 A 9/2000 Barry
6,121,356 A 9/2000 Lundberg
6,124,239 A 9/2000 Chapman
6,124,944 A 9/2000 Ohta
6,127,316 A 10/2000 Chapman
6,221,444 B1 4/2001 Okada
6,225,409 B1 5/2001 Davis
6,235,810 B1 5/2001 Pavluchenko
6,331,585 B1 12/2001 Merkel
6,332,953 B1 12/2001 Singh
6,402,865 B1 6/2002 Handa
6,410,479 B1 6/2002 Fukuchi
6,566,752 B2 5/2003 Hsia
6,596,451 B2 7/2003 Dontula
6,596,470 B2 7/2003 Matsumoto
6,694,885 B2 2/2004 Geddes
6,720,007 B2 4/2004 Walt
6,790,569 B2 9/2004 Yang
6,958,860 B2 10/2005 Dontula
7,026,024 B2 4/2006 Chang
7,041,369 B1 5/2006 Mackey
7,071,145 B2 7/2006 Morita
7,112,399 B2 9/2006 Dickerson
7,160,608 B2 1/2007 Yanagisawa
7,182,532 B2 2/2007 Johnson
7,435,783 B2 10/2008 Blankenship
7,465,343 B2 12/2008 Prasad
7,507,453 B2 3/2009 Geddes
7,579,081 B2 8/2009 Brown

| | | | |
|---|---|---|---|
| 7,651,216 | B2 | 1/2010 | Chen |
| 7,651,747 | B2 | 1/2010 | Chen |
| 7,671,878 | B2 | 3/2010 | Yamada |
| 7,762,188 | B2 | 7/2010 | Iftime |
| 7,858,161 | B2 | 12/2010 | Nair |
| 7,910,633 | B2 | 3/2011 | Mellott, II |
| 8,054,323 | B2 | 11/2011 | Peters |
| 2003/0089450 | A1 | 5/2003 | Lin |
| 2008/0160233 | A1 | 7/2008 | Luther |

FOREIGN PATENT DOCUMENTS

| | | |
|---|---|---|
| GB | 1389122 | 8/1972 |
| GB | 1468398 | 3/1977 |
| GB | 1488554 | 10/1977 |
| WO | WO 93/00390 | 1/1993 |

OTHER PUBLICATIONS

The Society of Polymer Science, Japan, "Polymer Data Handbook", p. 44, Basic Edition, Baifukan Co., Japan.

J. Brandrup, "Polymer Handbook", 1989, p. 45, 46, 554, 555, 3rd Edition, John Wiley & Sons, New York, NY.

George S. Brady, "Material's Handbook", 1991, pp. 151, 152, 51, 13th Edition, McGraw-Hill Inc., New York, NY.

A.F.M. Barton, "Chemical Reviews", Article name: "Solubility Parameters", 1975, vol. 75 #6, pp. 731-753, American Chemical Society, Washington, DC.

Encyclopedia of Chemical Technology, 1971, pp. 889-910, Interscience Publishers, New York, NY.

* cited by examiner

THERMOGRAPHIC IMAGING ELEMENT

REFERENCE TO RELATED PATENT APPLICATION

This application claims priority based upon applicants' provisional application U.S. Ser. No. 61/342,011, filed on Apr. 8, 2010.

FIELD OF THE INVENTION

A thermographic substrate comprised of a thermosensitive layer, wherein said thermosensitive layer is comprised of a binder, a multiplicity of hollow sphere organic pigments, and a thermal solvent.

BACKGROUND OF THE INVENTION

Direct thermal imaging is widely used for printing variable information; for example, this imaging method is commonly used to print facsimiles, receipts, shipping address labels, barcodes and prescription labels. Direct thermal imaging or printing is accomplished by directing heat to specific regions of thermosensitive coated substrate resulting in a change in the color of the region which was heated. Imagewise heating of the thermosensitive substrate is accomplished using a thermal printer such as, for example, the printers provided by Zebra Corporation of 475 Half Day Road, Suite 500, Lincolnshire, Ill. 60069. Such printers contain thermal printheads comprised of linear arrays of individually addressable heating elements, typically containing 60 to 236 such heating elements per linear centimeter of printhead. The thermal printhead is placed in intimate contact with the thermosensitive substrate. As the substrate is caused to move beneath the printhead, the individual heating elements are caused to heat in an imagewise pattern, imaging one complete line across the thermosensitive substrate at a time. Typical printing speeds range from 2.5 centimeters per second cm/s to 30 centimeters per second.

Direct thermal imaging has been widely accepted as a fast and efficient digital printing method. However, this printing technology has a significant weakness, i.e., the stability of the printed image to fading from exposure to sunlight. Thus, e.g., U.S. Pat. No. 6,034,704 of Stewart discloses that thermally activated substrates produce images which can be expected to fade. Labels, facsimiles and receipts printed on direct thermal sensitive substrates will fade quickly if they are not stored in a dark environment. Many labeling applications require the printing of variable information onto substrates for outdoors usage and consequently require good resistance to fading induced by exposure to sunlight.

It is an object of this invention to provide a thermographic substrate assembly that affords good resistance to fading induced by exposure to sunlight.

SUMMARY OF THE INVENTION

In accordance with this invention, there is provided a thermographic substrate assembly comprised of a colorant and a flexible substrate, wherein said thermographic substrate assembly is further comprised of a thermosensitive layer, and wherein said thermosensitive layer is comprised of a binder, a multiplicity of hollow sphere organic pigments, and a thermal solvent.

DESCRIPTION OF THE PREFERRED EMBODIMENTS

Figure 1:
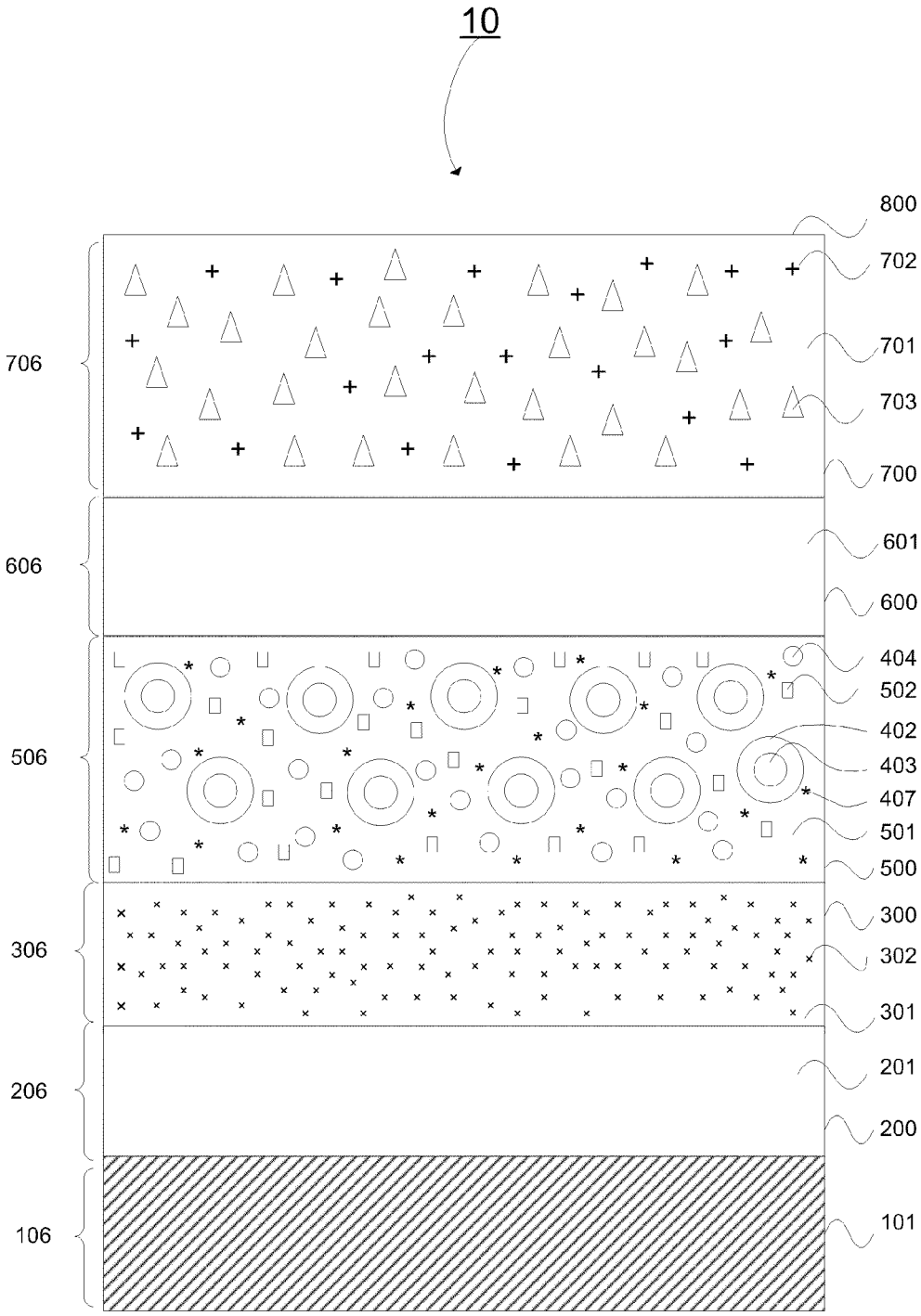
FIGS. 1 through 5 are schematics of preferred thermographic substrate.

In one embodiment of the invention, there are disclosed thermographic materials and, in particular, direct thermal imaging substrates capable of developing sufficient visual contrast such that human and machine readable images may be printed by direct heating of said substrates with a thermal printhead and have sufficient resistance to image fading that they are suitable for outdoors applications.

In one embodiment, hollow sphere polymer particles are used in the thermographic imaging element of the invention.

Innovative ways to whiten coated layers using microvoids have evolved to overcome the limitation of blushing lacquers. For example, U.S. Pat. No. 4,427,836 of Kowalski, the entire disclosure of which is hereby incorporated by reference into this specification, describes multiple-stage core-sheath polymer dispersions comprised of microvoids. These hollow spheres polymer particles have certain advantages as opacifying agents in aqueous coating solutions either as a supplement to, or replacement of, conventional inorganic pigments. However, these polymer particles have poor solvent resistance, limiting their use almost exclusively to aqueous systems. Marketing literature on hollow organic pigments from Rohm and Haas warns to avoid using solvents and plasticizers with solubility parameters similar to the hollow sphere organic pigments in coating compositions. Such solvents can soften the polymer shell of the pigment, causing collapse of the spheres during film formation. See, e.g., (http://www.rohmhaas.com/assets/attachments/business/architectural_and_functional_coatings/ropaque_opaque_pigment/ropaque_ultra-e/tds/ropaque_ultra-e.pdf).

Claim 12 of Kowalski describes: "12. A composition comprising an aqueous dispersion of water-insoluble core/sheath polymer particles having an average diameter of 0.07 to 4.5 microns, having a core polymerized from a monomer system comprising one or more monoethylenically unsaturated monomers having a group of the formula —HC═C<, at least one of said unsaturated monomers having a carboxylic acid group, and having at least one sheath polymerized from at least one different monomer system, at least one of said different monomer systems being hard and producing a polymer (a) having a T.sub.i greater than 50.degree. CELSIUS, (b) being non film-forming at 20.degrees Celsius, (c) being permeable to ammonia and amines, said core being swollen by neutralization with ammonia or amine in the presence of water, said particles having a property such that when subsequently dried a single cavity forms in said core and said particles cause opacity in compositions in which they are contained." The core/sheath polymer particles described and claimed in Kowalski may be used in the thermographic element of this invention.

Claim 15 of U.S. Pat. No. 4,427,836 describes the core/sheath polymer particles as being " . . . dried core/sheath particles having a single cavity in said core and an average particle size of about 0.07 to 4.5 micron and having a core polymerized from a monomer system comprising one or more monoethylenically unsaturated monomers having a group of the formula —HC═C<, at least one of said unsaturated monomers having a carboxylic acid group, and having at least one sheath polymerized from at least one different monomer system, at least one of said different monomer systems being hard and producing a polymer (a) having a T.sub.i greater than 50 degrees Celsius, (b) being non film-forming at 20 degree Celsius, (c) being permeable to ammonia and amines, said core having been swollen by neutralization with ammonia or amine in the presence of water, and subsequently dried."

Claim 17 of U.S. Pat. No. 4,427,836 describes the core/sheath product as being present " . . . at a pigment volume concentration of 5 to 50 percent or higher . . . ."

Claim 20 of U.S. Pat. No. 4,427,836 describes the core/sheath product as being, prior to swelling, " . . . essentially impermeable at 20 degrees Celsius to fixed or permanent bases including sodium, potassium, calcium and magnesium hydroxide."

Additional disclosure regarding the hollow sphere particles is presented elsewhere in this specification.

In one embodiment of the invention, there are provided thermographic materials and, in particular, direct thermal imaging substrates capable of developing sufficient visual contrast such that human and machine readable images may be printed by direct heating of said substrates with a thermal printhead and have sufficient resistance to image fading that they are suitable for outdoors applications. Such visual contrast preferably is thermally developed by altering the light scattering capability of the layers comprising the direct thermal imaging substrate such that layers of low color saturation may become higher in color saturation or white opaque top-coatings become transparent, revealing underlying colored layers. Optionally and additionally, underlying layers of low color saturation may become higher in color saturation through the application of heat to said substrates, improving contrast of said images further.

The thermographic materials of this embodiment are preferably comprised of thermo-sensitive layers applied to thin, flexible substrates suitable for a variety of digital thermal printing applications such as receipts, tickets, labels, tags, bar codes and the like. Said thermo-sensitive layers are comprised of hollow organic pigments, thermal solvents, binders and optionally colorants. The thermal solvent is a solid or liquid substance with solubility characteristics similar to those of the hollow microsphere polymeric pigment. Upon application of heat to said thermosensitive layers, the combination of heat and thermal solvent is able to soften or dissolve the wall of the hollow organic pigment, leading to the collapse of the void contained in the hollow microsphere and resulting in a decrease in opacity of the thermosensitive layer.

A further advantage of this embodiment is that it does not rely on leuco dye based thermographic chemistries which are prone to light fade. Additionally, it does not rely upon iron based thermographic chemistries which tend to gain background density upon exposure to light. This preferred embodiment is able to utilize conventional color pigments, either in an underlying substrate or as a part of a thermosensitive layer. Numerous colored pigments are known to those skilled in the art to be resistant to fading from exposure to light and in particular to sun light. This inherent advantage of the instant invention enables direct thermal printable substrates to be prepared which are suitable for outdoor applications.

In this embodiment, white opaque thermosensitive layers comprised of hollow particle plastic pigments and thermal solvents may be coated over colored substrates. Heat from a thermal printhead renders the white opaque layer sufficiently transparent that the underlying colored substrate is revealed and sufficient visual contrast is developed between the heated and unheated portions of the substrate such that human and machine readable images can be read.

In this embodiment, the thermosensitive layers may additionally comprise pigments capable of absorbing light. Such thermal sensitive layers are opaque and low in color saturation when initially applied to a flexible substrate. However, upon heating with a thermal printhead such layers will become more transparent, enabling the colored pigment to impart color saturation to the layer. Such pigmented thermosensitive layers develop sufficient visual contrast between the heated and unheated portions of the substrate such that human and machine readable images can be read.

In a preferred aspect of this embodiment, a flexible substrate is first coated with a pigmented thermally sensitive layer, and then the pigmented layer is overcoated with a white opaque thermally sensitive layer. In this embodiment, heat from the thermal printhead tranparentizes both layers, allowing the underlying pigmented layer's increased color saturation to be clearly visible. Because the underlying pigmented thermo-sensitive layer is initially low in color saturation, a thinner white opaque thermal sensitive overcoat is required to produce a thermosensitive substrate with low background density or color saturation. A thermosensitive substrate with low background color saturation capable of developing marks of high color saturation with selective application of heat from a thermal printhead has the advantage of being high in visual contrast, making it very suitable for human and machine readable applications.

DEFINITIONS OF CERTAIN TERMS

In this specification, and in the claims, applicants have used certain terms that are described in the specifications and claims of prior United States patents. These terms are used in the same manner as they have been used in the prior patent(s); and they have the same meaning.

Thus, e.g., U.S. Pat. No. 7,182,532, the entire disclosure of which is hereby incorporated by reference into this specification, uses the following terms in its claims: "Knoop hardness" (claim 1), "Sheffield smoothness" (claim 6), "flexible support" (claim 9), "flexible polymeric support" (claim 10), " . . . poly(ethylene terephthalate), polypropylene, polyolefins, cellophane, polycarbonate, cellulose acetate, polyethylene, polyvinyl chloride, polystyrene, polyimide, polyvinylidene chloride, polyvinyl alcohol, fluororesin, chlorinated resin, ionomer, and mixtures thereof . . . (claim 11), "flexible paper" (claim 12), and "synthetic paper" (claim 36).

Thus, e.g., U.S. Pat. No. 7,507,453, the entire disclosure of which is hereby incorporated by reference into this specification, uses the following terms in its claims: "ink layer" (claim 1), "heat activatable layer" (claim 1), "elongation to break" (claim 1), "peel force" (claim 1), "solid carbonaceous binder" (claim 5), "coating weight" (claim 6), "softening point" (claim 7), "synthetic resin" (claim 9), "wax" (claim 14), "colorant" (claim 21), and "opacifier" (claim 24).

DETAILED DESCRIPTION OF SOME OF THE PREFERRED EMBODIMENTS

FIG. 1 is a schematic representation of a thermographic substrate 10 made in accordance with one preferred process of this invention; this Figure is not necessarily drawn to scale.

The term "substrate" used in this specification refers to a flexible material or support that is coated with one or more layers of thermosensitive compositions. By way of illustration and not limitation, one may use one or more of the substrates described in U.S. Pat. Nos. 7,182,532, 6,694,885 and 7,507,453, and 5,665,670. The entire disclosure of each of these patents is hereby incorporated by reference into this specification.

In the preferred embodiment depicted in FIG. 1, the substrate 101 is comprised of a synthetic paper substrate. In one aspect of this embodiment, said substrate 101 is optionally comprised of clay or calcium carbonate treated synthetic papers. These synthetic papers are well known to those skilled in the art. Thus, by way of illustration and not limitation, one may use one or more of the synthetic papers sold by the Hop Industries Corporation of 174 Passaic Street, Garfield, N.J. Thus, e.g., one may use HOP 5.9 microns synthetic paper. Thus, e.g., one may use "HOP-SYN Synthetic Paper," DLI grade; this paper is clay modified polypropylene, and is a calendared plastic sheet made from a mixture of clay, calcium carbonate and polypropylene resin. Thus, e.g., reference may also be had to U.S. Pat. No. 7,858,161, the entire disclosure of which is hereby incorporated by reference into this specification; claim 8 of this patent refers to, e.g., "paper" and "synthetic paper."

By way of further illustration, one may use one or more of the synthetic papers available (as oriented polypropylene and polyethylene based synthetic papers) as "Yupo synthetic paper" from Oji-Yuka Synthetic Paper Co. of Tokyo, Japan. One may use the "Polyart synthetic paper" obtainable from Arjobex of Paris, France. One may use the "Kimdura synthetic paper" sold by Neenah Paper Corporation of Neenah, Wis. These and other synthetic papers are well known and are disclosed, e.g., in U.S. Pat. Nos. 5,474,966, 6,086,987, and 5,108,834 and in United States published patent application 2003/0089450; the entire disclosure of each of these patent documents is hereby incorporated by reference into this specification.

In one preferred embodiment, the substrate 101 either consists essentially of or comprises at least 80 weight percent of a synthetic polymeric material such as, e.g., polyethylene, polyester, nylon, polypropylene, polycarbonate, polyethylene-co-propylene, and the like.

In one preferred embodiment, the substrate 101 comprises at least about 90 weight percent of polyethylene or polypropylene or polybutylene, polyvinyl chloride, polyethylene terephthalate, polycarbonate, and mixtures thereof.

The substrate 101 preferably has a thickness 106 of from about 25 microns to about 250 microns. It is preferred that the thickness of said support not vary across the substrate 101 by more than about 15 percent.

In one embodiment, the support does soften when exposed to solvent(s) or water.

In one embodiment, the substrate 101 preferably comprises at least about 80 weight percent of, or consists essentially of, a cellulosic material such as, e.g., paper.

When paper is used as substrate 101, it preferably has a weight per unit area of at least about 50 to about 200 grams per square meter. In one embodiment, the basis weight of the paper is from about 45 to about 65 grams per square meter.

In one embodiment, the substrate 101 is a 90 grams per square meter basis paper made from bleached softwood and hardwood fibers. In one aspect of this embodiment, the surface of this paper is sized with starch.

In one embodiment, the substrate 101 has a Sheffield smoothness of from about 1 to about 150 Sheffield Units and, more preferably, from about 1 to about 50 Sheffield Units. Means for determining Sheffield smoothness are well known. Reference may be had, e.g., to U.S. Pat. Nos. 5,451,559, 5,271,990, 5,716,900, 6,332,953, 5,985,424, and the like. The entire disclosure of each of these United States patents is hereby incorporated by reference into this specification.

In one embodiment the substrate 101 may be comprised of a layered composite of natural and synthetic papers.

In one embodiment, the substrate 101 has a surface energy greater than 30 dynes per centimeter. Surface energy, and means for measuring it, are well known to those skilled in the art. Reference may be had, e.g., to U.S. Pat. Nos. 5,121,636; 6,225,409; 6,221,444; 6,075,965; 6,007,918; 5,777,014; and the like. The entire disclosure of each of these United States patents is hereby incorporated by reference into this specification.

In one embodiment, the substrate 101 has a surface energy of more than about 40 dynes per centimeters.

In one preferred embodiment, the substrate 101 either consists essentially of or comprises at least 80 weight percent of a synthetic polymeric resins such as, e.g., polyethylene, polyvinyl chloride polyester (such as polyethylene terephthalate), nylon, polyimide, polypropylene, polycarbonate, cellulose acetate, cellulose nitriate, polylactic acid and the like. Such synthetic substrates 101, comprised of thermoplastics, may preferably be extruded and biaxially oriented to form a film of uniform thickness and high surface smoothness. Multilayer substrates 101 comprised of thermoplastics may be coextruded together such that composite film substrates are prepared. Such multi-layer substrates may differ in composition from core to skin. In one preferred embodiment, the core of a multilayer substrate 101 is microvoided while the surface skins are unvoided.

U.S. Pat. No. 5,604,079 of Campbell describes various microvoided substrates in U.S. Pat. No. 5,604,078; the entire disclosure of this patent is hereby incorporated by reference into this specification. As is disclosed in this patent, "Microvoided composite packaging films are conveniently manufactured by coextrusion of the core and surface layers, with subsequent biaxial orientation, whereby voids are formed around void-initiating material contained in the core layer. Such composite films are disclosed in, for example, U.S. Pat. No. 4,377,616 . . . . The core of the composite film should be from 15 to 95% of the total thickness of the film, preferably from 30 to 85% of the total thickness. The nonvoided skin(s) should thus be from 5 to 85% of the film, preferably from 15 to 70% of the thickness. The density (specific gravity) of the composite film should be between 0.2 and 1.0 g/cm.sup.3, preferably between 0.3 and 0.7 g/cm.sup.3. As the core thickness becomes less than 30% or as the specific gravity is increased above 0.7 g/cm.sup.3, the composite film starts to lose useful compressibility and thermal insulating properties. As the core thickness is increased above 85% or as the specific gravity becomes less than 0.3 g/cm.sup.3, the composite film becomes less manufacturable due to a drop in tensile strength and it becomes more susceptible to physical damage. The total thickness of the composite film can range from 20 to 150 .mu.m, preferably from 30 to 70 .mu.m. Below 30 .mu.m, the microvoided films may not be thick enough to minimize any inherent non-planarity in the support and would be more difficult to manufacture. At thicknesses higher than 70 .mu.m, little improvement in either print uniformity or thermal efficiency are seen, and so there is little justification for the further increase in cost for extra materials."

U.S. Pat. No. 4,377,616 discloses that: "Void" is used herein to mean devoid of added solid and liquid matter, although it is likely the "voids" contain gas. The void-initiating particles which remain in the finished packaging film core should be from 0.1 to 10 .mu.m in diameter, preferably round in shape, to produce voids of the desired shape and size. The size of the void is also dependent on the degree of orientation in the machine and transverse directions. Ideally, the void would assume a shape which is defined by two opposed and edge contacting concave disks. In other words, the voids tend to have a lens-like or biconvex shape. The voids are oriented so that the two major dimensions are aligned with the machine and transverse directions of the film. The Z-direction axis is a minor dimension and is roughly the size of the cross diameter of the voiding particle. The voids generally tend to be closed cells, and thus there is virtually no path open from one side of the voided core to the other side through which gas or liquid can traverse."

Referring again to Figure, and in another embodiment, such substrate(s) 101 may be deposited from solvents onto a smooth drum and dried.

In a preferred embodiment the substrate 101 is comprised of a renewable material such as cellulose, cellulose derivative(s), polylactic acid, and the like.

As the support usable in the present invention, there are preferred polyester films such as polyethylene terephthalate film, polybutylene terephthalate film, polyethylene naphthalate film, polybutylene naphthalate film, polyarylate film, polycarbonate film, polyamide film, aramid film, polyether sulfone film, polysulfone film, polyphenylene sulfide film, polyether ether ketone film, polyether imide film, modified polyphenylene ether film and polyacetal film, and other various plastic films commonly used for the support of recording media of this type.

In one preferred embodiment, the substrate 101 either consists essentially of or comprises at least 80 weight percent of a synthetic polymeric resin such as, e.g., polyethylene, polyester, nylon, polypropylene, polycarbonate, cellulose acetate, cellulose nitriate, polylactic acid and the like.

In a preferred embodiment, the uncoated substrate 101 (see FIG. 1) has a surface energy greater than 35 dynes per centimeter and a smoothness of from about 10 to about 150 Sheffield Units.

Referring again to FIG. 1, in one embodiment the substrate 101 is paper that is preferably coated with and contiguous with a surface layer 200 comprised of resin. Thus, e.g., the paper may be extrusion coated with a resin at a coat weight of 10 to 40 grams per square meter. In this embodiment, the resin comprises a polyolefin, such as, e.g., polyethylene, polypropylene, polybutylene, and mixtures thereof. Said resin may be coated means of extrusion, at a temperature of from about 200 to about 300 degrees Celsius. Extrusion coating of a resin is well known. Reference may be had, e.g., to U.S. Pat. Nos. 5,104,722, 4,481,352, 4,389,445, 5,093,306, 5,895,542, and the like. The entire disclosure of each of these United States patents is hereby incorporated by reference into this specification.

In a preferred embodiment, substrate 101 is white in color. In another preferred embodiment, substrate 101 is colored and is comprised of colorant. The term colorant is defined elsewhere in this specification.

Surface layer 200 may be comprised of various pigments, clays and latex polymers such as those described in U.S. Pat. No. 4,521,494, the entire disclosure of which is hereby incorporated by reference.

In one embodiment the surface layer 200 has a surface energy greater than 30 dynes per centimeter.

In one embodiment, the surface layer 200 preferably comprises a material that, when coated upon the substrate 101, provides a smooth surface with a surface energy of at least 35 dynes per centimeter. Said surface layer 200 may optionally be treated with by flame, plasma or corona to raise said surface energy to at least 40 dynes per cm.

In one embodiment, the preferred surface layer coating 200 is substantially smooth. In one aspect of this embodiment, the coated substrate has a Sheffield smoothness of from about 1 to about 150 Sheffield Units and, more preferably, from about 1 to about 50 Sheffield units.

Referring again to FIG. 1, and in the preferred embodiment depicted therein, the surface layer 200 may be of any composition that will produce the desired surface energy and smoothness upon coating the substrate 101. Thus, by way of illustration and not limitation, one may utilize cured or uncured polyurethane, polyvinyl chloride, polyacrylate, polyamide, polyester, polyvinyl alcohol, polyimide, polyurea, titinate, ziconate, silane and combinations thereof.

In one embodiment, and referring again to FIG. 1, surface layer coating 200 is comprised of voids. Those skilled in the art are well aware of various means for producing a surface layer coating that is comprised of voids. Such voids may be formed through a variety of means. For example, in U.S. Pat. No. 6,402,865, the entire disclosure of which is hereby incorporated by reference into this specification, Handa describes the use of blowing agents to create holes or voids in a layer structure, stating "The above layered morphology development process in a polymer containing dissolved blowing agent is similar to the microcellular foaming process. See, for example, U.S. Pat. No. 4,473,665 issued on Sep. 25, 1984, assigned to J. E. Martini-Vvedensky et al.; U.S. Pat. No. 5,223,545, issued on Jun. 29, 1993, assigned to V. Kumar; U.S. Pat. No. 5,670,102 issued on Sep. 23, 1997, assigned to C.A. Perman et al. However, as mentioned earlier, the layered structure is produced when the temperature of the polymer-blowing agent system is below its T.sub.g whereas in microcellular or conventional foaming, the processing temperature is above the system's T.sub.g. If the process described here is carried out at a temperature above the system's T.sub.g, a cellular structure develops in the material and the desired layered morphology can not be achieved."

Voids may also be created within a layer by incorporation of incompatible particles within said layer and then orienting or stretching said layer, see for example U.S. Pat. Nos. 6,958,860, 5,494,735, 6,596,451, 5,462,788, 5,935,904 and 7,762,188.

Voids may also be created within a layer by incorporation of expandable particles. Thus, e.g., in U.S. Pat. No. 5,834,526, Wu discloses the use of said expandable particles in various packaging materials, stating that: "Thermoplastic hollow expandable particles having volatile liquid blowing agents encapsulated therein are described in U.S. Pat. No. 3,615,972 to Morehouse, et al. The blowing agents are described as aliphatic hydrocarbons, chlorofluorocarbons, or tetraalkyl silanes. The particles are said to be prepared by combining an oil phase containing monomer and blowing agent with an aqueous phase, and agitating violently. Use of perfluorinated blowing agents or ways to improve encapsulation of such blowing agents are not described. U.S. Pat. No. 4,108,806 to Cohrs, et al., teaches that the expandable synthetic resinous microspheres of U.S. Pat. No. 3,615,972 can be mixed with certain resins and extruded, thereby incorporating the microspheres in the resin and then the microspheres expanded. The only microspheres exemplified are ones made of a copolymer shell of styrene and acrylonitrile having isobutane encapsulated therein. U.S. Pat. No. 5,429,869 to McGregor, et al., describes use of the microspheres of U.S. Pat. No. 3,615,972 in a process for expanding polytetrafluoroethylene. PCT Publication No. WO 93/00390 to 3M Corporation describes composite articles of a fibrillated polyolefin matrix and energy expandable hollow polymeric particles, which upon expansion of the particles provides thermal insulation. This publication teaches that the expandable microspheres are made of a shell of vinyl or vinylidene halides or copolymers of styrene or methylmethacrylate. The blowing agents are described as those disclosed in U.S. Pat. No. 3,615,972 and U.S. Pat. No. 4,483,889. Use of perfluorobutanes, perfluoropentenes and perfluorohexanes is described, but no means of incorporating such compounds inside the microspheres is taught."

Referring again to FIG. 1, Voids may also be incorporated into surface layer 200 by the addition of hollow sphere organic pigments which are described elsewhere in this specification.

Surface layer 200 preferably has a thickness 206 from about 0.01 micron to about 50 microns.

In one preferred embodiment, surface layer 200 has a thickness 206 from about 10 microns to about 30 microns.

In another preferred embodiment, surface layer 200 has a thickness 206 from about 0.05 microns to about 5 microns.

In another preferred embodiment, surface layer 200 contains voids. Such voids, in one aspect of this embodiment, have an average diameter from 0.1 micron to about 1.5 micron.

Referring again to FIG. 1, the thermographic substrate 10 contains an optional color layer 300. This optional color layer 300 preferably comprises one or more thermoplastic binder materials 301 in a concentration of from about 5 to about 95 percent, based upon the dry weight of colorant 302 and binder 301 in such color layer 300. In one embodiment, the binder 301 is present in a concentration of from about 66 to about 95 percent. In another embodiment, the color layer 300 comprises from about 75 to about 90 weight percent of binder 301.

One may use any of the polymeric binders 301 known to those skilled in the art. Thus, e.g., one may use one or more of the binders disclosed in U.S. Pat. Nos. 6,127,316, 6,124,239, 6,114,088, 6,113,725; 6,083,610, 6,031,556, 6,031,021, 6,013,409, 6,008,157, 5,985,076, and the like. The entire, disclosure of each of these United States patents is hereby incorporated by reference into this specification.

By way of further illustration, one may use a binder 301 which preferably has a multiplicity of polar moieties such as, e.g., one or more carboxyl groups, hydroxyl groups, chloride groups, carboxylic acid groups, urethane groups, amide groups, amine groups, urea, epoxy resins, mixtures thereof, and the like. Some suitable binders within this class include polyester resins, bisphenol-A polyesters, polyvinyl chloride, copolymers made from terephthalic acid, polymethyl methacrylate, vinylchloride/vinylacetate resins, epoxy resins, nylon resins, urethane-formaldehyde resins, polyurethane, mixtures thereof, and the like.

In one embodiment, the binder 301 is comprised of a mixture of two or more synthetic resins. Thus, e.g., one may use a mixture comprising from about 40 to about 60 weight percent of polymethyl methacrylate and from about 40 to about 60 weight percent of vinylchloride/vinylacetate resin. In this embodiment, these materials collectively comprise the binder.

In one embodiment, the binder 301 comprises polybutylmethacrylate and polymethylmethacrylate, comprising from 10 to 30 percent of polybutylmethacrylate and from 50 to 80 percent of the polymethyl methacrylate. In one embodiment, this binder comprises cellulose acetate propionate, ethylenevinylacetate, vinyl chloride/vinyl acetate, urethanes, etc.

One may obtain these binders 301 from many different commercial sources. Thus, e.g., some of them may be purchased from Dianal America Company of 9675 Bayport Blvd., Pasadena, Tex. 77507; suitable binders available from this source include "Dianal BR 113" and "Dianal BR 106." Similarly, suitable binders may also be obtained from the Eastman Chemicals Company (Tennessee Eastman Division, Box 511, Kingsport, Tenn.).

Referring again to FIG. 1, optional color layer 300 is preferably comprised of colorant 302. Said colorant 302 may comprise one or more dyes or pigments.

In one preferred embodiment, one or more of such colorants are light stable pigments that may be organic or inorganic. Herbst and Hunger in their book "Industrial Organic Pigments", classify colorants as either dyes or pigments. Pigments are defined as "inorganic or organic, colored, white or black materials which are practically insoluble in the medium in which they are incorporated". While most inorganic pigments are stable against fading due to exposure to sunlight, their colors are often muted and many hues can't be produced. Organic pigments on the other hand are capable of creating a large number of hues but their resistance to fade is largely dependent upon their chemical structure and crystal form.

In one embodiment, the colorants 302 are various organic and inorganic pigments as well as carbon black. Examples of such organic and inorganic pigments include azo pigments (such as monoazo yellow and orange, disazo, beta-napthol, napthol AS reds, azo lake, benzimidazolone, disazo condensation, metal complex azo, isoindolinone, isoindoline), polycyclic pigments (such as quinacridone, perylene, perinone, diketopyrrolo pyrrole and thioindigo), anthraquinone pigments (such as anthrapyrimidine, flavanthrone, pyranthrone, anthanthrone, dioxazine, triarylcarbonium and quinophthalone), phthalocyanine pigments, nitro pigments, nitroso pigments, nigrosine pigments, titanium white, calcium carbonate and barium sulfate. Such pigments may be used in combination with dyes for adjusting the color of the ink layer. The content of the coloring agent in the ink layer is preferably from about 1 percent to about 50 percent more preferably from about 5 percent to about 33 percent.

The colorant 302 may take the form of a soluble dye dissolved in the binder 301 color layer 300. Preferably, the colorant 302 is comprised of a pigment dispersed in the binder 301 of color layer 300. Additionally, any additive known to those skilled in the art, eg, dispersants, rheology modifiers, defoamers, surfactants, wetting agents, etc, may also be included as needed.

In a preferred embodiment, the coating fluid used to prepare color layer 300 is comprised of a surfactant. Surfactants are defined as "surface active agents" in Webster's Third International Dictionary (Unabridged). The use of surfactants in coating compositions is disclosed by Orem in U.S. Pat. No. 4,370,412, the entire disclosure of which is hereby incorporated by reference into this specification. Surfactants are compounds that lower the surface tension of a liquid, the interfacial tension between two liquids, or the interfacial tension between a liquid and a solid. Surfactants are used as detergents, wetting agents, emulsifiers, foaming agents, and dispersants. Surfactants are usually organic compounds that are amphiphilic, meaning they contain both hydrophobic groups (their tails) and hydrophilic groups (their heads). Therefore, a surfactant molecule contains both a water insoluble (oil soluble component) and a water soluble component. Surfactants reduce the surface tension of water by adsorbing at the liquid-gas interface. In addition, they reduce the interfacial tension between oil and water by adsorbing at the liquid-liquid interface. Surfactants are also often classified into four primary groups; anionic, cationic, non-ionic, and zwitterionic (dual charge).

For this application, the surfactant is used as a wetting agent. Wetting is the ability of a liquid to maintain contact with a solid surface, resulting from intermolecular interactions when the two are brought together. Many technological processes require control of liquid spreading over solid surfaces. By reducing the surface tension of a liquid with surfactants, a non-wetting material can be made to become partially or completely wetting.

Adhesive forces between a liquid and solid cause a liquid drop to spread across the surface. Cohesive forces within the liquid cause the drop to ball up and avoid contact with the surface. The contact angle is the angle at which the liquid-vapor interface meets the solid-liquid interface, which is determined by the resultant adhesive and cohesive forces. The tendency of a drop to spread out over a flat, solid surface increases as the contact angle decreases, so the contact angle provides an inverse measure of wettability. A contact angle less than 90° (low contact angle) usually indicates that wetting of the surface is very favorable, and the fluid will spread over a large area of the surface. Contact angles greater than 90° (high contact angle) generally means that wetting of the surface is unfavorable so the fluid will minimize contact with the surface and form a compact liquid droplet.

Surfactants are absorbed onto the liquid-vapor, solid-liquid, and solid-vapor interfaces, which modify the wetting behavior of hydrophobic materials to reduce the free energy. As the surfactants are absorbed, the solid-vapor surface tension increases and the edges of the drop become hydrophilic. As a result, the drop spreads.

In a preferred embodiment, the color layer 200 will be comprised of a defoamer. The use of defoamers in coated layers is disclosed by Merkel in U.S. Pat. No. 6,331,585, the entire disclosure of which is hereby incorporated by reference into this specification. The action of a defoamer is defined in Webster's Third International Dictionary (Unabridged) as "to remove the foam from". Thus, a defoamer or an anti-foaming agent is a chemical additive that reduces and hinders the formation of foam in industrial process liquids. Generally a defoamer is insoluble in the foaming medium and has surface active properties. An essential feature of a defoamer is low viscosity and a facility to spread rapidly on foamy surfaces. Defoamers have an affinity to the air-liquid surface where they destabilizes foam, causing the rupture of air bubbles and breakdown of surface foam. Defoamers also help entrained air bubbles to agglomerate and form larger bubbles which, in turn, can rise to the surface of the bulk liquid more quickly. There are several different types of defoamers, for example oil based, powder, water based, silicone based and alkyl polyacrylates.

Defoamers are well known and widely described in the patent literature. Reference may be had, e.g., to U.S. Pat. No. 7,910,633 (see claim 1); the entire disclosure of this patent is hereby incorporated by reference into this specification.

In a preferred embodiment, color layer 300 may also comprise dispersants to facilitate the dispersion of pigment based colorants 302. Dispersants are surface active compounds which help to separate pigment agglomerates into their primary particles in the dispersion process. See, for example, U.S. Pat. No. 4,522,654, the entire disclosure of which is hereby incorporated by reference into this specification.

In one preferred embodiment, colorant 302 is comprised of one or more transparent organic pigments such as, e.g., Naphthol Yellow S, Hansa Yellow 5G, Hansa Yellow 3G, Hansa Yellow G, Hansa Yellow GR, Hansa Yellow A, Hansa Yellow RN, Hansa Yellow R, Benzidine Yellow, Benzidine Yellow G, Benzidine Yellow GR, Permanent Yellow NCG and Quinoline Yellow Lake, Permanent Red 4R, Brilliant Fast Scarlet, Brilliant Carmine BS, Permanent Carmine FB, Lithol Red, Permanent Red F5R, Brilliant Carmine 6B, Pigment Scarlet 3B, Rhodamine Lake B, Rhodamine Lake Y and Arizalin Lake, Victoria Blue Lake, metal-free Phthalocyanine Blue, Phthalocyanine Blue and Fast Sky Blue, and dyes such as Rhodamine, Victoria Blue and carbon black. These coloring agents may be used either alone or in combination.

As used in this specification, the term "transparent pigment" refers to a pigment which gives a transparently colored ink when dispersed in binder 301 of color layer 300.

In one embodiment, the colorant 302 is comprised of one or more inorganic pigments. Thus, for example, a blue colorant can contain the oxides of a cobalt, chromium, aluminum, copper, manganese, zinc, etc. Thus, e.g., a yellow colorant can contain the oxides of one or more of lead, antimony, zinc, titanium, vanadium, gold, and the like. Thus, e.g., a red colorant can contain the oxides of one or more of chromium, iron (two valence states), zinc, gold, cadmium, selenium, or copper. Thus, e.g., a black colorant can contain the oxides of the metals of copper, chromium, cobalt, iron (plus two valence), nickel, manganese, and the like. Furthermore, in general, one may use colorants comprised of the oxides of calcium, cadmium, zinc, aluminum, silicon, etc.

Suitable pigments and colorants are well known to those skilled in the art. See, e.g., U.S. Pat. Nos. 6,120,637, 6,108,456, 6,106,910, 6,103,389, 6,083,872, 6,077,594, 6,075,927, 6,057,028, 6,040,269, 6,040,267; 6,031,021, 6,004,718, 5,977,263, and the like. The disclosure of each of these United States patents is hereby incorporated by reference into this specification.

Color layer 300 preferably has a thickness 306 from about 0.01 micron to about 25 microns.

In one preferred embodiment, color layer 200 has a thickness 306 from about 10 microns to about 20 microns.

In another preferred embodiment, color layer 200 has a thickness 306 from about 0.1 microns to about 5 microns.

Thermosensitive Layer 500

Referring again to FIG. 1, and in the preferred embodiment depicted therein, thermographic substrate 10 is comprised of a thermosensitive layer 500. The Webster's Third New International Dictionary (Unabridged) defines thermosensitive as "relating to or being a material that is in one or more ways sensitive to heat".

Thermosensitive layers are well known to those skilled in the art. Thus, e.g., U.S. Pat. No. 7,671,878, the entire disclosure of which is hereby incorporated by reference into this specification, claims: "1. A thermal printer comprising: a feeding mechanism which feeds one of thermal papers which include a double-sided thermal paper having thermosensitive layers formed on both sides thereof and a single-sided thermal paper having a thermosensitive layer formed on one side thereof; a first thermal head which is so provided as to be brought into contact with a first side of the thermal paper fed by the feeding mechanism and is configured to print an image on the first side of the paper; a second thermal head which is so provided as to be brought into contact with a second side of the thermal paper fed by the feeding mechanism and is configured to print an image on the second side of the paper; a mark determination section which is configured to determine whether a mark has been printed on at least one of the first and second sides of the thermal paper; and a controller which is configured to control print operation based on a determination result from the mark determination section, wherein the controller is configured to control double-sided printing by the first and second thermal heads in the case where the mark determination section has determined that a mark has been printed on both the first and second sides of the thermal paper, the controller is configured to control single-sided printing by the first thermal head in the case where the mark determination section has determined that a mark has been printed on the first side of the thermal paper and control single-sided printing by the second thermal head in the case where the mark determination section has determined that a mark has been printed on one of the second side of the thermal paper." The thermosensitive layer described in U.S. Pat. No. 7,671,878 may be used in the process of this invention.

Thus, e.g., U.S. Pat. No. 7,071,145 of Morita, the entire disclosure of which is hereby incorporated by reference into this specification, claims: "1. A thermosensitive recording material comprising an under layer comprising hollow particles and a thermosensitive layer provided on a substrate in this order, wherein the thermosensitive layer comprises a leuco dye and a color developer, the color developer is an oligomer composition obtained from the reaction of a polyvalent isocyanate compound represented by following Formula (I) with an aromatic amine represented by following Formula (II) . . . in which X represents a tri- or more-valent group, a represents an integer numeral of 3 or more, b and c represent respectively integer numerals in the range of 0 to 5 and they satisfy a relation of b+c=1 to 5, Z represents hydrogen atom, alkyl group, allyl group or aryl group, and the aryl group may include condensed ring structure thereof, and d represents an integer numeral in the range of 0 to 4." The thermosensitive layer described in U.S. Pat. No. 7,671,878 may be used in the process of this invention.

Thus, e.g., U.S. Pat. No. 5,919,729 of Mori, the entire disclosure of which is hereby incorporated by reference into this specification, claims: "1. A thermosensitive recording medium comprising a support, a thermosensitive layer provided on said support and capable of forming a color image when heated imagewise, and a protecting layer provided on said thermosensitive layer and containing a pigment and a core-shell resin obtained by polymerizing a vinyl monomer in an emulsion containing acrylonitrile-containing polymer seeds so that a polymer of said vinyl monomer is copolymerized on each of said seeds to form a shell surrounding a core of said seed, said vinyl monomer containing acrylamide and/or methacrylamide, wherein said core-shell resin meets with the following criteria (a) and (b): (a) the glass transition point Tg of said core is at least 20 degrees Celsius; and (b) the glass transition point Tg of said shell is at least 200 degrees Celsius" The thermosensitive layer described in U.S. Pat. No. 5,919,729 may be used in the process of this invention.

In one embodiment of applicants' invention, two different thermosensitive layers are preferably used, one that goes from gray to black, and another that goes from white to clear. It is to be understood that, although applicants have disclosed particular preferred embodiments of each of these individual thermosensitive elements, other "prior art" individual thermosensitive elements also may be used.

Referring again to FIG. 1, and to the preferred embodiment depicted therein, thermosensitive layer 500 is coated over color layer 300. Such compositions, when applied to thin, flexible substrates, have a variety of digital thermal printing applications such as, e.g., receipts, tickets, labels, tags, bar codes and the like.

Thermosensitive layer 500 enables the direct thermal imaging of substrates with several advantages: (1) no leuco dyes or phenolic compounds are required, (2) no expensive silver-based chemistry is required, (3) no difficult to control blushing lacquers are required, (4) layers may be coated from water, eliminating the need for expensive solvent coating vehicles, (5) a light-stable color dye or pigment may be used, offering a nearly limitless variety of imaged colors, (6) thermal imaging of the substrate is accomplished with a digital thermal printer, (7) images have excellent durability, being resistant to fade, abrasion, water, hand sanitizers, suntan lotion, etc.

In one preferred embodiment, the thermosensitive layer 500 is comprised of hollow organic pigments 402, thermal solvents 404, binders 501 and optional colorants 502. Applicants have described particular embodiments of such hollow organic pigments, thermal solvents, binders, and colorants in this specification. It is to be understood, however, that other "prior art" embodiments of such materials also may be used.

Thermosensitive layer 500 is preferable coated from water, although such thermosensitive layer may be coated from other solvents or, alternatively, may be a 100 percent solid system that is in a liquid phase when coated and under the conditions of the coating.

In one embodiment, water-based compositions are prepared such that many of the components remain separated and not intimately mixed at the time of coating and drying. In one embodiment, thermosensitive layer 500 is comprised of dispersions of solids, emulsions of liquids, microcapsules, hollow sphere polymeric particles and the like.

In one preferred embodiment, thermosensitive layer 500 is comprised of a continuous phase binder 501 in which said dispersions, emulsions, microcapsules and hollow sphere polymer particles are dispersed.

Thermosensitive layer 500 preferably has a coating weight 506 of 0.5 to 20 grams per square meter, more preferably from 1 to 10 grams per square meter.

Hollow Organic Pigments

In one preferred embodiment, the thermographic substrate 10 is comprised of hollow organic pigments. Many of such pigments are described in the prior art; and such prior art hollow pigments may be used in the process of this invention.

Thus, e.g., U.S. Pat. No. 7,160,608 of Yanagisawa, the entire disclosure of which is hereby incorporated by reference into this specification, claims: "1. A coated paper comprised of a paper substrate, at least one surface of which is provided with at least one coating layer, characterized in that the surface of said coating layer has cracks of a width of 0.2 to 3.0 μm and a length of 3 to 1000 μm in an amount of 1 to 1000 cracks per $mm^2$; wherein said surface of said coating layer has a white paper glossiness of 45 to 85 percent at a light-incident arid receipt angle of 75 degrees in accordance with JIS S 8741 and an Oken type air permeability of not more than 8000 sec. in accordance with the JAPAN TAPPI Pulp and Paper Testing Method No. 5-2:000; said coating layer contains thermoplastic organic microparticles having a glass transition temperature of 20 to 150° Celsius; and, 100 parts by mass of said coating layer contains 40 to 90 parts by mass of an inorganic pigment and 5 to 60 parts by mass of said thermoplastic organic microparticles." The organic microparticles of this patent may be used in the process of this invention.

Thus, e.g., U.S. Pat. No. 7,651,216 of Chen, the entire disclosure of which is hereby incorporated by reference into this specification, claims: "1. A fusible print medium, comprising: a substrate; an ink-receiving layer disposed on the substrate, wherein the ink-receiving layer includes a plurality of hollow beads having a diameter from about 0.3 to 5 μmeters, a void volume of about 20 percent to 70 percent, and a glass transition temperature above 50° Celsius, wherein the hollow beads have substantially the same diameter, and wherein the hollow beads are at least 70 percent of the ink receiving layer." The hollow beads of this patent may be used in the process of this invention.

Thus, e.g., U.S. Pat. No. 7,651,747 of Chen claims: "1. A fusible print medium for use in inkjet printing, consisting of: a substrate; a fusible first ink-receiving layer; and, a second ink-receiving layer disposed between said first layer and said substrate, wherein said fusible first ink-receiving layer includes a mixture comprising: a first plurality of discrete particles comprising at least one hollow organic pigment; and a second plurality of discrete particles comprising at least one solid plasticizer having a melting point between about 40° Celsius and about 150° C. and below a glass transition temperature of the at least one hollow organic pigment; and wherein said medium is formulated to form a fused surface layer approximately 0.2 μm to approximately 10 μm thick on said second ink-receiving layer on said substrate . . . ." The hollow organic pigments of this patent may be used in the process of this invention.

Chen '747 discloses hollow organic pigments and that the void volume of such pigments may range from 10 percent to 90 percent. Webster's Third International Dictionary (Unabridged) defines pigment as "a natural or synthetic inorganic or organic substance that imparts a color including black or white to other materials." The hollow organic pigments of this patent may be used in the process of this invention.

U.S. Pat. No. 5,162,289 of Betts, the entire disclosure of which is hereby incorporated by reference into this specification, describes hollow microsphere polymer pigment 402. Betts discloses that: "Plastic pigment particles, including hollow plastic pigment particles, are themselves well-known in the paper industry as constituents of coating compositions. Solid plastic pigments form the subject of Chapter 6 of Tappi Monograph No. 38 entitled "Paper Coating Pigments", published 1976, and are also the subject of a sub-section on pages 2073 and 2074 of "Pulp &Paper—Chemistry &Chemical Technology" edited by James P. Casey, 3rd Edition, Volume IV, published in 1976 by John Wiley &Sons. Examples of patents on plastic pigments and/or their use in paper coatings are British Patents Nos. 1229503; 1468398 and 1488554. Hollow plastic pigments and their use in paper coatings are disclosed in British Patents Nos. 1270632 and 1389122; in a paper given at the 1984 Tappi Coating Conference by C. P. Hemenway, J. J. Latimer and J. E. Young entitled "Hollow-Sphere Polymer Pigment in Paper Coating" and in an article entitled "Hollow-Sphere Pigment Improves Gloss, Printability of Paper" by W. J. Haskins and D. I. Lunde in "Pulp &Paper", May 1989 edition. Similar hollow plastic pigments are also the subject of product information literature published by Rohm & Haas Company of Philadelphia, USA in relation to its products sold under the trade mark "Ropaque"." Claim 1 of Betts describes a "1. Pressure-sensitive copying paper comprising: a paper base; a coating of pressure-rupturable microcapsules on the paper base, the microcapsules containing a solution in an oil solvent of a chromogenic material which develops colour on contact with a colour developer; and a subcoat on the paper base and beneath the microcapsule coating; the subcoat comprising plastic pigment particles and a binder." The hollow microsphere pigments of this patent may be used in the process of this invention.

By way of father illustration, hollow microsphere polymer pigments have also been disclosed in U.S. Pat. No. 4,880,465 of Loria, the entire disclosure of which is hereby incorporated by reference into this specification. Loria claims: "1. A non-pigmented ink suitable for use in ink jet printing comprising: (a) from about 2 to about 20 percent by weight of a resin component; (b) from about 5 to about 25 percent by weight of hollow microspheres; and (c) the remainder being a suitable carrier vehicle comprised of water, ammonium hydroxide, and a volatile solvent; all percentages being based upon the total weight of the ink; the hollow microspheres having permeable walls comprised of a synthetic polymeric material, a central void region filled with water, capable of diffusing through the walls of said microspheres, an inside diameter from about 0.1 to about 0.5 micron and an outside diameter from about 0.4 to about 1 micron; the resin component, the hollow microspheres and the carrier vehicle being chemically nonreactive with each other; and the specific gravity of the ink being about equal to or greater than the specific gravity of the microspheres wherein, the ink has a viscosity at 25 degrees Celsius from about 3 to about 10 centipoises, an electrical resistivity from about 100 to about 3500 ohm-cm, and a sonic velocity from about 1300 to about 1700 meters/second." The hollow microspheres of this patent may be used in the process of this invention.

By way of further illustration, hollow microsphere polymer pigment has been described in U.S. Pat. No. 5,677,043 of Hultman, the entire disclosure of which is hereby incorporated by reference into this specification. Hultman claims: "1. An opaque thermal transfer paper for receiving heated ink from a thermal transfer placed in contact with said opaque thermal transfer paper printer ribbon, said opaque thermal transfer paper comprising in combination: a. a substrate comprising a paper sheet having an outer surface; b. a basecoat coating directly coated on said outer surface of said paper sheet, the coating weight of said basecoat coating ranging between 0.3 g/m.sup.2 to about 10 g/m.sup.2 and the thickness of said basecoat coating ranging between about 1 micron and about 30 microns, said basecoat coating comprising discrete, opaque, plastic, hollow, pigment spheres ranging from about 0.2 microns to about 2 microns in diameter and binders holding together said discrete, opaque, plastic, hollow, pigment spheres, said binders constituting from about 10 percent to about 60 percent by weight of said basecoat coating; and Celsius a topcoat coating directly coated on the basecoat coating, said topcoat coating having a coating weight within the range of from about 1 g/m.sup.2 to about 20 g/m.sup.2 and a coating thickness within the range of from about 1 micron to about 20 microns, said topcoat coating including a plurality of pigment particles having different particle shapes and particle sizes which cooperate to provide a generally open topcoat coating for receiving heated ink from a thermal transfer printing ribbon placed in contact with the topcoat coating, said topcoat coating further including a water holding viscosifying agent, said basecoat coating sandwiched between said substrate and said topcoat coating for attenuating the heat flux from said topcoat coating to said substrate when said topcoat coating receives heated ink from a thermal transfer printer ribbon and for filling in any voids located at said outer surface of said paper sheet." The hollow microsphere polymer pigments of this patent may be used in the process of this invention.

By way of further illustration, hollow microsphere polymer pigment has been described in U.S. Pat. No. 5,071,823 of Matsushita, the entire disclosure of which is hereby incorporated by reference into this specification. Matsushita claims: "1. An image-receiving, transfer recording sheet composed of a substrate and a porous heat insulating layer which, laid on the substrate, comprises 100 parts by weight of macromolecular microspheres and 5-100 parts by weight of a binder, said microspheres consisting mainly of hollow resin particles and/or heterogeneous resin particles." The hollow microsphere polymer pigments of this patent may be used in the process of this invention.

By way of yet further illustration, hollow microsphere polymer pigment has been described in U.S. Pat. No. 7,579,081 of Brown, the entire disclosure of which is hereby incorporated by reference into this specification. Brown claims: "1. An opacifying particle comprising a pigment particle having an average particle diameter of from 0.005 to 5 microns and an index of refraction of at least 1.8; a first polymer attached to the surface of the pigment particle via a silane residue, wherein the first polymer is an addition polymer of at least one ethylenically unsaturated monomer; and a shell comprising a second polymer, the second polymer being formed from at least one ethylenically unsaturated monomer comprising at least one water-soluble monomer selected from the group consisting of an ethylenically unsaturated alcohol-functional monomer, an ethylenically unsaturated inorganic acid-functional monomer, an ethylenically unsaturated carboxylic acid-functional monomer, an ethylenically unsaturated amide-functional monomer, an ethylenically unsaturated amine-functional monomer, and a combination thereof, which substantially encapsulates the pigment particle having the attached first polymer." The hollow microsphere polymer pigments of this patent may be used in the process of this invention.

Referring again to FIG. 1, and to the preferred embodiment depicted therein, such hollow organic pigments 402 are typically comprised of an outer wall or sheath of a thermoplastic material (such as, for example, polystyrene, polyacrylates, polycyanoacrylates and various addition polymers and copolymers) surrounding a void 403.

U.S. Pat. No. 7,435,783 of Blankenship, the entire disclosure of which is hereby incorporated by reference into this specification, discloses that "voided latex particles can be prepared by any of several known process, including those described U.S. Pat. Nos. 4,427,836, 4,468,498, 4,594,363, 4,880,842, 5,494,971, 5,521,253, 5,157,084, 5,360,827 among others. Voided latex particles, as described in the references noted above, are prepared by swelling the core of a core-shell emulsion polymer. Some of the processes, such as that described by U.S. Pat. No. 5,360,827 describe the processes whereby, in the latter stages of polymerizing the shell, monomer is added to facilitate diffusion of base into the core of the polymer in order to achieve swelling." The voided latex particles of this patent may be used in the process of this invention.

U.S. Pat. No. 6,720,007 of Walt, the entire disclosure of which is hereby incorporated by reference into this specification, discloses that "the nature of the polymeric shell is varied to accommodate various uses of the hollow microspheres. The microsphere shell typically contains styrene, methacrylate, or any polymer with a high glass-transition temperature (T.sub.g). The shell contains a polymer resulting from the polymerization of one or more monomers selected from the group consisting of acrylonitrile, styrene, benzyl methacrylate, phenyl methacrylate, ethyl methacrylate, divinyl benzene, 2-hydroxyethyl methacrylate, cyclohexyl methacrylate, p-methyl styrene, acrylamide, methacrylamide, methacrylonitrile, hydroxypropyl methacrylate, methoxy styrene, N-acrylylglycinamide, and N-methacrylylglycinamide. Alternatively, the shell contains a co-polymer (random or block) selected from the group consisting of styrene-PMMA, benzyl methacrylate-PMMA, styrene-PHEMA, styrene-PEMA, styrene-methacrylate, and styrene-butylacrylate. The strength and durability of the polymeric shell is increased by crosslinking polymer chains." The hollow microspheres of this patent may be used in the process of this invention.

U.S. Pat. No. 6,235,810 of Pavylyuchenko, the entire disclosure of which is hereby incorporated by reference into this specification, describes "a method for the preparation of latexes with hollow polymer particles useful as opacifying agents. The process comprises the preparation of hollow polymer particle latex by emulsion copolymerization with water soluble initiator and anionic surfactant as follows: a) preparation of seed latex of copolymer containing methyl methacrylate and methacrylic acid; b) preparation of latex of highly carboxylated copolymer containing methyl methacrylate and a cross-linking agent and optionally a vinyl aromatic compound; c) using highly carboxylated latex synthesized at stage b) in the preparation of the intermediate shell comprising a copolymer of methyl methacrylate, acrylic acid ester, a cross-linking agent and optionally vinyl aromatic compound, said intermediate shell copolymer having a glass transition temperature below 80 degrees Celsius; d) swelling the particles prepared at stage c) by addition of volatile basic compound; e) preparation of a hard shell on the swollen expanded particles comprising a copolymer of vinyl aromatic compound, acrylonitrile and/or methyl methacrylate, and cross-linking agent, said hard shell having a glass transition temperature above 80 degrees Celsius; and f) optional preparation of an external shell." The hollow polymer particles of this patent may be used in the process of this invention.

Hollow organic pigment particles often comprise a multilayer shell of a hydrophilic polymer on the inside of the shell substantially encapsulated by the second polymer. The second polymer presents the outermost surface and typically has a weight average molecular weight, "Mw," of at least 50,000, preferably of at least 250,000. The second polymer(s) may be a homopolymer or a copolymer.

The hollow organic pigment may have a non-spherical shape such as an ellipsoid or a rod-like shape. Preferably, the second polymer forms a spherical shell encapsulating the first polymer.

Hollow organic pigment 402 may have a wall thickness of between about 5 nanometers (nm) to 1 micron, preferably in the range of from 50 nanometers to 500 nanometers, most preferably in the range of from 80 nanometers to 150 nanometers.

Hollow organic pigment 402 preferably has an average particle size between 0.1 and 10 microns. More preferably, such average particle size is between 0.2 and 1 micron.

Hollow sphere polymer pigment 402 preferably has a glass transition temperature higher than 50 degrees Celsius. In one embodiment, such glass transition temperature is from about 60 to about 150 degrees Celsius.

In a preferred embodiment, hollow sphere polymer pigment 402 is comprised of a crosslinked polymer shell.

In another preferred embodiment, hollow sphere polymer pigment 402 is comprised of monomers which will depolymerize upon application of heat.

Hollow organic pigment 402 preferably has a density of less than 0.9 grams per cubic centimeter. In one embodiment, said density is less than 0.7 grams per cubic centimeter and, more preferably, less than 0.55 grams per cubic centimeter. Webster's Third International Dictionary (Unabridged) defines density as "the mass of a substance per unit volume".

Referring again to FIG. 1, and to the preferred embodiment depicted therein, thermosensitive layer 500 preferably comprises 10 percent to 66 percent of hollow organic pigment 402. In one embodiment, layer 500 is comprised of from about 25 to about 50 percent of such hollow organic pigment 402.

Thermal Solvents 404

In one embodiment, the thermosensitive layer 500 is comprised of one or more of thermal solvents 404. Some of the thermal solvents known to those in the art are described in this specification. It is to be understood that many other prior art thermal solvents also may be used.

Webster's Third International Dictionary (unabridged) defines solvent as "a substance capable of or used in dissolving or dispersing one or more other substances." Thermal solvents are compounds whose activity is increased with heat and act as solvents for various components of the thermosensitive layer, helping to accelerate the transparentization of said layer at elevated temperatures.

In one preferred embodiment, the thermal solvent 404 is a solid or liquid substance with solubility characteristics similar to those of the hollow organic pigment 402. Upon application of heat to said thermographic substrate 10, the combination of heat and thermal solvent 404 is able to soften or dissolve the wall of the hollow organic pigment 402, leading to the collapse of the void 403 contained in the hollow organic pigment and resulting a decrease in opacity of the thermosensitive layer 500.

Thermal solvents are claimed in, e.g., U.S. Pat. No. 5,320,929, the entire disclosure of which is hereby incorporated by reference into this specification. In this patent, thermal solvents are defined as "compounds which are solids at ambient temperature but which melt at the temperature used for processing. The thermal solvent acts as a solvent for various components of the heat-developable materials, it helps to accelerate thermal development and it provides the medium for diffusion of various materials".

Thermal solvents have been extensively used in photothermographic imaging elements; see, for example, U.S. Pat. Nos. 5,436,108, 5,328,799, 6,596,470, and 6,790,569; the entire disclosure of each of these United States patents is hereby incorporated by reference into this specification.

Bailey (U.S. Pat. No. 5,436,109) reviews the use of thermal solvents in photothermographic imaging systems ("Thermal Solvents in Dry Photothermographic Systems"). The thermal solvents described in these patents may be used in the process of this invention.

Heat processable photosensitive elements can be constructed so that after exposure, they can be processed in a substantially dry state by applying heat. It is known how to develop latent image in a photographic element not containing silver halide wherein organic silver salts are used as a source of silver for image formation and amplification. Such processes are described in U.S. Pat. Nos. 3,429,706 (Shepard et al.) and 3,442,682 (Fukawa et al.), the entire disclosure of each of which is hereby incorporated by reference into this specification. Other dry processing thermographic systems are described in U.S. Pat. Nos. 3,152,904 (Sorenson et al.) and 3,457,075 (Morgan and Shely); the disclosure of these United States patents are also hereby incorporated by reference into this specification.

A variety of compounds have been proposed as "carders" or "thermal solvents" or "heat solvents" for such systems, whereby these additives serve as solvents for incorporated developing agents, or otherwise facilitate the resulting development or silver diffusion processes. Acid amides and carbamates have been proposed as such thermal solvents by Henn and Miller (U.S. Pat. No. 3,347,675) and by Yudelson (U.S. Pat. No. 3,438,776). Bojara and de Mauriac (U.S. Pat. No. 3,667,959) disclose the use of nonaqueous polar solvents containing thione, —SO.sub.2- and —CO— groups as thermal solvents and carders in such photographic elements. Similarly, La Rossa (U.S. Pat. No. 4,168,980) discloses the use of imidazoline-2-thiones as processing addenda in heat developable photographic materials. The disclosure of each of these United States patents is hereby incorporated by reference into this specification; and the thermal solvents described therein may be used in the process of the invention.

Thermal solvents for use in substantially dry color photothermographic systems have been disclosed by Komamura et al. (U.S. Pat. No. 4,770,981), Komamura (U.S. Pat. No. 4,948,698), Aomo and Nakamaura (U.S. Pat. No. 4,952,479), and Ohbayashi et al. (U.S. Pat. No. 4,983,502); the entire disclosure of each of these patents is hereby incorporated by reference into this specification. The terms "heat solvent" and "thermal solvent" in these disclosures refer to a non-hydrolyzable organic material which is a liquid at ambient temperature or a solid at an ambient temperature but compatibilizes together with other components at the temperature of heat treatment or below but higher than 40 degrees Celsius. Such solvents may also be solids at temperatures above the thermal processing temperature. Their preferred examples include compounds which can act as a solvent for the developing agent and compounds having a high dielectric constant which accelerate physical development of silver salts. The disclosure of each of these United States patents is hereby incorporated by reference into this specification; and the thermal solvents described therein may be used in the process of the invention.

Alkyl and aryl amides are disclosed as "heat solvents" by Komamura et al. (U.S. Pat. No. 4,770,981), and a variety of benzamides have been disclosed as "heat solvents" by Ohbayashi et al. (U.S. Pat. No. 4,983,502). Polyglycols, derivatives of polyethylene oxides, beeswax, monostearin, high dielectric constant compounds having an —SO.sub.2- or —CO— group such as acetamide, ethylcarbamate, urea, methylsulfonamide, polar substances are described in U.S. Pat. No. 3,667,9591 the lactone of 4-hydroxybutanoic acid, methyl anisate, and related compounds are disclosed as thermal solvents in such systems. The role of thermal solvents in these systems is not clear, but it is believed that such thermal solvents promote the diffusion of reactants at the time of thermal development. Masukawa and Koshizuka disclose (U.S. Pat. No. 4,584,267) the use of similar components (such as methyl anisate) as "heat fusers" in thermally developable light-sensitive materials. The entire disclosure of each of these United States patents is hereby incorporated by reference into this specification; and the thermal solvents described therein may be used in the process of the invention.

Hirai et al. (U.S. Pat. No. 4,590,154), the entire disclosure of which is hereby incorporated by reference into this specification, disclose a heat developable color photographic light-sensitive material comprising silver halide, a hydrophilic binder, dye releasing compounds which release mobile dyes, and a sulfonamide compound. This system requires only heat to develop the latent image and to produce mobile dyes. However, the mobile dyes are affixed to an image receiving material, which must be wetted with water prior to being contacted with the heat developed donor element. The subsequent dye diffusion transfer to the receiver element is therefore of the conventional wet diffusion type.

Nakamine et al. (U.S. Pat. No. 5,107,454), the entire disclosure of which is hereby incorporated by reference into this specification, disclose a heat developable photographic chromogenic system that also utilizes diffusion transfer of dyes to an image receiving (fixing) element. The dye diffusion transfer in actuality requires that the image receiving or fixing element be wetted with water prior to being affixed to the dye donor element. The resulting dye transfer, therefore, is a wet diffusion transfer of the conventional type, not dry thermal dye transfer.

Such thermal solvents 404 can also facilitate the collapse of the hollow organic pigment at temperature and pressure conditions which can be achieved in a thermal imaging printer. Without the presence of a thermal solvent 404 the temperature at which the hollow organic pigments 402 in the thermosensitive layer 500 will collapse is at least as high as the glass transition temperature of the shell wall of said pigment 402 and typically much higher. While the temperatures which the thermal printer can achieve in a thermosensitive layer may be high (100 to 400 degrees Celsius), the duration of such temperatures in the layer is relatively short (less than 1 ms). Even at temperatures exceeding the glass transition temperature of said shell wall of the hollow organic pigment 402 in a thermal printer there is typically not sufficient time to allow the thermoplastic wall to relax sufficiently to collapse. The inventors have discovered that certain thermal solvents can positively interact with the heat supplied by a thermal printer in the time scale of the heating to facilitate the collapse of the hollow organic pigment 402; in particular, they have discovered that the use of one or more appropriate thermal solvents in their system lowers the temperature at which such collapse and resulting transparatization occurs.

Thermal solvents 404 may be either liquids or solids. Such agents 404, incorporated into thermosensitive layer 500 preferably are prevented from mixing with said hollow organic pigments 402 also in said layer 500 in order to maintain the opacity of said layer 500 non-thermally imaged areas. Without wishing to be bound to any particular theory, applicants believe that premature collapse of said pigments 402 would increase the transparency of said layer 500, defeating the function of the layer as a heat sensitive imaging layer. Separation of the thermal solvents 404 from the hollow polymeric particles 402 can be accomplished in many ways. The agents 404 may be physically separated from the pigments by dispersing them or dissolving them in suitable binder. Alternatively and additionally, said thermal solvents may be encapsulated within said layer 500.

Thermal solvents 404 may be liquids which are emulsified or dissolved in a suitable binder. Such liquid thermal solvents preferable have a boiling point above 100 degrees Celsius and more preferably above 150 degrees Celsius.

Thermal solvents 404 may be solids dispersed or dissolved in a suitable binder. The particle size of solid dispersed thermal solvents is preferably less than 10 microns and more preferably less than 5 microns and most preferably less than 1 micron.

Solid Thermal solvents 404 may be either amorphous or crystalline or semicrystalline. In the case of crystalline or semicrystalline agents 404, the melting point is preferably less than 200 degrees Celsius, more preferably less than 150 degrees Celsius, and most preferably less than 100 degrees Celsius. Polar waxes can act as thermal solvents 404.

In one embodiment, the thermal solvents preferably have solubility characteristics similar to those of the hollow organic pigment. The Hildebrand solubility parameter is described in U.S. Pat. No. 7,465,343 of Prasad, the entire disclosure of which is hereby incorporated by reference into this specification.

The Hildebrand solubility parameter that is discussed in the Prasad patent also is discussed in Billmeyer's "Textbook of Polymer Science", $2^{nd}$ Edition, Wiley-Interscience, New York, 1962. As is disclosed in such text, the Hildebrand solubility parameter is the square root of the cohesive energy density (energy/unit volume) of a material. Thus, the solubility parameter is the square root of calories/cubic cm or in SI units, joule/cubic meter. In SI units a pascal is defined as one joule per cubic meter. Thus, in this specification the units for solubility parameter shall be referred to as the square root of megapascal's or MPa.sup.1/2.

U.S. Pat. No. 5,997,741, the entire disclosure of which is hereby incorporated by reference into this specification, describes a method to determine the solubility parameter using the following formula: solubility parameter=$(\Delta E_v/V)^{1/2}$ wherein $\Delta E_v$ is molar evaporation energy, nearly equal to $\Delta H$-RT wherein $\Delta H$ is vapor heat, R is the gas constant and T is absolute temperature, and V is the molar volume of a solvent.

Solubility parameters are described in many scientific articles and books. By way of illustration, the "Polymer Data Handbook, Basic Edition", compiled by The Society of Polymer Science, Japan and published by Baifukan Co., Ltd. has tables on solubility parameters by solvent, so that a decision may be made on the choice of the heat stabilizing solvents suitable for the instant invention. Other references giving considerations to solubility parameters include Ind. Chem. Prod. Res. Dev. 8, March 1969, p. 2-11, Chemical Reviews, 75 (1975), p. 731-753, and Encyclopedia of Chemical Technology, 2nd Edition, Supplement Volume (1971), p. 889-910.

U.S. Pat. No. 7,041,369 of MacKay, the entire disclosure of which is hereby incorporated by reference into this specification, discloses that "the (.delta.) can be used to estimate the compatibility between materials. Generally, substantial compatibility between two materials can be expected when their solubility parameters are similar. It is known that water has a .delta.sub.water value of 48.0 Megapascals.sup.1/2, which is the highest among common solvents, probably due to the strong hydrogen bonding capacity of water. It is believed that starch typically has a .delta.sub.starch value similar to that of cellulose (about 34 Megapascals.sup.1/2)."

Suitable thermal solvents 404 will dissolve, swell, plasticize or mix with hollow organic pigments 402 under conditions of elevated temperature. If such agents 404 are in their liquid state then the rapid heating from the thermal printer must enable said agents to come into direct contact with said pigments 402 by means of diffusion, capillary action, flow and the like. If thermal solvents 404 are in the solid state then they must first melt with the heat provided from the thermal printer and then come into direct contact with said pigments 402 by similar means.

According to Mackay (U.S. Pat. No. 7,041,369, the entire disclosure of which is hereby incorporated by reference into this specification), compatible materials have a difference in solubility parameter of less than about 10 Megapascals.sup.1/2. In the instant invention it has been discovered that thermal solvents 404 with solubility parameters from about 16 Megapascals.sup.1/2 to about 28 Megapascals.sup.1/2 will transparentize a polystyrene-co-acrylic acid based polymeric pigment at 150 degrees Celsius.

Without wishing to be bound to any particular theory, the inventors believe that the thermal solvent 404 facilitates the thermally induced collapse of the hollow organic pigment 402 if the thermal solvents solubility parameter is within about 10 Megapascals.sup.1/2 of the material making up the outer shell of said pigment 402. The solubility parameter of polystyrene is reported in the Polymer Handbook, $3^{rd}$ Edition, John Wiley & Sons, NY 1989, pp. VII 554-555, and it ranges from 15.6 to 21. Megapascals.sup.1/2.

Suitable thermal solvents 404 may include such plasticizers as those disclosed in U.S. Pat. No. 5,776,280 including, e.g., adipic acid esters, phthalic acid esters, chlorinated biphenyls, cirates, epoxides, glycerols, glycol, hydrocarbons, chlorinated hydrocarbons, phosphates, esters of phthalic acid such as, e.g., di-2-ethylhexylphthalate, phthalic acid esters, polyethylene glycols, esters of citric acid, epoxides, adipic acid esters, and the like. The use of such plasticizing agents is well known and is described, e.g., in U.S. Pat. Nos. 6,121,356; 6,117,572; 6,086,700; 6,060,214; 6,051,171; 6,051,097; 6,045,646; and the like. The entire disclosure of each of these United States patents is hereby incorporated by reference into this specification. Other suitable plasticizers may be obtained from, e.g., the Eastman Chemical Company. These prior art plasticizers may be used in the process of this invention.

Furthermore, thermal solvents useful in the present invention include polar organic compounds such as the polyglycols described in U.S. Pat. No. 3,347,675 and the compounds described in U.S. Pat. No. 3,667,959; urea derivatives, e.g., dimethylurea, diethylurea and phenylurea; amide derivatives, e.g., acetamide, benzamide and p-toluamide; sulfonamide derivatives, e.g., benzenesulfonamide and .alpha.-toluenesulfonamide; and polyhydric alcohols, e.g., 1,2-cyclohexanediol and pentaerythritol. The entire disclosure of each of these patents is hereby incorporated by reference into this specification, and the thermal solvents disclosed therein may be used in the process of the invention.

Solid plasticizers are disclosed by Chen in U.S. Pat. No. 7,651,747. Thus, e.g., Chen discloses that: "Solid plasticizers 12 are known in the art and may include a phthalate compound, a terephthalate compound, an isophthalate compound, a benzoate compound, a polymeric adipate compound, or mixtures thereof. Examples of the solid plasticizer 12 include, but are not limited to, sucrose benzoate, 1,4-cyclohexanedimethanol dibenzoate, glyceryl tribenzoate, dicyclohexyl phthalate, benzyl 2-naphthyl ether, dimethyl terephthalate, 2-chloropropionanilide, 4-benzyldiphenyl, dibenzyl oxalate, m-terphenyl, diphenyl phthalate, diphenyl isophthalate, dihexyl phthalate, diactyl phthalate, cumylphenyl isophthalate, dihydroabietyl phthalate, dimethyl isophthalate, ethylene glycol dibenzoate, trimethylolethane tribenzoate, pentaerythritol tetrabenzoate, sucrose octaacetate, tricyclohexyl citrate, N-cyclohexyl-p-toluenesulfonamide, o,p-toluenesulfonamide, N-ethyl-p-toluenesulfonamide, N-butyl-p-toluenesulfonamide, n-tallow-4-toluenesulfonamide, p-toluenesulfonamide-formaldehyde resin, 1,2-di-(3-methylphenoxy)ethane, or mixtures thereof. The solid plasticizer 12 may have an average particle size of less than approximately 5 .mu.m, such as less than approximately 0.5 .mu.m." These solid plasticizers also may be used in the process of the invention.

In one embodiment, the solid plasticizer is selected from the group consisting of " . . . sucrose benzoate, 1,4-cyclohexanedimethanol dibenzoate, glyceryl tribenzoate, dicyclohexyl phthalate, benzyl 2-naphthyl ether, dimethyl terephthalate, 2-chloropropionanilide, 4-benzyldiphenyl, dibenzyl oxalate, m-terphenyl, diphenyl phthalate, diphenyl isophthalate, o,p-toluenesulfonamide, N-cyclohexyl-p-toluenesulfonamide, 1,2-di-(3-methylphenoxy)ethane, or mixtures thereof." are incorporated herein by reference.

The thermal solvents described by Bailey in U.S. Pat. No. 5,436,109 are hereby incorporated herein by reference; and they may also be used in the process of the invention.

Thermal solvents agents 404 may be solid materials, such as the sensitizers described by Metha (U.S. Pat. No. 5,888,283); the entire disclosure of this patent is hereby incorporated by reference into this specification. Mertha discloses that: "Suitable sensitizers for use in the ink composition include diphenoxyethane, aryl or alkyl-substituted biphenyls such as p-benzyl biphenyl, or toluidide phenyl hydroxynaphthoates and aromatic diesters such as dimethyl or dibenzyl terephthalate and dibenzyl oxalate. These materials may be used alone, or they may be combined with waxes or fatty acids. A preferred sensitizer for use is p-benzyl biphenyl. The sensitizer preferably has a softening point of between about 80 degrees Fahrenheit to 85 degrees Fahrenheit (27.degrees. Celsius to 29.degrees Celsius) and a melting point of between about 140 degrees Fahrenheit to 150 degrees Fahrenheit (60 degrees Celsius to 65 degrees Celsius). When the sensitizer is heated to its melting point (such as by the printhead in a direct thermal printer), it melts and lowers the melting point of adjacent color developer and color former particles, causing them to dissolve, react, and form a desired color." The sensitizers (thermal solvents) of this patent also may be used in the process of this invention.

One may use one or more of the sensitizers disclosed in U.S. Pat. No. 5,883,043, the entire disclosure of which is hereby incorporated by reference into this specification. The sensitizers/thermal solvents of this patent also may be used in the process of this invention.

In one embodiment, the thermal solvents used include dibenzyl oxalate, propylene carbonate, benzyl alcohol, triethylene glycol, triethylene glycol, dipropylene glycol, dibutyl phthalate, carnauba wax, 1, 2-bis(3-methylphenoxy) ethane and the like.

Referring again to FIG. 1, thermosensitive layer 500 is preferably comprised of 5 to about 50 weight percent of thermal solvent 404 and, more preferably, from about 10 to about 40 percent of such solvent. In one aspect of this embodiment, the concentration of such thermal solvent is from about 15 to about 30 weight percent.

In a preferred embodiment, thermosensitive layer 500 is comprised from about 0.5 to about 1.5 parts by weight of said thermal solvent for each part of said hollow sphere organic pigment.

Thermosensitive layer 500 may optionally include a colorant 502. A preferred colorant is a dye or pigment, such as, e.g., the colorants 302 described in optional colorant layer 300. Additionally, colorant 502 may be an optical brightener or fluorescent dye or pigment which adds a color effect to the layer without significantly impacting the opacity of the layer. So, for example, light stable dyes, transparent pigment dispersions and the like may be added to the layer to provide a tinting color effect once the layer has been transparentized. Such dyes or pigments may act as a light filter for the underlying color layers. Alternatively or additionally, optical brighteners may be added to thermosensitive layer 501 to improve the apparent whiteness of unimaged areas.

Binders for Thermosensitive Layer 500

Thermosensitive layer 500 is comprised of a binder 501 wherein said binder preferably constitutes at least 10 percent of said thermosensitive layer, and, in one embodiment, from 15 to 45 percent of said layer. The binders 301 described in optional color layer 300 are suitable for use in thermosensitive layer 500.

Binder 501 may be comprised of resins which are preferably water soluble or water dispersible. Binder resins usable in the thermosensitive layer 401 include, e.g., cellulosic resins such as ethyl cellulose, hydroxyethylcellulose, hydroxypropylcellulose, methylcellulose, cellulose acetate, cellulose acetate buytryate, and nitrocellulose; natural resins and gums such as gelatin, chitan, and various polysaccharides; vinyl resins such as polyvinylalcohol, polyvinylacetate, copolymers of polystyrene-co-butadiene and polyvinylpyrrolidone; acrylic resins such as polyacrylamide, polyacrylonitrile-co-styrene, polybutyl acrylate-co-acrylic acid, polymethylmethacrylate, polymethylmethacrylate-co-butylacrylate, polybutylmethacrylate; polyacetal resins such as polyvinylbutyral, polyvinylacetal, polyvinylformal, polyvinylacetal-co-butyral and the like; water dispersible acrylic resins and the like; polyester, polyurethane, polyamide, polyimide, polycarbonate, polyurea, polyether, polyethylene glycol, polyethylene oxide, polypropylene oxide, epoxy resins and the like; various copolymers and mixtures thereof.

In one embodiment, the binder comprises an ionomeric crosslinked resin. In one embodiment, the binder comprises a self crosslinking acrylic resin.

In one embodiment, the binder comprises a cross-linked resin. In this case, a resin having several reactive groups, for example, hydroxyl or amine groups, is used in combination with a crosslinking agent, such as a polyisocyanate, glyoxal, epoxies, aldehydes, silanes, titinates, zirconate, aziridine, oxazolin and the like.

Referring again to FIG. 1, the binder 501 in thermosensitive layer 500 may be comprised of from about 0 to about 100 weight percent of wax and, preferably, from about 5 to about 20 weight percent of such wax. In one embodiment, binder 501 comprises from about 5 to about 10 weight percent of such wax. Suitable waxes which may be used include, e.g., carnuaba wax, rice wax, beeswax, candelilla wax, montan wax, paraffin wax, microcrystalline waxes, synthetic waxes such as oxidized wax, ester wax, low molecular weight polyethylene wax, Fischer-Tropsch wax, and the like. These and other waxes are well known to those skilled in the art and are described, e.g., in U.S. Pat. No. 5,776,280, the entire disclosure of which is hereby incorporated by reference into this specification. One may also use ethoxylated high molecular weight alcohols, long chain high molecular weight linear alcohols, copolymers of alpha olefin and maleic anhydride, polyethylene, polypropylene, and the like. These and other suitable waxes are commercially available from, e.g., the Baker-Hughes Baker Petrolite Company of 12645 West Airport Blvd., Sugarland, Tex.

In one preferred embodiment, carnauba wax is used as the wax. As is known to those skilled in the art, carnauba wax is a hard, high-melting lustrous wax which is composed largely of ceryl palmitate; see, e.g., pages 151-152 of George S. Brady et al.'s "Material's Handbook," Thirteenth Edition (McGraw-Hill Inc., New York, N.Y., 1991). Reference also may be had, e.g., to U.S. Pat. Nos. 6,024,950; 5,891,476; 5,665,462; 5,569,347; 5,536,627; 5,389,129; 4,873,078; 4,536,218; 4,497,851; 4,4610,490; and the like. The entire disclosure of each of these United States patents is hereby incorporated by reference into this specification.

One may use one or more of the binders disclosed in U.S. Pat. Nos. 6,410,479, the disclosure of which is hereby incorporated by reference into this specification.

In one embodiment, carnauba wax is used as both the binder and the thermal solvent. Other comparable polar waxes may be similarly used.

Particles for Thermosensitive Layer 500

Referring again to FIG. 1, thermosensitive layer 500 is comprised of a multiplicity of particle 407. Particle 407 may be an organic or inorganic particle with an average particle size less than 5 microns and, more preferably, less than 2 microns. Particle 407 is added as filler to the layer with the function of improving the cohesion and thermal stability of layer 500 while providing minimal masking. Particles which mask layer 500 reduce its transparency after thermal imaging by scattering light. For example, particles such as titanium dioxide with a refractive index of 2.49 generate high masking and are not suitable for use in thermosensitive layer 500. Particles with small differences in refractive index to the binder 501 are preferred. Typically binders such as acrylic and styrene polymers have refractive indices in the range of 1.45 to 1.55. Organic polymeric particles will have refractive indexes in the same range as binder 501. In addition, many inorganic particles such as clay ($Al_2Si_2O_5(OH)_4$) and microcline ($KAlSi_3O_8$) have refractive indices in the range of 1.47 to 1.55 and are suitable for use as particle 407 in thermosensitive layer 500.

In a preferred embodiment, particle 407 has a refractive index between 1.0 and 2.0. In another embodiment, particle 407 has a refractive index between 1.25 and 1.75. In yet another embodiment, particle 407 has a refractive index between 1.35 and 1.65.

Layer 600 (Optional Barrier Layer)

Referring again to FIG. 1, thermographic substrate 10 is optionally and preferably comprised of a barrier layer 600.

Barrier layer 600 is optionally applied as contiguous coating over thermosensitive layer 401 and/or 501.

Barrier layer 600 functions to protect underlying thermosensitive layers 400 and/or 500 from attack by agents which could reduce the opacity of such layers. Barrier layer 600 preferably is a water based coating composition. In addition, and in one embodiment, barrier layer 600 helps to maintain distinct layer separation between thermosensitive layer 400 and/or 500 and heat resistant topcoat 700.

Binders described elsewhere in this specification, such as binder 201, 301, 401 or 501 may be used in layer 600.

Barrier layer 601 is preferably crosslinked, i.e., it is insolubilized after coating so that, when it is contacted with water or organic solvent at ambient temperature it is substantially insoluble in such solvent. In one aspect of this embodiment, thermographic layer 500 also is crosslinked. Consequently, and in this embodiment, the imaged thermographic substrate is substantially insoluble in water and, thus, is resistant to attack by water. Furthermore, unlike prior art thermographic substrates, the substrate of this invention is also resistant to light fading.

In one embodiment barrier layer 601 has a density greater than 0.9 grams per cubic centimeter and, preferably, greater than 1 gram per cubic centimeter, In another embodiment, the density of such barrier layer is, greater than 1.1 grams per cubic centimeter.

In one embodiment, barrier layer 601 is preferably comprised of polyvinyl alcohol. In a preferred embodiment, barrier layer 601 is comprised of a cross-linked polyvinyl alcohol.

In one embodiment, barrier layer 601 is preferably comprised of a chlorine containing polymer.

Barrier layer 601 preferably has a coating weight 606 of at least about 0.1 grams per square meter to 10 grams per square meter and, more preferably, from about 0.2 grams per square meter to 5 grams per square meter. In one embodiment, the coating weight is from 0.5 grams per square meter to 2 grams per square meter.

In one preferred embodiment, barrier layer 600 is flood coated over the top of thermosensitive layer 500 as a protection to layer 500 from attack by agents which include (but are not limited to) solvents, plasticizers, oils, inks, coating solutions, fingerprint oil, varnishes, adhesives and the like which might come in contact with top most surface 800 of the thermographic substrate 10. As will be apparent, the combination of a barrier layer and a thermographic layer provides a unique combination of properties, to wit, protection against fading, water, organic solvents, plasticizers, oils, adhesives, etc.

Barrier layer 600 is preferably coated from water. In one embodiment, water-based compositions are prepared such that many of the components remain separated and not intimately mixed at the time of coating and drying. In one embodiment, barrier layer 600 is comprised of dispersions of binders 601, coalescent agents, crosslinkers and the like.

In one preferred embodiment, barrier layer 600 is comprised of a continuous phase crosslinked binder 601.

Layer 700—Heat Resistant Topcoating

Referring again to FIG. 1, thermographic substrate 100 is optionally comprised of a heat resistant topcoat 700. The topcoat 700 is the uppermost layer of the thermographic substrate and comes in direct contact with the thermal printhead when the thermographic substrate is imaged in a thermal printer. The thermal print head is comprised of a linear array of individual heating element. As these heating elements are energized in response to image being printed, they may reach temperatures in the range of 200 degrees Celsius to about 400 degrees Celsius. As the thermographic substrate 100 passes beneath the thermal printhead, the topcoat 700 is in turn heated as it comes in contact with energized heating elements of the printhead. Those skilled in the art will understand that many of the binders described in this specification will soften at such temperatures and be inclined to stick or adhere to the hot printing elements.

Topcoatings which are heat resistant are able to freely pass beneath an energized thermal printhead without sticking or stalling. Heat resistant layer 700 preferably is resistant to sticking to the thermal printhead and must enable thermographic substrate 10 to pass beneath said printhead with minimal friction, irrespective of the temperature of said printhead. Heat resistant layer 700 preferably should not rub off or build up on the thermal printhead as such material will interfere with the flow of heat from the printhead to the thermographic substrate 10.

In a preferred embodiment, the coefficient of friction of the heat resistant topcoat does not increase by more than 50 percent form 20 degrees Celsius to about 300 degrees Celsius.

Heat resistant topcoat 700 is comprised of heat resistant binder 701 and optionally one or more abrasive particles 702 and one or more lubricants 703. One may use one or more of the binders disclosed elsewhere in this specification. Additionally, the binders disclosed in U.S. Pat. No. 6,410,479, the disclosure of which is hereby incorporated by reference into this specification, may be used.

The binder 701 for heat resistant layer 700 may be any composition which does not cause sticking at temperatures of 150 degrees Celsius or higher. Binders described elsewhere in this specification, such as binders 201, 301, and 501, may be used. In another preferred embodiment, binder 701 has a glass transition temperature of at least 50 degrees Celsius. In yet another preferred embodiment binder, 701 has a glass transition temperature at least 70 degrees Celsius.

In a preferred embodiment, binder 701 is a cross-linked polyvinyl alcohol. Crosslinked polyvinyl alcohol base topcoating binders have been described in U.S. Pat. No. 6,410,479, the entire disclosure of which is hereby incorporated by reference into this specification, and such binders may be used in the process of this invention.

Preferably, heat resistant layer 700 is comprised of polyvinyl alcohol. The polyvinyl alcohol use in heat resistant layer 700 is preferably fully saponified, partially saponified, or denatured by carboxyl, amide, sulfonic acid or butyl aldehyde.

In one embodiment, heat resistant layer 700 is preferably comprised of a crosslinked binder to further improve its heat resistance and its ability not to stick to the thermal printhead. Hydroxyl containing binders, such as polyvinyl alcohol, polyurethane, polyacrylates, polyesters, polyacetals and the like, may preferably be crosslinked with dialdehydes such as glyoxal or polyaldehyde, epoxies such as diglycydil type, dimethylolurea such as glycerindiglycidylether, isocyanates, boron oxides, aziradines, oxazolines; and the like.

Heat resistant layer 700 preferably protects the underlying thermosensitive layers 500 from attack by plasticizer, oil, solvents and the like.

Heat resistant layer 700 is preferably comprised of a lubricant 703. The lubricant 703 lowers the friction of said layer 700 against the thermal printhead, particularly at high temperatures. Lubricants 703 may be comprised of the metallic salt of high fatty acid such as zinc stearate, zinc stearyl phosphate, calcium stearate, waxes such as paraffin, polyethylene, carnauba and micro crystalline, silicone compounds, phosphate esters and the like.

Heat resistant layer 700 is preferably comprised of one or more abrasive particles 702. Abrasive particles 702 help to remove any materials which may buildup on the thermal printhead. Preferably, such abrasive particles are comprised of inorganic particles with an average particle size less than 1 micron, more preferably less than 0.5 micron, and most preferably less than 0.1 micron.

Abrasive particle 702 preferably have a melting point above 200 degrees Celsius and, more preferably, above 300 degrees Celsius, and, most preferably above 400 degrees Celsius.

Abrasive particle 702 is preferably comprised of silica, alumina, Mania, talc, clay and the like.

Abrasive particle 702 preferably has a Mohs hardness less that that of the outermost glaze on the thermal printhead. In one embodiment the abrasive particle has a Mohs hardness of less than 7. In another embodiment the abrasive particle 702 has a Mohs hardness of less than 5.

The heat resistant layer 700 is preferably comprised of an ultraviolet (UV) cured addition polymer resin. Halbrook discloses the use of UV cured protective coatings in thermosensitive recording materials in U.S. Pat. No. 6,566,752, the entire disclosure of which is hereby incorporated by reference. Halbrook states that: "Suitable UV cured protective overcoats are described in U.S. Pat. No. 4,886,744. Most free radical initiated polymerizations can be suitably cured with the use of a photoinitiator that is responsive in the UV range. These UV overcoats are said to contain additives such as UV absorbers and light stabilizers. Employing the UV cured coating allows for rapid drying. U.S. Pat. No. 4,886,774 discloses the use of a coating comprising the reaction product of acrylated aromatic urethane oligomers as unsaturated oligomer, tetrahydrofural methacrylate, as methacrylate oligomer and trimethylolpropane triacrylate as crosslinking monomer. U.S. Pat. No. 5,158,924 also describes ultraviolet curing resins which are suitable for protective coatings and include urethane resins, epoxy resins, organosiloxane resins, polyfunctional acrylate resins, melamine resins, thermoplastic resins having high softening points such as fluorine plastics, silicone resins, and polycarbonate resins. A specific example of a urethane acrylate-type UV curing resin is UNIDIC C7-157 made by Dainippon Ink & Chemicals Incorporated."

The heat resistant layer 700 is optionally applied over said barrier layer 600.

The heat resistant layer 700 may be applied over said thermosensitive layers 500.

The heat resistant layer 700 preferably has a coating weight 706 of from about 0.05 to about 10.0 grams per square meter, and more preferably from about 0.1 to about 5 grams per square meter; in one embodiment, such coating weight is from 0.5 to 2.0 grams per square meter.

Referring again to FIG. 1, topcoating 700 protects thermographic substrate 10 from damage as it passes under the printhead of a thermal printer. It must also provide a low friction surface 800 to enable smooth transport of the thermographic substrate beneath the printhead wherein said friction is relatively independent of temperature.

Heat resistant topcoatings should protect the thermal printhead from excessive buildup of debris from the printing of said thermographic substrates as this can impede heat flow between the printhead and the substrate.

In a preferred embodiment, any build up of debris on a thermal printhead from said thermographic substrate may be easily removed by rubbing said buildup with an alcohol saturated cloth.

The abrasive characteristics of heat resistant topcoatings should be great enough to clean any buildup of debris on the thermal printhead and yet low enough to minimize wear of the printhead.

In a preferred embodiment, 100,000 inches of thermographic substrate may be printed on a given thermal printhead without noticeable degradation to image quality.

In another preferred embodiment, 1,000,000 inches of thermographic substrate may be printed on a given thermal printhead without noticeable degradation to image quality.

In yet another preferred embodiment, 5,000,000 inches of thermographic substrate may be printed on a given thermal printhead without noticeable degradation to image quality.

Heat resistant topcoating 700 is preferably coated from water. In one embodiment, water-based compositions are prepared such that many of the components remain separated and not intimately mixed at the time of coating and drying.

In U.S. Pat. No. 6,410,479, the entire disclosure of which is hereby incorporated by reference into this specification, Fukuchi discloses several preferred binders for thermographic topcoatings, stating that: "any composition which does not cause sticking at the higher temperature than 200 degrees Celsius and does not hurt the thermal sensitivity and lustrous property can be used. Concretely, various kinds of polyvinyl alcohol of 200 about 2500 polymerization degree such as fully saponified polyvinyl alcohol, partially saponified polyvinyl alcohol, denatured polyvinyl alcohol e.g. polyvinyl alcohol denatured by carboxyl, polyvinyl alcohol denatured by amide, polyvinyl alcohol denatured by sulfonic acid or polyvinyl alcohol denatured by butylal (butyl aldehyde); water soluble high polymer of cellulose derivatives, such as, hydroxyethyl cellulose, methyl cellulose, ethyl cellulose, carboxymethyl cellulose and acetyl cellulose and (meth)acrylic ester resin such as (meth)acrylic ester copolymer, acrylic ester and/or methacrylic ester, copolymer of styrene and/or vinyl acetate, copolymer of acrylamide/acrylic ester/methacrylic acid, copolymer of colloidal silica complex acrylic ester and copolymer of colloidal silica complex styrene/acrylic ester can be mentioned."

In U.S. Pat. No. 6,410,479, Fukuchi discloses several preferred crosslinking agents for use in thermographic topcoats, stating that: "Concretely, dialdehyde type such as glyoxal or polyaldehyde, polyamine type such as polyethylamine, epoxy type, polyamide resin, melamine resin, diglycydil type, dimethylolurea such as glycerindiglycidylether, further, ammonium persulfate, iron chloride and magnesium chloride can be mentioned, however, the invention is not limited to them. Compared with a three-dimensional bridged type glyoxal cross-linking agent, since a two-dimensional bridged type glyoxal does not deteriorate the glossiness, it is useful for the preparation of excellent lustrous surface. The reason why is unclear, however, it is considered that the light scattering is generated on a micro scale when it is three-dimensionally bridged. The amount of cross-linking agent to be added can be adjusted voluntarily so as to be a fixing composition which does not cause sticking at the temperature higher than 200 degrees Celsius and, for instance, 0.05-0.3 parts can be added to 1 part of water soluble high polymer substance."

In U.S. Pat. No. 6,410,479 Fukuchi discloses several preferred lubricants for use in thermographic topcoats, stating that: "a slipping agent in the glossing layer or the intermediate layer of this invention, for the purpose of improving the thermal head compatibility. As a slipping agent, the slipping agents which are generally used in the conventional thermally sensitive recording medium can be used. As the concrete example, metallic salt of high fatty acid such as zinc stearate or calcium stearate and wax such as paraffin wax, polyethylene wax, carnauba wax, micro crystalline wax and acrylic type wax can be mentioned. Especially, when the thermal head compatibility is concerned, zinc stearate or calcium stearate are desirably used."

Thermographic substrate 10 may be imaged with thermal printers well known to those skilled in the art. One may use one or more of the direct thermal printers disclosed in U.S. Pat. Nos. 6,124,944; 6,118,467; 6,116,709; 6,103,389; 6,102,534; 6,084,623; 6,083,872; 6,082,912; 6,078,346; and the like. The disclosure of each of these United States patents is hereby incorporated by reference into this specification.

Digital thermal transfer printers are readily commercially available. Thus, e.g., one may use a printer identified as Zebra 140xilll and various other thermal printers sold by Zebra Corporation of Vernon Hills, Ill.

Rd is a measure of the darkness of a given substrate or article. Rd is defined in answers.com as "The common logarithm of the ratio of the luminance of a nonabsorbing perfect diffuser to that of the surface under consideration, when both are illuminated at an angle of 45° to the normal and the direction of measurement is perpendicular to the surface."

Rd is used in claim 1 of U.S. Pat. No. 4,830,503, the entire disclosure of which is hereby incorporated by reference into this specification, Such claim 1 describes: "A Rd measuring system for measuring the Rd of a plurality of objects each having a surface-to-be-measured and being arranged in a common plane on a support means, said system comprising: a light source disposed outside the support means, a measuring head connected to the light source through an optical fiber bundle, the measuring head being movable, under deformation of the optical fiber bundle, to measuring positions which oppose a respective object, the measuring head having a photosensor which receives light which is emitted from the light source and which is subsequently reflected at the surface-to-be-measured, thereby measuring the reflection density of the surface-to-be-measured, said system further comprising means for keeping constant the radius of curvature of the bent portion of the optical fiber bundle in any measuring position of the measuring head."

Preferably, the unimaged color saturation of thermographic substrate 10 is less than 0.8 Rd (Rd), more preferably less than 0.5 Rd and most preferably less than 0.15 Rd.

Upon imaging thermographic substrate 10 with a thermal printer, the color saturation of substrate 10 is greater than 0.8 Rd, preferably greater than 1.0. In one embodiment, such color saturation is greater than 1.35.

Figure 2:
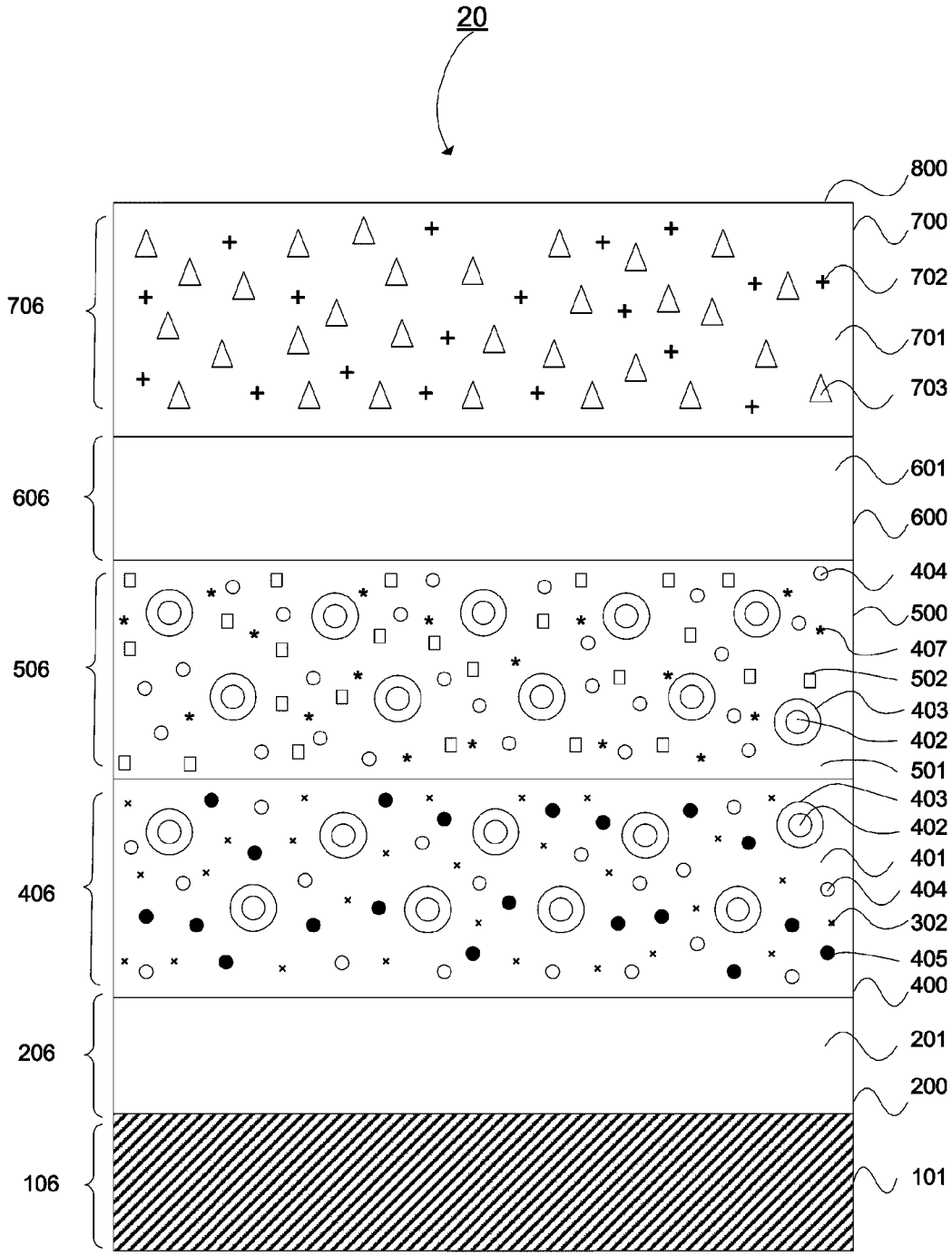

FIG. 2 is a schematic representation of a thermographic substrate 20 made in accordance with one preferred process of this invention; this Figure is not necessarily drawn to scale. Thermographic substrate 20 is comprised of flexible substrate 101, optional surface layer 200, thermosensitive layer 500, optional barrier layer 600 and heat resistant topcoating 700. In addition, thermographic substrate 20 is comprised of colored thermosensitive layer 400 disposed between substrate 101 and thermosensitive layer 500.

Colored thermosensitive layer 400 is comprised of hollow organic pigments 403, thermal solvents 404, binders 40, and light stable colorants 302 all of which have been described elsewhere in this specifications.

Colored thermosensitive layer 400 may preferably be comprised of colored particles 405. Colored particles 405 are comprised of binders 501 and colorants 302 described elsewhere in this specification. Such colored particles may be in the form of a liquid dispersion which may be incorporated into the fluid used to coat thermosensitive layer 400 of thermographic substrate 20.

Colored particles 405 help to segregate colorants 302 in thermosensitive layer 400, reducing the light absorption of such colorants and thus contributing to higher lightness value L* for the thermographic substrate 20. However, upon heating, colored particles 405 readily mix with the binders 401 and thermal solvents 404 in layer 400, enabling said layer to rapidly increase in color saturation.

Colored particles 405 are preferably comprised of wax binders 501, thermal solvents 404 and colorants 302.

Colored particles 405 preferably have an average particle size less than 10 microns, more preferably less than 5 microns and most preferably less than 2 microns.

Colored particles 405 are preferably comprised of from about 1 percent to about 50 percent of colorant 302. Colored particles 405 are more preferably comprised of from about 10 to about 30 percent of colorant 302.

Thermosensitive layer 400 is preferably comprised for from about 1 to about 50 percent of colored particles 405 and/or colorant 302. Thermosensitive layer 400 is more preferably comprised for from about 5 to about 40 percent of colored particles 405 and/or colorant 302. Thermosensitive layer 400 is most preferably comprised for from about 10 to about 33 percent of colored particles 405 and/or colorant 302.

Thermosensitive layer 400 is preferably coated from water. Water based compositions may be prepared such that many of the components remain separated and not intimately mixed at the time of coating and drying. Thermosensitive layer 400 may be comprised of dispersions of solids, emulsions of liquids, microcapsules, hollow organic pigments and the like.

Preferably, thermosensitive layer 400 is comprised of a continuous phase binder in which said dispersions, emulsions, microcapsules, pigments, dyes and hollow organic pigments are dispersed.

Referring again to FIG. 2, thermosensitive layer 400 is comprised of colorants 405 capable of absorbing light. Said thermosensitive layer 400 is opaque and low in color saturation when initially applied to a flexible substrate 101. However, upon heating with a thermal printhead, said layer 400 will become more transparent, enabling the colorants 405 and/or 302 to impart color saturation to the layer.

Thermosensitive layer 400 is comprised of colorants 405 and/or 302 which have sufficient resistance to image fading such that they are suitable for outdoors applications. Such colorants, comprising light stable dyes and/or pigments, are described elsewhere in this specification. Before heating said thermosensitive layer 400, colorants 405 and/or 302 are partially hidden by hollow organic pigments 402. Light scattering by said pigments 402 reduces the effectiveness of such colorants to absorb incident light, lowering the color saturation of the layer. In areas printed with a thermal printer, the combination of heat from the thermal printhead and the thermal solvent 404 causes the collapse of the hollow organic pigment 402. Such collapse of the hollow organic pigment 404 reduces the ability of colored thermosensitive layer 400 to scatter light. The thermally imaged portion of layer 400 thus becomes more transparent, increasing the capability of the colorant 405 and/or 302 to absorb incident light and raising the color saturation of the layer 400.

Referring to FIG. 2, thermosensitive layer 400 preferably has a coating weight 406 of 0.5 to 20 grams per square meter, more preferably from 1 to 10 grams per square meter.

Referring again to FIG. 2, thermosensitive layer 400 is disposed above and contiguous with substrate 101.

Referring again to FIG. 2, thermosensitive layer 400 is optionally disposed above and contiguous with optional surface layer 200.

Upon coating, thermosensitive layer 400 is opaque and low in color saturation. Upon heating with a thermal printer, thermosensitive layer 400 decreases in opacity and increases in color saturation. Thermosensitive layer 400 is capable of developing sufficient visual contrast such that human and machine readable images may be printed by direct heating of said layer 400 with a thermal printhead. Such visual contrast is thermally developed by altering the light scattering capability of the layer 400.

In one embodiment, colored thermosensitive layer 400 is disposed between said substrate 101 and said white opaque thermosensitive layer 500. Upon heating with a thermal printer, thermosensitive layer 500 such becomes transparent, revealing underlying thermosensitive layer 400. Simultaneously, heating from the thermal printer decreases the opacity of thermosensitive layer 400 and increases its color saturation resulting in a significant increase in visual contrast.

Preferably, the unimaged color saturation of thermographic substrate 20 is less than 0.8 Rd, more preferably less than 0.5 Rd and most preferably less than 0.15 Rd.

Upon imaging thermographic substrate 10 with a thermal printer the color saturation of thermographic substrate 20 is greater than 0.8 Rd, preferably greater than 1.0. In one aspect of this embodiment, such color saturation is greater than 1.35.

Figure 3:
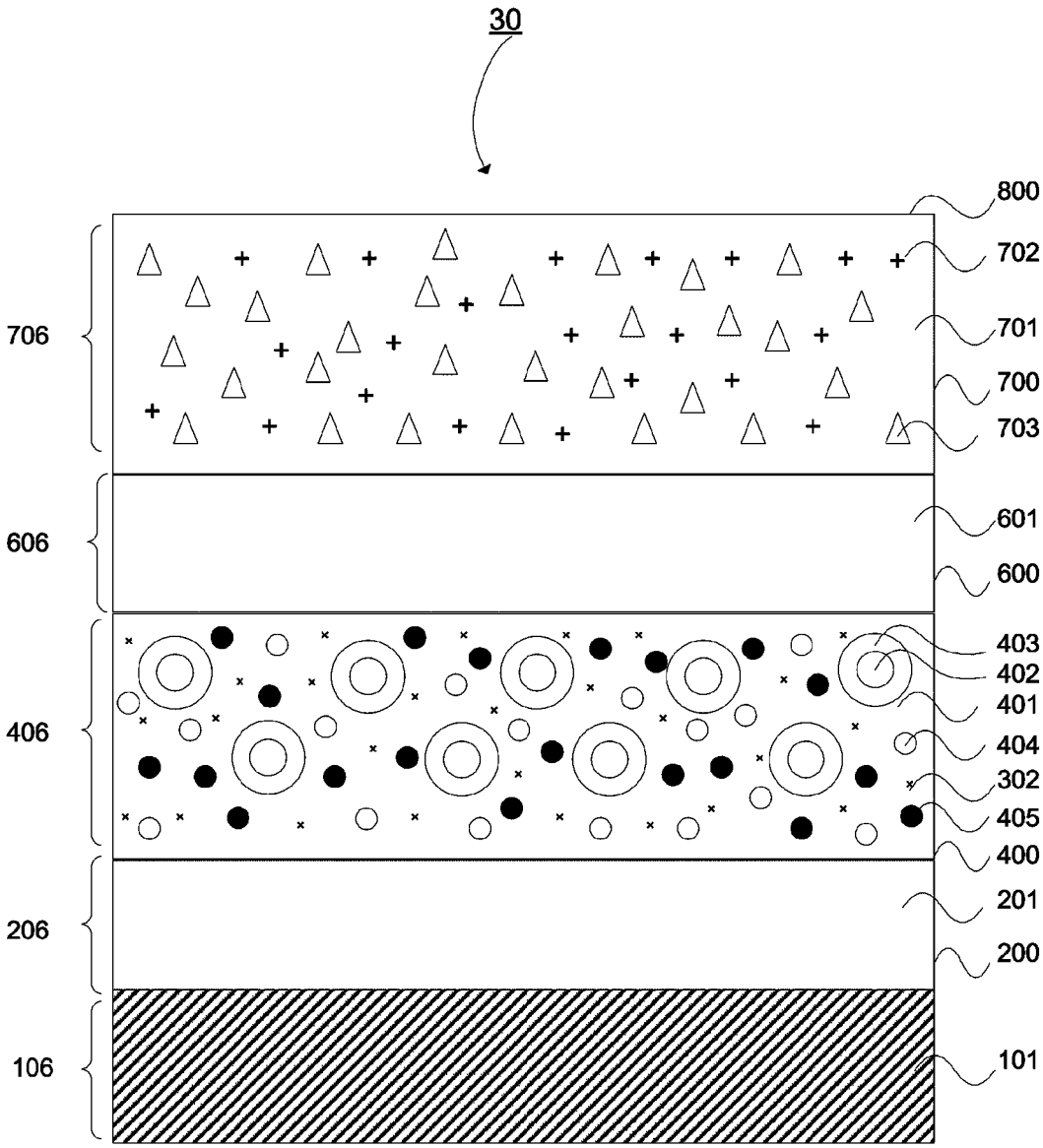

FIG. 3 is a schematic representation of a thermographic substrate 30 made in accordance with one preferred process of this invention; this Figure is not necessarily drawn to scale. Thermographic substrate 30 is comprised of flexible substrate 101, optional surface layer 200, colored thermosensitive layer 400, optional barrier layer 600 and optional heat resistant topcoating 700.

Colored thermosensitive layer 400 is comprised of hollow organic pigments 403, thermal solvents 404, binders 401, light stable colorants 302 and colored particles 405 all of which have been described elsewhere in this specification.

Thermographic substrate 30 utilizes a high lightness colored thermosensitive layer 400. Upon coating, colored thermosensitive layer 400 is opaque and low in color saturation. Upon heating with a thermal printer, thermosensitive layer 400 decreases in opacity and increases in color saturation. Thermosensitive layer 400 is capable of developing sufficient visual contrast such that human and machine readable images may be printed by direct heating of said layer 400 with a thermal printhead. Such visual contrast is thermally developed by altering the light scattering capability of the layer 400.

Preferably, the unimaged color saturation of thermographic substrate 30 is less than 0.9 Rd, and more preferably it is less than 0.8 Rd. In one embodiment, such unimaged color saturation is less than 0.3 Rd.

Upon imaging thermographic substrate 10 with a thermal printer, the imaged color saturation of thermographic substrate 30 is greater than 1.0 Rd, and, more preferably, greater than 1.2. In one embodiment, the imaged color saturation is greater than 1.3.

Figure 4:
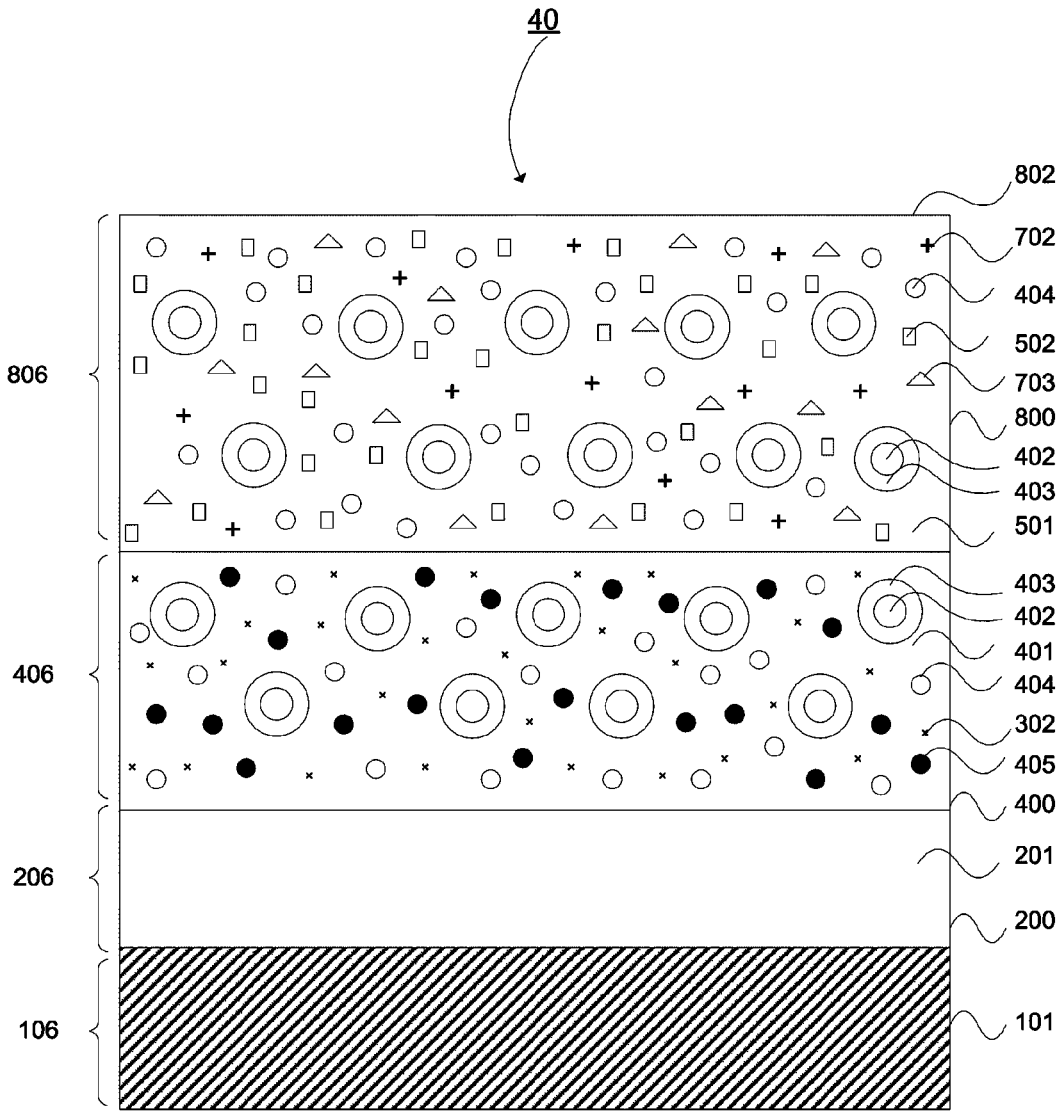

FIG. 4 is a schematic representation of a thermographic substrate 40 made in accordance with one preferred process of this invention; this Figure is not necessarily drawn to scale. Thermographic substrate 40 is comprised of flexible substrate 101, optional surface layer 200, colored thermosensitive layer 400 and a heat resistant thermosensitive layer 800.

Colored thermosensitive layer 400 is comprised of hollow organic pigments 403, thermal solvents 404, binders 401, light stable colorants 302 and colored particles 405, all of which have been described elsewhere in this specifications.

Opaque thermosensitive layer 800 is comprised of hollow organic pigments 403, thermal solvents, 404, binders 501, colorants 502, abrasive particles 702 and lubricants 703.

Thermographic substrate 40 utilizes two thermosensitive layers, 400 and 800. Upon coating, thermosensitive layer 400 and 800 are opaque and low in color saturation. Upon heating with a thermal printer, thermosensitive layer 400 decreases in opacity and increases in color saturation while thermosensitive layer 800 decreases in opacity, becoming more transparent. Thermosensitive layers 400 and 800 are capable of developing sufficient visual contrast such that human and machine readable images may be printed by direct heating of said layers with a thermal printhead. Such visual contrast is thermally developed by altering the light scattering capability of both layers 400 and 800.

Thermosensitive layer 800 is the top most layer of thermographic substrate 40 and as such is the layer whose top most surface 802 must come into direct contact with the thermal printhead. Thermosensitive layer 800 must be resistant to sticking to the thermal printhead and must enable thermographic substrate 40 to pass beneath said printhead with minimal friction, irrespective of the temperature of said printhead. Thermosensitive layer 800 should not rub off or build up on the thermal printhead as such material will interfere with the flow of heat from the printhead to the thermographic substrate 40.

Thermosensitive layers with dual functionality as heat resistant topcoatings are known to those skilled in the art. For example, see U.S. Pat. No. 4,675,705 (the entire disclosure of which is hereby incorporated by reference into this specification) in which heat sensitive coating compositions for thermal printing incorporate both lubricants such as wax and zinc stearate and abrasive particles such as calcium carbonate and aluminum hydrate to reduce residue and sticking (on the printhead) and enhance printing.

The binder 501 for thermosensitive layer 800 may be any composition which does not cause sticking at temperatures of 150 degrees Celsius or higher. Binders described elsewhere in this specification such as binder 201, 301, and 401, may be used. In another preferred embodiment, binder 501 has a glass transition temperature of at least 50 degrees Celsius. In yet another preferred embodiment binder 501 has a glass transition temperature at least 70 degrees Celsius.

In a preferred embodiment, binder 501 is a cross-linked polyvinyl alcohol. Such crosslinked polyvinyl alcohol base topcoating binders have been described in U.S. Pat. No. 6,410,479, the entire disclosure of which is hereby incorporated by reference into this specification.

Preferably, thermosensitive layer 800 is comprised of polyvinyl alcohol. The polyvinyl alcohol use in thermosensitive layer 800 is preferably fully saponified, partially saponified, or denatured by carboxyl, amide, sulfonic acid or butyl aldehyde.

Thermosensitive layer 800 is preferably comprised of a crosslinked binder to further improve its heat resistance and ability not to stick to the thermal printhead. Hydroxyl containing binders such as polyvinyl alcohol, polyurethane, polyacrylates, polyesters, polyacetals and the like may preferably be crosslinked with dialdehydes such as glyoxal or polyaldehyde; one may also use epoxies such as diglycydil type, dimethylolurea such as glycerindiglycidylether; isocyanates; boron oxides; aziradines, oxazolines; and the like.

Thermosensitive layer 800 is preferably comprised of a lubricants 703 and abrasive particles 702 described, e.g., elsewhere in this specification.

Referring to FIG. 4, Thermosensitive layer 800 preferably has a coating weight 806 of from 0.5 to 20 grams per square meter, and, more preferably from 1 to 10 grams per square meter.

Preferably, the unimaged color saturation of thermographic substrate 40 is less than 0.8 Rd, and more preferably it is less than 0.5 Rd. In one embodiment, such unimaged color saturation is less than 0.15 Rd.

Upon imaging thermographic substrate 40 with a thermal printer, the color saturation of thermographic substrate 20 is greater than 0.8 Rd, and it preferably is greater than 1.0. In one embodiment, such color saturation is greater than 1.35.

Figure 5:
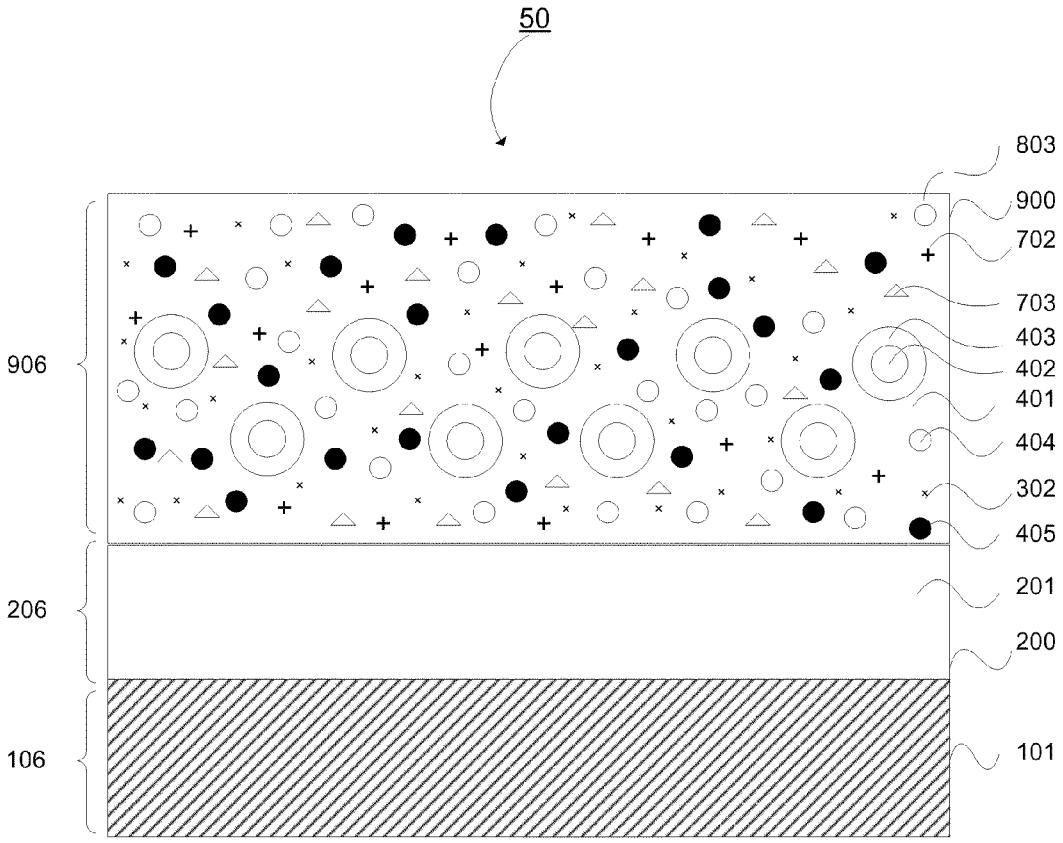

FIG. 5 is a schematic representation of a thermographic substrate 50 made in accordance with one preferred process of this invention; this Figure is not necessarily drawn to scale. Thermographic substrate 50 is comprised of flexible substrate 101, optional surface layer 200 and a colored, heat resistant thermosensitive layer 900.

Colored, heat resistant thermosensitive layer 900 is comprised of hollow organic pigments 403, thermal solvents 404, binders 401, light stable colorants 302, colored particles 405, abrasive particles 702 and lubricants 703, all of which have been described elsewhere in this specification.

Thermographic substrate 50 utilizes thermosensitive layer 900. Upon coating, thermosensitive layer 900 is opaque and low in color saturation. Upon heating with a thermal printer, thermosensitive layer 900 decreases in opacity and increases in color saturation. Thermosensitive layer 900 is capable of developing sufficient visual contrast such that human and machine readable images may be printed by direct heating of said layers with a thermal printhead. Such visual contrast is thermally developed by altering the light scattering capability of layer 900.

Thermosensitive layer 900 is the top most layer of thermographic substrate 50 and, as such, is the layer whose top most surface 803 must come into direct contact with the thermal printhead. Thermosensitive layer 900 must be resistant to sticking to the thermal printhead and must enable thermographic substrate 50 to pass beneath said printhead with minimal friction, irrespective of the temperature of said printhead. Thermosensitive layer 900 should not rub off or build up on the thermal printhead as such material will interfere with the flow of heat from the printhead to the thermographic substrate 50.

Colored, heat resistant thermosensitive layer 900 is comprised of a binder 401 which preferably has the same attributes as binder 501 of thermosensitive layer 800. In a preferred embodiment, binder 401 is a cross-linked polyvinyl alcohol. Such crosslinked polyvinyl alcohol base topcoating binders have been described in U.S. Pat. No. 6,410,479, and they may be used in the process of this invention. The entire disclosure of this patent is hereby incorporated by reference into this specification.

Thermosensitive layer 900 is preferably comprised of a lubricants 703 and abrasive particles 702 described elsewhere in this specification.

Colored, heat resistant thermosensitive layer 900 may preferably be comprised of colorants 302 and colored particles 405 described elsewhere in this specification.

Colored, heat resistant thermosensitive layer 900 is preferably comprised of from about 1 to about 50 percent of colored particles 405 and/or colorant 302. Thermosensitive layer 900 is more preferably comprised of from about 5 to about 40 percent of colored particles 405 and/or colorant 302. Thermosensitive layer 900 is most preferably comprised of from about 10 to about 33 percent of colored particles 405 and/or colorant 302.

Thermosensitive layer 900 is preferably coated from water. Water based compositions may be prepared such that many of the components remain separated and not intimately mixed at the time of coating and drying. Thermosensitive layer 900 may be comprised of dispersions of solids, emulsions of liquids, microcapsules, hollow organic pigments and the like.

Preferably, thermosensitive layer 900 is comprised of a continuous phase binder in which said dispersions, emulsions, microcapsules, pigments, dyes and hollow organic pigments are dispersed.

Referring again to FIG. 5, thermosensitive layer 900 is opaque and low in color saturation when initially applied to a flexible substrate 101. However, upon heating with a thermal printhead, said layer 900 will become more transparent, enabling the colorants 405 and/or 302 to impart color saturation to the layer.

Thermosensitive layer 900 is comprised of colorants 405 and/or 302 which have sufficient resistance to image fading such that they are suitable for outdoors applications. Such colorants, comprising light stable dyes and/or pigments are described elsewhere in this specification. Before heating said thermosensitive layer 900, colorants 405 and/or 302 are partially hidden by hollow organic pigments 402. Light scattering by said pigments 402 reduces the effectiveness of such colorants to absorb incident light, lowering the color saturation of the layer. In areas printed with a thermal printer, the combination of heat from the thermal printhead and the thermal solvent 404 cause the collapse of the hollow organic pigment 402. Such collapse of the hollow organic pigment 404 reduces the ability of colored, heat resistant thermosensitive layer 900 to scatter light. The thermally imaged portion of layer 900 thus becomes more transparent, increasing the capability of the colorants 405 and/or 302 to absorb incident light and raising the color saturation of the layer 900.

Referring again to FIG. 5, thermosensitive layer 900 preferably has a coating weight 906 of 0.5 to 20 grams per square meter and, more preferably, from 1 to 10 grams per square meter.

Preferably, the unimaged color saturation of thermographic substrate 50 is less than 0.8 Rd; more preferably it is less than 0.5 Rd; and most preferably it is less than 0.15 Rd.

Upon imaging thermographic substrate 50 with a thermal printer, the color saturation of thermographic substrate 50 is greater than 0.8 Rd, preferably greater than 1.0; in one aspect of this embodiment, the color saturation is greater than 1.35.

Figure 6A:
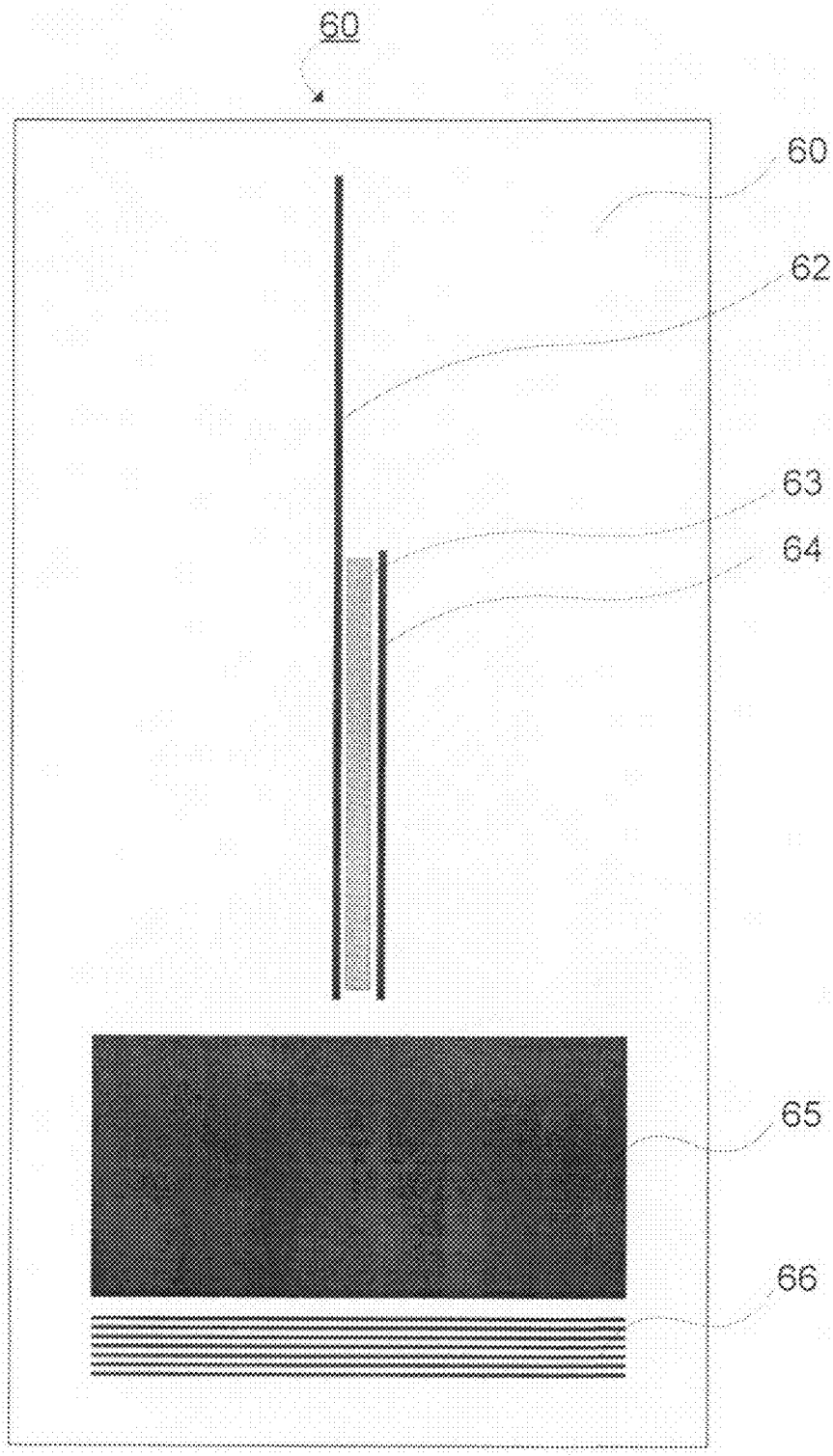
FIG. 6 is a schematic representation of a thermally printed image used to assess the impact of the thermographic substrate on the long term printing performance of the thermal printer.
Figure 6B:
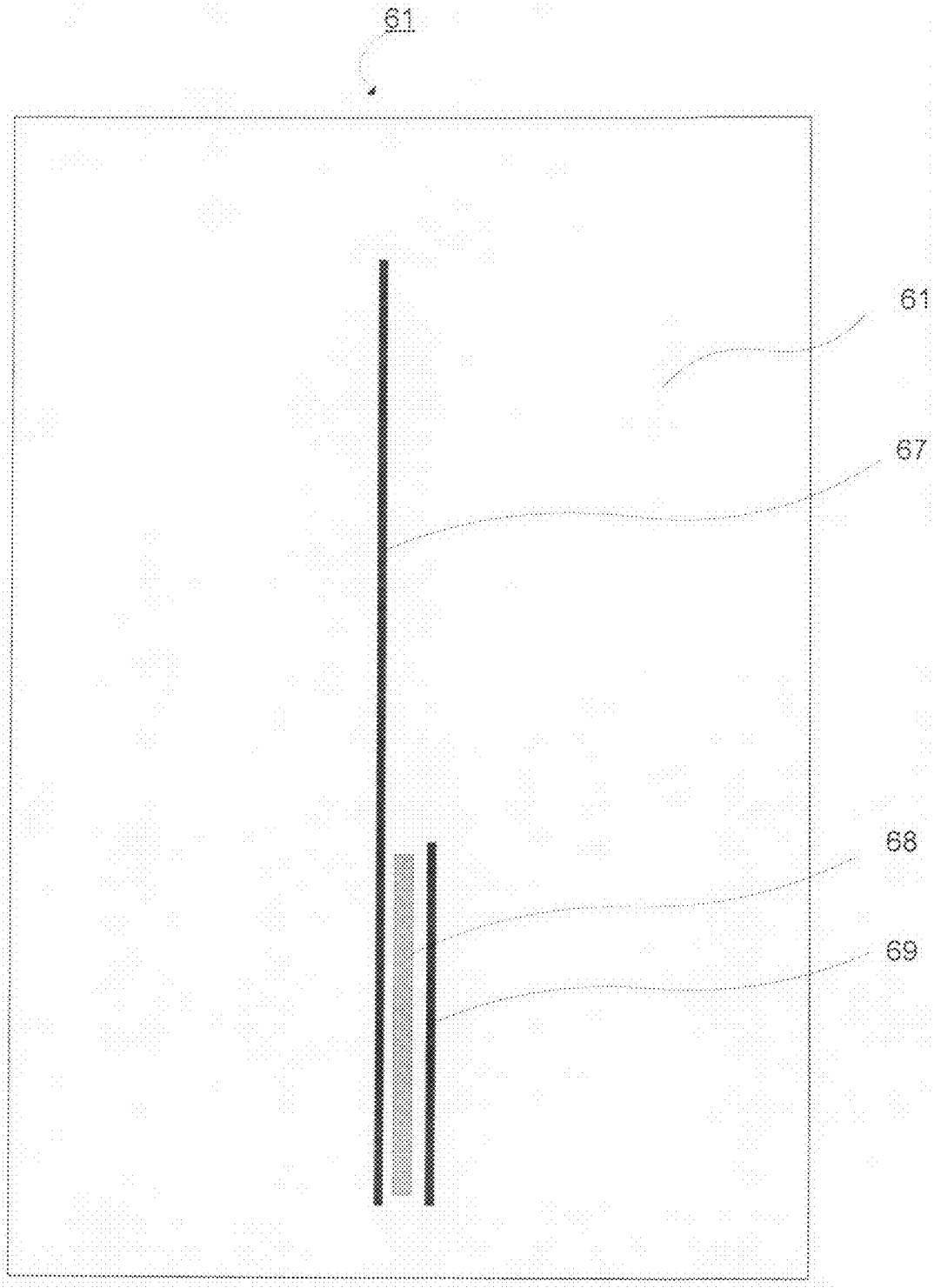

FIG. 6 is a schematic representation of two thermal printing images which may be utilized to assess the performance of thermographic substrates for image quality over the course of extended printing operations. It is known to those skilled in the art that thermographic substrates may damage a thermal printhead after repeated printing either by depositing buildup on the printhead or by excessively wearing the printhead. Such damage can impede the flow of heat between the printhead and the thermographic substrate and in extreme, completely damage one or more heating elements of the printhead. The image 61 in FIG. 6*b* may be repeatedly printed onto a long length of thermographic substrate to assess the impact of repeated printing on image quality. The printed lines 67 and 69 and printed text 68 parallel to the printing direction shown in the FIG. 6*b* simulate extended printing under hot conditions while the unprinted areas simulate printing under cold temperatures. Before and after such an extended printing test the image 60 in FIG. 6*a* may be printed to assess the impact on image quality. Image 60 is comprised on printed lines 62 and 64 and printed text 63 parallel to the printing direction and aligned relative to the print head in the same position as lines 67 and 69 and printed text 68. If repeated printing of image 61 impacts the image quality of printed thermographic substrate, then a change should be observed between the initial image quality print 60 and the final image quality print 60. In particular, if there is a degradation in of the image quality of the thermographic print then uniformity of the rectangle 65 will be degraded with streaks parallel to lines 62 and 64 and the continuity of the seven lines 66 perpendicular to the print direction will be broke for image 60 shown in FIG. 6*a*.

Figure 7:
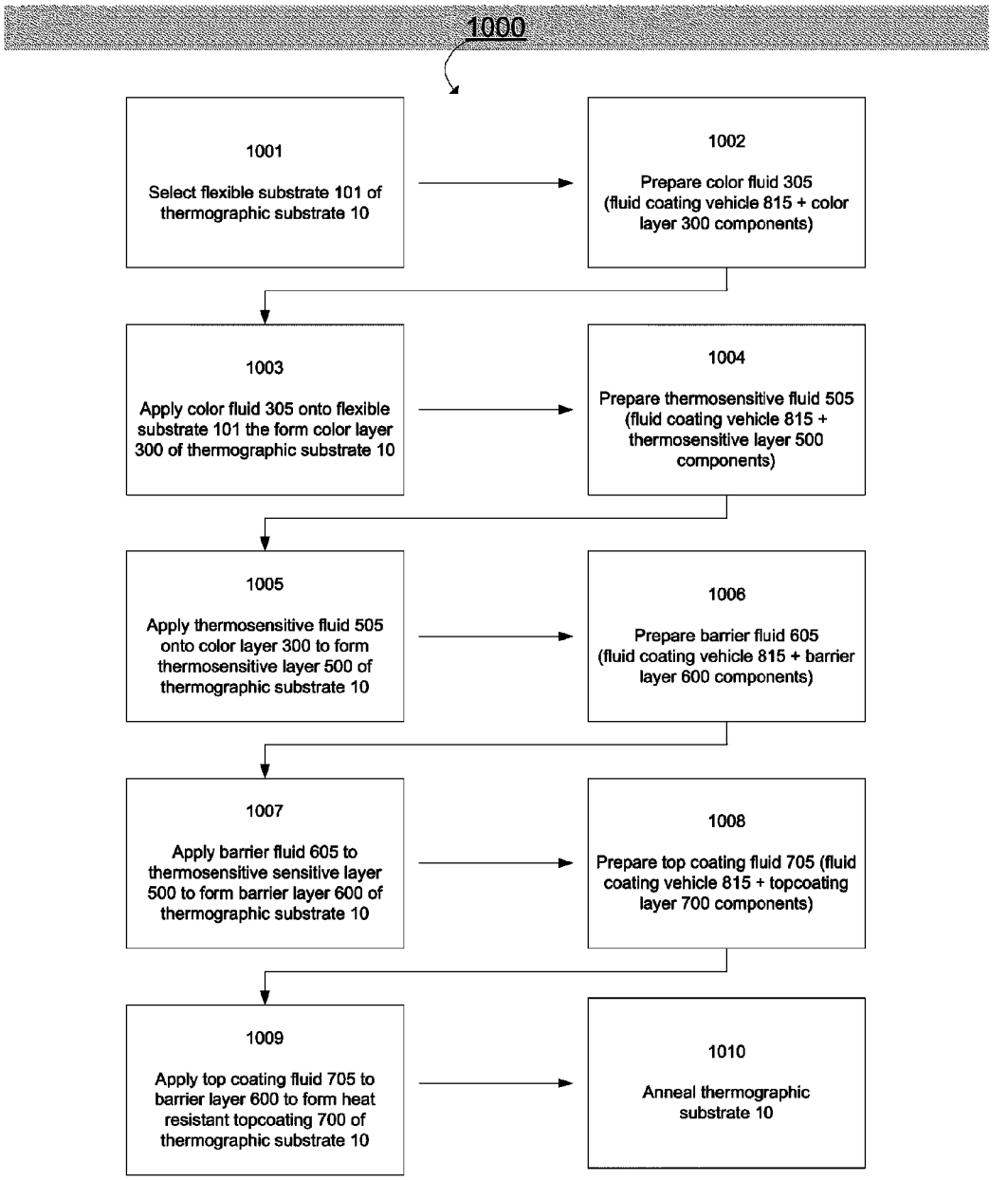
FIG. 7 is a schematic representation of process used to prepare a thermographic substrate.

FIG. 7 describes a process 1000 used to prepare a thermographic substrate 10. As is illustrated in FIG. 7, and in the preferred embodiment depicted therein, in step 1001 the thermographic substrate 10 is prepared by first selecting a flexible substrate 101. The flexible substrate 101 is the base onto which the various layers of the thermographic substrate 10 will be applied.

The flexible substrate may be any of the flat, flexible supports described elsewhere in this specification including various papers and films. Step 1001 may include the treatment of the substrate 101 with corona discharge, flame, ionization or other such treatments to increase the surface energy of said substrate 101 to better facilitate wetting and adhesion of coated layers onto said substrate 101.

Referring again to FIG. 7, in step 1002 fluid 305 is prepared. This color fluid 305 is comprised of the various compounds described elsewhere in this specification for the color layer 300 and may include colorant 302, binder 301 as well as a fluid coating vehicle 815.

Fluid coating vehicle 815 may be comprised of a liquid such as water or solvent. Alternatively, the fluid coating vehicle 815 may be comprised of a wax or resin which, when heated above its melting point or glass transition temperature, become a fluid. The components of the color layer 300 may be mixed into the fluid coating vehicle 815. Some of the components of color layer 300 may be soluble in fluid coating vehicle 815. Such soluble components are dissolved into fluid coating vehicle 815 and such dissolution may be facilitate by heating.

In a preferred embodiment, the fluid coating vehicle 815 is heated to a temperature which is lower than its boiling point to facilitate dissolution of a soluble component.

Some components, such as particulate matter, may be milled into said fluid coating vehicle 815 to form a particulate dispersion. Those skilled in the art will understand that milling methods may include, but are not limited to, three roll milling, grinding, ball milling, attrition, sonication, homogenization, small media milling and the like. After such milling the particulate components of the color layer 300 should have an average particle size from about 50 nm to about 10 microns.

Heated dispersions or solutions in the fluid coating vehicle 815 are preferably cooled prior to mixing with other components of the color layer 300.

In a preferred embodiment, a defoaming additive is added to color fluid 305 to control foaming of said fluid 305.

In a preferred embodiment, a surfactant or wetting additive is added to color fluid 305 to improve wetting of color fluid 305 onto substrate 101.

Once all of the components of the color layer 300 are mixed or milled into the fluid coating vehicle 815, they are combined together and mixed until they are homogeneously dispersed to form said color fluid 305.

Referring again to FIG. 7, in step 1003 of process 1000 the color fluid 305 is applied to flexible substrate 101. Step 1003 may use any of the commonly used coating processes known to those skilled in the art such as slot die, rotogravure coating, flexographic coating, roll coating, extrusion coating, lithographic coating, curtain coating and the like. In addition, various printing methodologies may be used to apply said color fluid 305 to said substrate 101 including, but not limited to, ink jet printing, flexo printing, letter press printing, gravure printing, stamp printing, pad printing and the like.

In a preferred embodiment, the color fluid 305 is printed onto the flexible substrate 101 to form an imaged color layer 300 comprised of text, graphics, codes and the like.

In another preferred embodiment, several different color fluids 305 are printed onto different regions of the flexible substrate 101 to form a multicolored color layer 300.

When the fluid coating vehicle 815 used to prepare the color fluid 305 is a liquid, then process 1003 to apply the color fluid 305 to the substrate 101 will include a drying step to remove the fluid coating vehicle 815 from the color fluid 305 after it has been applied to the substrate 101. Color layer 300 must be sufficiently dry so that it is no longer tacky or sticky and can be wound into a roll and resist blocking or adhering to the backside of substrate 101. Preferably, color layer 300 should contain less than about 10% of fluid coating vehicle 815 after the application and drying of process 1003.

In a preferred embodiment, the temperature of the drier in step 1003 of process 1000 does not exceed 100 degrees Celsius.

When the fluid coating vehicle 815 used to prepare the color fluid 305 is a wax or resin, then process 1003 to apply the color fluid 305 to the substrate 101 will heat the color fluid to a temperature above the melting point or glass transition temperatures of these materials. Typically, such temperatures will be between about 50 and 200 degrees Celsius. Process 1003 will include a cooling step to chill fluid coating vehicle 815 below its melting point or glass transitions temperature after the color fluid 305 has been applied to the substrate 101. Color layer 300 must be sufficiently cool and solidified so that it is no longer tacky or sticky and can be wound into a roll and resist blocking or adhering to the backside of substrate 101. Color layer 300 may comprise from about 30 to about 95 weight percent of said wax or resin fluid coating vehicle 815 after the application and cooling of process 1003.

The color fluid 305 may be applied with step 1003 to form a color layer 300 of various thicknesses 306. The color layer dry thickness 306 preferably has a thickness from about 0.1 micron to about 25 microns.

Referring again to FIG. 7, a thermosensitive fluid 505 is produced in step 1004. This thermosensitive fluid 505 is comprised of the various compounds described elsewhere in this specification for the thermosensitive layer 500 and may include hollow sphere organic pigments 402, thermal solvents 404, particles 407, binders 501 and optional colorants 502 as well as a fluid coating vehicle 815. Fluid coating vehicle 815 may be comprised of a liquid such as water or solvent. In a preferred embodiment the fluid coating vehicle 815 is water. When the fluid coating vehicle is solvent, it must be a solvent which is capable of dispersing the hollow sphere organic pigments 402 without attacking, softening, swelling, collapsing or distorting said pigments 402. The components of the thermosensitive layer 500 may be mixed into the fluid coating vehicle 815. Some of the components of thermosensitive layer 500 may be soluble in fluid coating vehicle 815. Such soluble components are dissolved into fluid coating vehicle 815 and such dissolution may be facilitate by heating.

In a preferred embodiment, the fluid coating vehicle 815 is heated to a temperature which is lower than its boiling point to facilitate dissolution of a soluble component.

Some components, such as particulate matter, may be milled into said fluid coating vehicle 815 to form a particulate dispersion as described elsewhere in this specification.

Heated dispersions or solutions in the fluid coating vehicle 815 are preferably cooled prior to mixing with other components of the thermosensitive layer 500.

In a preferred embodiment, particles 407 are added to fluid coating vehicle 815 and mixed prior to adding other components of thermosensitive layer 500.

In a preferred embodiment, a defoaming additive is added to thermosensitive fluid 505 to control foaming of said fluid 505.

In a preferred embodiment, a surfactant or wetting additive is added to thermosensitive fluid 505 to improve wetting of color fluid 505 onto color layer 300.

Once all of the components of the thermosensitive layer 500 are mixed or milled into the fluid coating vehicle 815, they are combined together and mixed until they are homogeneously dispersed to form said thermosensitive fluid 505.

Referring again to FIG. 7, step 1005 applies the thermosensitive fluid 505 to color layer 300 which in turn is applied to flexible substrate 101. The application step 1005 may use any of the commonly used coating processes known to those skilled in the art such as slot die, rotogravure coating, flexographic coating, roll coating, extrusion coating, lithographic coating, curtain coating and the like. In addition, various printing methodologies may be used to apply said thermosensitive fluid 505 to said substrate 101 including, but not limited to, ink jet printing, flexo printing, letter press printing, gravure printing, stamp printing, pad printing and the like.

In a preferred embodiment, the thermosensitive fluid 505 is printed onto the color layer 300 to form an imaged thermosensitive fluid 505 comprised of text, graphics, codes and the like.

In another preferred embodiment, several different thermosensitive fluid 505 are printed onto different regions of the color layer 300 to form a multicolored thermosensitive layer 500.

When the fluid coating vehicle 815 used to prepare the thermosensitive fluid 505 is a liquid, then step 1005 to apply the thermosensitive fluid 505 to the color layer 300 will include a drying step to remove the fluid coating vehicle 815 from the thermosensitive layer 500 after it has been applied to the color layer 300. Thermosensitive layer 500 must be sufficiently dry so that it is no longer tacky or sticky and can be wound into a roll and resist blocking or adhering to the backside of substrate 101. Preferably, thermosensitive layer 500 should contain less than about 10% of fluid coating vehicle 815 after the application and drying of process 1005.

In a preferred embodiment, the temperature of the drier in step 1005 of process 1000 does not exceed 100 degrees Celsius.

The thermosensitive fluid 505 may be applied with step 1005 to form a thermosensitive layer 500 of various thicknesses 506. Thermosensitive layer 500 preferably has a coating weight 506 of 0.5 to 20 grams per square meter, more preferably from 1 to 10 grams per square meter.

Referring again to FIG. 7, step 1006 prepares a barrier fluid 605. This barrier fluid 605 is comprised of the various compounds described elsewhere in this specification for the barrier layer 600 and may include binders 501 as well as a fluid coating vehicle 815. Fluid coating vehicle 815 may be comprised of a liquid such as water or solvents. In a preferred embodiment the fluid coating vehicle 815 is water. When the fluid coating vehicle is solvent, it must be a solvent which is capable of dispersing the hollow sphere organic pigments 402 without attacking, softening, swelling, collapsing or distorting said pigments 402. The components of the barrier layer 600 may be mixed into the fluid coating vehicle 815.

Some of the components of barrier layer 600 may be soluble in fluid coating vehicle 815. Such soluble components are dissolved into fluid coating vehicle 815 and such dissolution may be facilitate by heating.

In a preferred embodiment, the fluid coating vehicle 815 is heated to a temperature which is lower than its boiling point to facilitate dissolution of a soluble component.

Alternatively, some components, such as particulate matter, may be milled into said fluid coating vehicle 815 to form a particulate dispersion as described elsewhere in this specification.

Heated dispersions or solutions in the fluid coating vehicle 815 are preferably cooled prior to mixing with other components of the barrier layer 600.

In a preferred embodiment, a defoaming additive is added to barrier fluid 605 to control foaming of said fluid 605.

In a preferred embodiment, a surfactant or wetting additive is added to barrier fluid 605 to improve wetting of barrier fluid 605 onto thermosensitive layer 500.

Once all of the components of the barrier layer 600 are mixed or milled into the fluid coating vehicle 815, they are combined together and mixed until they are homogeneously dispersed to form said barrier fluid 605.

Referring again to FIG. 7, step 1007 applies the barrier fluid 605 to thermosensitive layer 500 which in turn is applied to color layer 300 on flexible substrate 101. The application step 1007 may use any of the commonly used coating processes known to those skilled in the art such as slot die, rotogravure coating, flexographic coating, roll coating, extrusion coating, lithographic coating, curtain coating and the like. In addition, various printing methodologies may be used to apply said barrier fluid 605 to said thermosensitive layer 500 including, but not limited to, ink jet printing, flexo printing, letter press printing, gravure printing, stamp printing, pad printing and the like.

When the fluid coating vehicle 815 used to prepare the barrier fluid 605 is a liquid, then step 1007 to apply the barrier fluid 605 to the thermosensitive layer 500 will include a drying step to remove the fluid coating vehicle 815 from the barrier layer 600 after it has been applied to the thermosensitive layer 500. Barrier layer 600 must be sufficiently dry so that it is no longer tacky or sticky and can be wound into a roll and resist blocking or adhering to the backside of substrate 101. Preferably, barrier layer 600 should contain less than about 10% of fluid coating vehicle 815 after the application and drying of process 1007.

In a preferred embodiment, the temperature of the drier in step 1007 of process 1000 does not exceed 100 degrees Celsius.

The barrier fluid 605 may be applied with step 1007 to form a barrier layer 600 of various thicknesses 606. Barrier layer 600 preferably has a coating weight 606 of at least about 0.1 grams per square meter to 10 grams per square meter.

Referring again to FIG. 7, step 1008 prepares a topcoating fluid 705. This coating fluid 705 is comprised of the various compounds described elsewhere in this specification for the heat resistant topcoat 700 which is comprised of heat resistant binder 701 and optionally one or more abrasive particles 702 and one or more lubricants 703 as well as a fluid coating vehicle 815. Fluid coating vehicle 815 may be comprised of a liquid such as water or solvents.

In a preferred embodiment the fluid coating vehicle 815 is water.

When the fluid coating vehicle is solvent, it must be a solvent which is capable of dispersing the hollow sphere organic pigments 402 without attacking, softening, swelling, collapsing or distorting said pigments 402. The components of the topcoat layer 700 may be mixed into the fluid coating vehicle 815.

Some of the components of topcoat layer 700 may be soluble in fluid coating vehicle 815. Such soluble components are dissolved into fluid coating vehicle 815 and such dissolution may be facilitated by heating.

In a preferred embodiment, the fluid coating vehicle 815 is heated to a temperature which is lower than its boiling point to facilitate dissolution of a soluble component.

Alternatively, some components, such as particulate matter, may be milled into said fluid coating vehicle 815 to form a particulate dispersion as described elsewhere in this specification.

Heated dispersions or solutions in the fluid coating vehicle 815 are preferably cooled prior to mixing with other components of the topcoat layer 700.

In a preferred embodiment, a defoaming additive is added to topcoat fluid 705 to control foaming of said fluid 705.

In a preferred embodiment, a surfactant or wetting additive is added to topcoating fluid 705 to improve wetting of topcoating fluid 705 onto barrier layer 600.

Once all of the components of the topcoat layer 700 are mixed or milled into the fluid coating vehicle 815, they are combined together and mixed until they are homogeneously dispersed to form said topcoat fluid 705.

Referring again to FIG. 7, step 1009 applies the topcoat fluid 705 to barrier layer 600 which in turn is applied to the thermosensitive layer 500 which is applied on the color layer 300 which is applied on flexible substrate 101. The application process 1009 may use any of the commonly used coating processes known to those skilled in the art such as slot die, rotogravure coating, flexographic coating, roll coating, extrusion coating, lithographic coating, curtain coating and the like. In addition, various printing methodologies may be used to apply said topcoat fluid 705 to said barrier layer 600 including, but not limited to, ink jet printing, flexo printing, letter press printing, gravure printing, stamp printing, pad printing and the like.

When the fluid coating vehicle 815 used to prepare the topcoat fluid 705 is a liquid, then step 1009 to apply the topcoat fluid 705 to the barrier layer 600 will include a drying step to remove the fluid coating vehicle 815 from the topcoat layer 700 after it has been applied to the barrier layer 600. Topcoat layer 700 must be sufficiently dry so that it is no longer tacky or sticky and can be wound into a roll and resist blocking or adhering to the backside of substrate 101. Preferably, topcoat layer 700 should contain less than about 10% of fluid coating vehicle 815 after the application and drying of process 1009.

In a preferred embodiment, the temperature of the drier in step 1009 of process 1000 does not exceed 100 degrees Celsius.

The topcoat fluid 705 may be applied with process 1009 to form a topcoat layer 700 of various thicknesses 706. Topcoat layer 700 preferably has a coating weight 706 of at least about 0.05 grams per square meter to 10 grams per square meter.

The thermographic substrate 10 assembly is prepared by building up, layer over layer, on a flexible substrate 101 a color layer 300 using color fluid 305 and application step 1003, a thermographic layer 500 using thermosensitive fluid 505 and application step 1005, a barrier layer 600 using barrier fluid 605 and application step 1007, and finally a topcoating layer 700 using topcoating fluid 705 and application step 1009.

Referring again to FIG. 7, the thermographic substrate 10 may be thermally annealed in process 810. Such annealing helps to consolidate the various layers of thermographic substrate 10, improving interlayer adhesion and thermographic performance. Such annealing is preferably done at temperatures less than about 60 degrees Celsius and for times from at least 1 minute to about 96 hours.

EXAMPLES

The following examples are presented to illustrate the claimed invention but are not to be deemed limitative thereof. Unless otherwise specified, all temperatures are in degrees Celsius, and all parts are by weight.

Example 1

This example illustrates the preparation of a thermographic substrate that comprises a base polyester flexible substrate (sold as part number "21940 THERMLfilm SELECT "by (FlexCON Inc of Spenser, Mass.), a color (black) layer, a thermo-sensitive opaque (white) layer, and a heat resistant topcoated layer that together will, when heated to a temperature range produced by a thermal printer printhead, produce a visually contrasting colored (black), image.

In the experiment described by this example, a black nitrocellulose gravure color ink was applied to the polyester substrate using a #4 Meyer rod for an average wet coverage of 3.57 grams per square meter, and it was allowed to dry, resulting in a black color layer with a dry coverage of 1.07 grams per square meter.

In such experiment, the black color layer coated on the polyester substrate was measured for reflective density (Rd) using a MacBeth (Grandville, Mich.) model RD914 densitometer. The Rd of the black color layer was 1.8.

An opaque thermosensitive coating ink having the following composition was prepared: 15.5 of a 30 percent styrene/acrylic hollow organic pigment dispersion in water (known as Ropaque OP-96 and sold by the Rohm and Haas Company, 100 Independence Mall West, Philadelphia, Pa.) was added to a small plastic mixing vessel. To this, 6.25 grams of a 40 percent dispersion in water of dibenzyl oxalate thermal solvent (sold as product HS-2046 by Cytech Products, 906 Peterson Dr., Elizabethtown, Ky.), 3.25 grams of a 40 percent calcium stearate dispersion (Cytech Products), 8 grams of C44 30 percent acrylic resin binder solution (CIBA, Port Arthur, Tex.) and 2.69 grams of tap water were added and stirred until the fluid was homogenous. Using #15 Meyer coating rod, the fluid was coated over the top of the black color layer, and the water was dried out of the layer using room temperature blown air. The white opaque thermosensitive layer had a dry coating weight of 5.5 grams per square meter and an of 0.16.

A heat resistant topcoating ink having the following composition was prepared: 4.07 grams of water in a heated vessel was brought to a temperature of 90 degrees Celsius, and 0.7 grams of polyvinyl alcohol (Celvol 103, sold by Sekisui Specialty Chem, Dallas, Tx.) were added and mixed until it was dissolved into the water. The solution temperature was cooled to 25 degrees Celsius. To this mixture the following materials were added: 1.44 grams of heat resistant varnish (sold by XSYS Print Solutions, 2401 Whitehall Park Dr, Charlotte N.Y.), 0.23 grams of calcium stearate dispersion as above, 0.3 grams of 15 percent silica dispersion (sold as Perkasil 660, by (WR Grace, 7500 Grace Dr., Columbia, Md.), 0.05 grams of fluorinated wetting agent (sold as Chemwet 29 by the Chemcor Corporation of 48 Leone Lane, Chester, N.Y.) and 2.29 grams of water; and the resulting mixture was mixed.

The protective layer was coated with a #6 drawdown rod over the top of the thermosensitive ink layer and dried. The heat resistant layer had a dry coat weight of 1.5 grams per square meter. The resulting thermographic substrate was subjected to a temperature of 45 degrees Celsius (in an oven) for 12 hours. The system was imaged using a Zebra LP2824-Z thermal printer at 2 inches per second print speed and a printer darkness setting of 30. The reflective density of the imaged area was tested to be 1.35, and the Rd of the unimaged area was 0.16, the resulting contrast ration was 7.43.

The imaged sample was subjected to a fading test in a QUV Photostability Chamber (sold by Q-Panel Lab Products of Cleveland, Ohio) for 144 hours of continuous exposure. The sample so tested was remeasured for Rd. The unimaged portion had an Rd of 0.20, and the imaged portion had an Rd of 1.33. Consequently, after this accelerated aging test, the imaged portion had a contrast ratio 5.65, substantially above the desired contrast ratio after exposure of 0.5 described elsewhere in this specification.

By comparison, when a prior art leuco-dye based thermographic system (obtained from Kanzaki Corporation of Japan) was similarly tested, it had a contrast ratio of 0.14. The contrast ratio of applicants' device was 4013 percent greater than the contrast ratio of the prior art device.

It should be noted that, with the prior art device, the contrast ratio prior to the accelerated aging test was comparable (slightly higher) than the contrast ratio of applicants' device.

Example 2

This example illustrates the preparation of a thermographic substrate that consists of a polyester flexible substrate (21940 THERMLfilm), a black color layer, an opaque (white) thermosensitive layer, and a heat resistant topcoating that together will, when heated to a temperature range, produce a visually colored (black) image.

The black color layer described in Example 1 was coated onto the polyester substrate via drawdown rod #4 and dried, and the reflective density was measured to be 1.8.

A white opaque thermosensitive coating ink having the following composition was prepared: 12.45 grams of a 30 percent styrene/acrylic hollow organic pigment dispersion in water known as "Ropaque 0-96" was added to a small plastic mixing vessel. To this, 2.08 grams of a 40 percent dispersion in water of dibenzyl oxalate thermal solvent (HS-2046), 2.78 g of a wax binder (a 30 percent Carnauba wax dispersion in water obtained from Koster Keunen, LLC, 1021 Echo Lake Rd., Watertown, Conn.), and 2.69 grams of tap water were added and stirred until the fluid was homogenous. Using a #15 coating rod, this was coated over the top of the black color layer, and the water was dried out of the layer using room temperature blown air to yield a dry coating weight of 5.72 grams per square meter. This thermographic substrate was white in color and had a measured reflective density of 0.15.

Similar to the procedure described in Example 1, a heat resistant topcoating was prepared and coated over the white opaque thermosensitive layer, tempered at 45 degrees Celsius for 12 hours, and imaged via Zebra LP2824-Z printer. The Rd of the imaged area was tested to be 1.65, and the Rd of the unimaged area was 0.15; the resulting contrast ratio was 10.0.

Example 3

Sample thermosensitive coatings comprised of combinations of five different hollow organic pigments and five different thermal solvents were evaluated for transparentization as a function of temperature. The following hollow organic pigments were used:

TABLE 1

Hollow Organic Pigments of Example 3

| Organic Pigment | Supplier | resin | wet grams/cc | dry grams/cc | PS μ | percent void |
|---|---|---|---|---|---|---|
| Ropaque OP-96 | Rohm&Haas | styrene/acrylate | 1.03 | 0.63 | 0.5 | 42 |
| Hique 168 | Nae Woi | styrene/acrylate | 1.02 | | 0.5 | |
| Hique 332 | Nae Woi | styrene/acrylate | 1.03 | | 0.4 | |
| Hique332L | Nae Woi | styrene/acrylate | 1.03 | | 0.4 | |
| Hique2050 | Nae Woi | styrene | 1.02 | | 1.2 | |

The following thermal solvents, ranging in solubility parameter from 15.3 Megapascals$^{1/2}$ to 29.9 Megapascals$^{1/2}$ in Table 2 were used.

TABLE 2

Thermal Solvents Used in Example 3

| Thermal Solvent | δ MPa$^{1/2}$ | Supplier | Location |
|---|---|---|---|
| Ethylene Glycol | 29.9 | Univar Inc. | Tonawana, NY |
| Dipropylene Glycol | 20.5 | Dow Corp. | Midland, MI |
| Dibenyl oxalate (HS2046) | 16.6 | DIC Corp. | Osaka, Japan |
| Butyl Stearate | 15.3 | Sigma-Aldrich | St. Louis, MO |

Samples were prepared by mixing 3 grams of one of the various hollow organic pigment dispersions, with 3 grams of water and 3 grams of a 15 percent solution of Celvol 103 polyvinyl alcohol binder. To this mixture was added 0.6 grams of Chemwet 29 surfactant and 0.75 grams of one of the aforementioned various thermal solvents. For each of the hollow organic pigments in this example, a sample was also prepared without the addition of any thermal solvent. The total number of samples prepared was 30. The mixture was then gently shaken to mix and coated with a #15 Myer Rod onto a Gardner Opacity Chart substrate (AG-5305/2813, available from BYK/Gardner Instruments of Columbia, Md.). The coating was then dried with a heat gun until dry to the touch. The opacity chart had a large black panel printed on it which can be used to gauge the opacity of the dried sample coating. Reflection densities were taken of the coating over the black panel of the opacity chart with an X-Rite 500 Series Spectrodensitometer (available from X-Rite Inc., Grandville, Mich.). Separate portions of each sample were heated to various temperatures by placing them in direct contact with a metal washer sitting atop a thermostatted hotplate for 10 seconds. After the samples were allowed to cool the Rd's of the heated portions were measured.

The contrast ratio ((Heated Rd−Unheated Rd)/Unheated Rd) is a measure of the change in opacity of the coated sample. The higher the contrast ratio, the more transparent the sample coating becomes upon heating. By transparentizing, the coating is less effective at covering the underlying black panel on the opacity chart.

Both the Rd of each unheated sample as well as the contrast ratio of each heated sample is shown in Table 3. For each of the hollow organic pigments, a sample was prepared without the addition of any thermal solvent (samples 3a, 3g, 3m, 3s, and 3y). As can be seen in Table 3, each of these samples, without thermal solvent, showed an increase in contrast ratio at 200 degrees Celsius. It might be noted that samples containing Ropaque 96, Hique 168 and Hique 332 hollow organic pigments all showed good transparentization at 200 degrees Celsius and slight transparentization at 175 degrees Celsius. Samples prepared with Hique 332L and Hique 2050 hollow organic pigments shown only slight transparentization at 200 degrees Celsius and no transparentization at 175 degrees Celsius or below.

The addition of thermal solvents to the samples generally lowered the temperature at which the sample coated showed good transparentization (contrast ratio greater than 0.5) and increased the un-imaged Rd. The increase in unimaged Rd was attributed to a dilution in the concentration of hollow organic pigments from the added thermal solvent, which accounted about 36 weight percent of the thermosensitive layer when added. Thermal solvents on the extremes of the solubility parameter range, ethylene glycol (29.9 Megapascals$^{1/2}$) and butyl stearate (15.3 Megapascals$^{1/2}$), were least effective at promoting transparentization of the sample coatings. Thermal solvents in the mid range of solubility parameters, dibenzyl oxalate (16.6 Megapascals$^{1/2}$), dipropylene glycol (20.5 Megapascals$^{1/2}$) and propylene carbonate (27.2 Megapascals$^{1/2}$), were most effective at promoting transparentization of the sample coatings. Across all 5 hollow organic bead types evaluated in this experiment, these intermediate solubility thermal solvents were able to reduce the temperature at which good transparentization occurred to 175 degrees Celsius or less. In fact, the dibenzyl oxalate thermal solvent was able to reduce the temperature down to 93 degrees Celsius for all 5 hollow organic pigment types (samples 3e, 3k, 3q, 3w and 3ac).

TABLE 3

Thermosensitive Layers of Example 3

| Sample ID | Hollow Pigment | Thermal solvent | δ MPa$^{1/2}$ | Rd 20° C. | Contrast Ratio 93° C. | 150° C. | 175° C. | 200° C. |
|---|---|---|---|---|---|---|---|---|
| 3a. | Ropaque 96 | NONE | | 0.26 | 0.0 | 0.2 | 0.7 | 2.2 |
| 3b. | Ropaque 96 | ethylene glycol | 29.9 | 0.46 | 0.1 | 0.3 | 0.8 | 1.4 |
| 3c. | Ropaque 96 | propylene carbonate | 27.2 | 0.48 | −0.2 | 0.6 | 1.2 | 1.5 |
| 3d. | Ropaque 96 | dipropylene glycol | 20.5 | 0.46 | −0.1 | 0.5 | 1.9 | 2.2 |
| 3e. | Ropaque 96 | dibenzyl oxalate | 16.6 | 0.42 | 0.8 | 1.4 | 1.7 | 1.8 |
| 3f. | Ropaque 96 | butyl stearate | 15.3 | 0.39 | 0.1 | 0.4 | 0.7 | 0.9 |
| 3g. | Hique 168 | NONE | | 0.29 | 0.0 | 0.2 | 0.5 | 1.6 |
| 3h. | Hique 168 | ethylene glycol | 29.9 | 0.56 | −0.2 | 0.0 | 0.3 | 0.7 |
| 3i. | Hique 168 | propylene carbonate | 27.2 | 0.55 | −0.1 | 0.3 | 1.2 | 1.3 |
| 3j. | Hique 168 | dipropylene glycol | 20.5 | 0.52 | −0.2 | 0.1 | 1.4 | 1.8 |

TABLE 3-continued

| Thermosensitive Layers of Example 3 | | | | | | | | |
|---|---|---|---|---|---|---|---|---|
| Sample | Hollow | | δ | Rd | Contrast Ratio | | | |
| ID | Pigment | Thermal solvent | $MPa^{1/2}$ | 20° C. | 93° C. | 150° C. | 175° C. | 200° C. |
| 3k. | Hique 168 | dibenzyl oxalate | 16.6 | 0.46 | 1.2 | 1.4 | 1.6 | 1.7 |
| 3l. | Hique 168 | butyl stearate | 15.3 | 0.74 | 0.1 | 0.1 | 0.4 | 0.4 |
| 3m. | Hique 332 | NONE | | 0.26 | 0.1 | 0.0 | 0.4 | 1.6 |
| 3n. | Hique 332 | ethylene glycol | 29.9 | 0.56 | 0.1 | 0.1 | 0.5 | 0.7 |
| 3o. | Hique 332 | propylene carbonate | 27.2 | 0.6 | −0.1 | 0.3 | 1.0 | 1.1 |
| 3p. | Hique 332 | dipropylene glycol | 20.5 | 0.6 | −0.1 | 0.0 | 1.2 | 1.5 |
| 3q. | Hique 332 | dibenzyl oxalate | 16.6 | 0.51 | 0.9 | 1.1 | 1.4 | 1.4 |
| 3r | Hique 332 | butyl stearate | 15.3 | 0.66 | 0.0 | 0.2 | 0.6 | 0.8 |
| 3s. | Hique 332L | NONE | | 0.27 | 0.0 | 0.1 | 0.2 | 0.7 |
| 3t. | Hique 332L | ethylene glycol | 29.9 | 0.58 | −0.2 | 0.1 | 0.1 | 0.3 |
| 3u. | Hique 332L | propylene carbonate | 27.2 | 0.49 | 0.1 | 0.4 | 0.8 | 1.0 |
| 3v. | Hique 332L | dipropylene glycol | 20.5 | 0.57 | −0.3 | 0.0 | 0.6 | 1.1 |
| 3w. | Hique 332L | dibenzyl oxalate | 16.6 | 0.43 | 0.9 | 1.0 | 1.5 | 1.5 |
| 3x. | Hique 332L | butyl stearate | 15.3 | 0.51 | 0.3 | 0.4 | 0.4 | 0.4 |
| 3y. | Hique 2050 | NONE | | 0.25 | 0.0 | 0.1 | 0.2 | 0.6 |
| 3z. | Hique 2050 | ethylene glycol | 29.9 | 0.4 | 0.3 | 0.1 | 0.7 | 0.7 |
| 3aa. | Hique 2050 | propylene carbonate | 27.2 | 0.55 | −0.1 | 0.2 | 0.6 | 0.9 |
| 3ab. | Hique 2050 | dipropylene glycol | 20.5 | 0.53 | −0.2 | 0.3 | 0.5 | 0.8 |
| 3ac. | Hique 2050 | dibenzyl oxalate | 16.6 | 0.4 | 1.0 | 1.3 | 1.6 | 1.8 |
| 3ad. | Hique 2050 | butyl stearate | 15.3 | 0.55 | −0.1 | 0.1 | 0.2 | 0.3 |

The differences in behavior exhibited by the different hollow organic pigments is likely the result of many factors including copolymer composition, pigment wall thickness, pigment Tg, pigment particle size and pigment solubility parameter.

Example 4

This example illustrates the preparation of a thermographic substrate consisting of a clay coated paper substrate (Fasson TT1C from Avery Corporation of Pasadena, Calif.), a color (black) layer, an opaque (white) thermosensitive layer, and a heat resistant topcoating that together will, when heated to a temperature range, produce a visually colored (black) image by transparency of the opaque coated layer as well as color shift of the colored (black) layer.

A thermosensitive coating ink of the following composition was prepared: 15.53 grams of a 30 percent styrene/acrylic hollow organic pigment dispersion in water known as Ropaque 0-96 was added to a small plastic mixing vessel. To this, 2.6 grams of a 40 percent dispersion in water of dibenzyl oxalate thermal solvent (HS-2046) 3.47 grams of a wax dispersion (30 percent Carnauba wax [milk] in water), 3.74 grams of a polyvinyl alcohol binder (Celvol 103, Clariant) solution 15 percent in water of 0.14 grams Cartabond GHF clay (Clariant), 1.15 grams of a carbon black dispersion (Aquasperse 1140 percent pigment in water by Evonik of Parsippany, N.J.), and 3.36 grams of tap water were added and stirred until the fluid was homogenous. Using a #6 coating rod, this thermosensitive ink was coated onto the paper substrate, and the water was dried out of the layer using room temperate blown air to yield a coating weight of 2.05 grams per square meter. This colored thermosensitive coating was gray in color and its measure reflective density was 0.61.

A white opaque thermosensitive coating ink having the following composition was prepared: 12.45 grams of 30 percent styrene/acrylic hollow organic pigment dispersion in water known as Ropaque 0-96 were added to a small plastic mixing vessel. To this, 2.08 grams of a 40 percent dispersion in water of dibenzyl oxalate (HS-2046), 2.78 grams of wax dispersion (30 percent Carnauba wax milk), and 2.69 grams of tap water were added and stirred until the fluid was homogenous. Using a #6 coating rod, this was coated over the top of the colored thermosensitive layer, and the water was dried out of the layer using room temperate blown air to yielding a coating weight of 2.90 grams per square meter. This system of coatings was white in color, and its measured reflective density was 0.19.

Similar to Example 1, a heat resistant topcoating was prepared and coated with a number 3 rod over the white opaque thermosensitive layer and dried at 45 degrees Celsius for 12 hours to yield a dry coating weight of 0.6 grams per square meter; and it was imaged via Zebra LP2824-Z printer. The reflective density of the imaged area was tested to be 1.05, and the Rd of the unimaged area was 0.19; the resulting contrast ratio was 4.52.

Example 5

This example illustrates the preparation of a thermographic substrate that comprises a polyester flexible substrate TC-390, a color layer, an opaque (white) thermosensitive layer, and a heat resistant topcoating that together will, when heated to a temperature range, produce a visually colored (black) image.

A color layer ink was prepared with pigment dispersion. The dispersion was made by melting together the following in a steel-ball attritor (SZEGVARI Attritor Model 01-HD from Union Process of Akron, Ohio) subjected to 110 degrees Celsius: 120 grams of carnauba wax (Strohmeyer and Arpe, Short Hills, N.J.) and 120 grams of Paraffin wax 05 (Koster Keunen) were charged. 400 cubic centimeters of stainless steel ball media were added and the attritor set to 500 revolutions per minute. To this, 60 grams of Printex 25 carbon black pigment (Evonik) was added and milled for 30 minutes. The resulting dispersion was removed from the attitor and media and kept hot.

The attritor was cleaned and set to room temperature. 270 grams of water were added along with 400 cubic centimeters of clean stainless media. To this, 30 grams of polyvinyl alcohol (Celvol 103) were added, and the temperature brought to 90 degrees Celsius while attriting for 30 minutes. The temperature was brought to 80 degrees Celsius, and, while attriting, 75 grams of the hot pigment dispersion was added. The temperature was allowed to cool 1 degree Celsius per minute until the fluid reached 30 degrees Celsius. This dispersion was removed from the attritor.

A thermosensitive coating ink having the following composition was prepared: 12.84 grams of Ropaque 0-96 hollow organic pigment dispersion were added to a small plastic mixing vessel. To this, 6.45 grams of a 40 percent dispersion in water of dibenzyl oxalate (HS-2046) and 10.71 grams of the above pigment/wax dispersion were charged and stirred until the fluid was homogenous. Using a #15 coating rod, this was coated onto the base paper and the water was dried out of the layer using room temperate blown air to yield a coating weight of 5.72 grams per square meter. This colored thermographic layer was gray in color and measured 0.68 Rd.

A white opaque thermosensitive coating ink having the following composition was prepared: 15.5 of a 30 percent styrene/acrylic hollow organic pigment dispersion in water known as Ropaque 0-96 were added to a small plastic mixing vessel. To this, 6.25 grams of a 40 percent dispersion in water of dibenzyl oxalate thermal solvent (HS-2046), 3.25 grams of a 40 percent calcium stearate dispersion (Cytech Products), 8 grams of a C44 30 percent acrylic resin solution, and 2.69 grams of tap water were charged and stirred until fluid was homogenous. Using a #15 coating rod, this was coated over the top of the color thermosensitive layer, and the water was dried out of the layer using room temperature blown air to yield a coating weight of 6.76 grams per square meter. This system of coatings was white in color and measured 0.19 in reflective density.

The samples were heated on a hot plate to 175 degrees Celsius for 10 seconds and thereafter allowed to cool. The Rd's of the heated portions were measured to be 1.42, the unheated portion was measured to be 0.19 and the resulting contrast ration was 6.47.

Example 6

This example illustrates the preparation of a thermographic substrate that comprises a synthetic paper (PB1 HG polypropylene film from Granwell Products, West Caldwell, N.J.), a color layer, an opaque (white) thermosensitive layer, and a heat resistant topcoating. When thermally imaged, this thermographic substrate will produce a visually colored image by transparency of the opaque thermosensitive coated layer. In addition, this example illustrates a thermographic substrate that maintains significant image contrast when exposed to temperatures less than 100 degrees Celsius.

The black color layer described in Example 1 was coated onto the synthetic paper via Meyer rod #4 and dried, and the reflective density was measured to be 2.0.

Ten different thermosensitive coating inks were then prepared, nine of which contained an inorganic particle additive and one without any additive. The details on the inorganic particle additives used in this example may be found in Table 4.

TABLE 4

Inorganic particles of Example 6

| Inorganic Particle | Supplier | Type | Size |
|---|---|---|---|
| Burgess 17 | Burgess Pigment Co. | High bright hydrous kaolin clay | 0.5μ |
| Burgess 40 | Burgess Pigment Co. | Medium bright hydrous kaolin clay | 1.3μ |
| Burgess 97 | Burgess Pigment Co | Medium bright hydrous kaolin clay | 0.2μ |

TABLE 4-continued

Inorganic particles of Example 6

| Inorganic Particle | Supplier | Type | Size |
|---|---|---|---|
| Optiwhite | Burgess Pigment Co. | Premium white flash calcined clay | 1.4μ |
| Kaobrite | Thiele Kaolin Co. | No. 2 Std. hydrous coating clay | 80-86% < 2μ |
| Kaogloss | Thiele Kaolin Co. | No. 1 Std. hydrous coating clay | 90-94% < 2μ |
| Minex 10 | Unimin Corporation | Nepheline syenite microcline | 2.3μ |
| Minex 12 | Unimin Corporation | Nepheline syenite microcline | — |
| Satintone 5 | BASF Corporation | High brightness calcined aluminosilicate clay | 0.8μ |

All of the inorganic particles used in this example were received as dry powders. They were dispersed in water to make 30 percent (by weight) dispersions by adding 15 grams of powder and 35 grams of tap water to a vessel and stirring until homogeneous. Then an ink base was made with 26.96 grams of C44 binder, 40.84 grams of a 52 percent dispersion in water of 1,2-bis(3-methylphenoxy) ethane thermal solvent, 58.84 grams of a 30 percent styrene/acrylic hollow organic pigment dispersion in water (Hique 168), 1.35 grams of a fluoro-surfactant (Chemwet 29), and 0.31 grams of tap water, which were added to a vessel and stirred. For each different type of inorganic particles, 12.8 grams of this ink premix were added to a smaller vessel with 7.2 grams of one of the inorganic particle dispersions, and each was shaken until homogeneous to form a thermosensitive coating solution.

Using a #15 coating rod, each thermosensitive coating ink was coated over the top of a separate sheet of black color layer coated synthetic paper and dried using a heat gun to form a white, opaque thermosensitive layer.

Similar to the procedure described in Example 1, a heat resistant topcoating was prepared, coated over each of the white, opaque thermosensitive layers, and dried at 50 degrees Celsius for 12 hours to form a thermosensitive substrate.

Each of the 10 thermosensitive substrates prepared in this example were thermally imaged with a Zebra LP2824-Z printer set to a printing speed of 3 inches per second and printer energy of 20.

Dry coating weights, and reflective densities of both the background (white) and printed area (black) for each ink are shown in Table 5. While all of the inorganic particle containing thermographic substrates in this example showed lower image Rd than the thermographic substrate without particles, those prepared with calcined clay were significantly lower in image Rd than those containing hydrous clays or microclines.

TABLE 5

Data for Example 6

| Inorganic Particle | Coat weight $g/m^2$ | RD (background) | RD (Image) | Contrast Ratio |
|---|---|---|---|---|
| None | 8.22 | 0.21 | 1.73 | 7.24 |
| Burgess 17 | 10.08 | 0.18 | 1.39 | 6.72 |
| Burgess 40 | 9.96 | 0.18 | 1.20 | 5.67 |
| Burgess 97 | 9.48 | 0.18 | 1.48 | 7.22 |
| Optiwhite | 10.04 | 0.16 | 0.90 | 4.63 |

TABLE 5-continued

| Data for Example 6 | | | | |
|---|---|---|---|---|
| Inorganic Particle | Coat weight g/m$^2$ | RD (background) | RD (Image) | Contrast Ratio |
| Kaobrite | 9.52 | 0.18 | 1.44 | 7.00 |
| Kaogloss | 10.04 | 0.18 | 1.57 | 7.72 |
| Minex 10 | 9.56 | 0.19 | 1.50 | 6.89 |
| Minex 12 | 9.72 | 0.20 | 1.55 | 6.75 |
| Satin Tone 5 | 9.44 | 0.14 | 0.95 | 5.79 |

To evaluate the thermal image stability of each of the 10 thermosensitive substrates, thermally imaged samples described in Table 5 were exposed to temperatures of 70 degrees Celsius and 80 degrees Celsius continuously for 4 hours, and then allowed to cool to room temperature. The background and image Reflection densities were then re-measured for each example after this heating and the contrast ratio's calculated. These data are summarized in Table 6.

TABLE 6

| Contrast Ratios for Example 6 | | | |
|---|---|---|---|
| Inorganic Partilce | Contrast Ratio (Original) | Contrast Ratio (70 C.) | Contrast Ratio (80 C.) |
| None | 7.24 | 1.38 | 0.00 |
| Burgess 17 | 6.72 | 3.97 | 0.41 |
| Burgess 40 | 5.67 | 2.18 | 0.07 |
| Burgess 97 | 7.22 | 4.39 | 1.05 |
| Burgess Optiwhite | 4.63 | 2.14 | 0.45 |
| Kaobrite | 7.00 | 3.81 | 0.42 |
| Kaogloss | 7.72 | 3.62 | 1.00 |
| Minex 10 | 6.89 | 2.21 | 0.00 |
| Minex 12 | 6.75 | 2.56 | 0.35 |
| Satin Tone 5 | 5.79 | 3.65 | 1.00 |

The effect of different types of clay on resisting transparentization when exposed to heat is more evident at 80 degrees Celsius. Table 6 shows the original contrast ratio, and then the contrast ratios after both 70 degrees Celsius and 80 degrees Celsius exposure. As described earlier, the contrast ratio ((Heated (imaged) Rd−Unheated (un-imaged) Rd)/Unheated (un-imaged) Rd) is a measure of the change in opacity of the thermosensitive substrate. In this example, the higher the contrast ratio, the more opaque the background remains during exposure to heat and thus the greater the thermal image stability. When the contrast ratio is lower, it means the thermosensitive layer is less effective at covering the underlying color layer because it loses opacity due to heat exposure.

As can be seen in Table 6, although some inorganic particle types are better than others at increasing the thermal image stability (high contrast ratio) of the thermosensitive layer, overall the examples with particles performed better than the example without particles. In addition, smaller particles appear to offer greater image stability than larger particles.

Example 7

This example illustrates the function of a barrier layer between the heat resistant topcoat and the thermosensitive layer. Two thermographic substrates were prepared, one with a barrier layer and one without. These thermographic substrate were prepared on a base of 3.2 mil synthetic paper (Sold as FPG-80, Yupo, Chesapeake, Va.), along with a color layer (black), an opaque (white) thermographic layer, a barrier layer and a heat resistant topcoat. These layers together when thermally imaged produced a visually colored (black) image.

The black color layer described in Example 1 was coated onto the synthetic paper substrate with a #4 Meyer rod and dried with room temperature blown air; the reflective density was measured to be 1.80.

The opaque (white) thermographic layer as described in Example 6 (without inorganic particles) was coated over the color layer with a #15 Meyer rod, and dried with a hot air gun. The dry coating weight of the thermographic layer was 8.50 grams per square meter, and the Rd was 0.15.

A barrier layer coating solution was prepared: 29.25 grams of a 50 percent solids binder of ethylene vinyl chloride copolymer emulsion in water (Sold as Airflex 4500, Air Products, Allentown, Pa.) was added to a small plastic mixing vessel. To this, 0.94 grams of 40 percent solids fluoro-surfactant (Sold as Chemwet 29) and 69.81 grams of tap water were added to the vessel and stirred until the fluid was homogeneous. Using a #4 Meyer rod this was coated over the top of the thermographic layer and dried using room temperature blown air. The barrier layer was determined to have a dry coating weight of 1.00 grams per square meter.

Similar to the procedure described in Example 1, a heat resistant topcoat was prepared and coated over the barrier layer and oven dried at 45 degrees Celsius for 24 hours and thermally imaged with a Zebra LP2824-Z printer at a speed of 3 inches per second and an energy setting of 20. The reflective density of the imaged area was tested to be 1.65, and the Rd of the un-imaged area was 0.15; the resulting contrast ratio was 10.0.

In the case of the no barrier layer sample, the thermographic substrate was prepared in a similar fashion to Example 6 (no inorganic particles). This thermographic substrate was thermally imaged with a Zebra LP2824-Z printer at a speed of 3 inches per second and a print energy of 20. The reflective density of the imaged area was tested to be 1.73, and the Rd of the un-imaged area was 0.21; the resulting contrast ratio was 7.24.

The resulting thermographic substrates were thermally imaged with a Zebra 140Xi III plus 203 dpi printer in order to test for print degradation over extended printing lengths. A print was produced at the start of the trial to assess the image quality (see FIG. 6*a*). The image quality print was 8 inches long and 4 inches wide and consisted of a first 0.0625 inches wide line parallel to the printing direction and 4.6875 inches long. In a similar fashion a second 0.0625 inches inch line was printed parallel to the print direction of the print. The second line was 2.1875$^{inches}$ long. In between the first and second line a text string was printed parallel to the first and second lines. The text string was the same length as the second line and was also 0.0625 inches wide. Directly after the text string and first and second lines a large solid fill rectangle was printed. The rectangle was 1.375 inches wide and 3.875 inches long. After printing the rectangle, a set of seven parallel lines, each 0.0625 inches wide and perpendicular to the print direction were printed below the solid fill. The separation between each line was 0.0625 inches. The first image quality print for each of the thermographic substrates of this example showed no signs of print degradation in the lines or solid fill.

A test print, see FIG. 6*b*, was the same size as the image quality print. However, the test print did not include either the solid fill rectangle or the seven perpendicular lines. The length of the first line was 6.375 inches and the length of the image was 8 inches. The first line was printed over 80 percent of the length of the image quality print and thus was said to be an 80 percent duty cycle vertical line. The second line was 2.375 inches long and in a similar fashion was a 30 percent duty cycle line. In between the first and second line a text string was printed parallel to the first and second lines. The text string was the same length as 30 percent duty cycle second line and was also 0.0625 inch wide.

The test print image was repeatedly printed until a total of 400 meters of the thermosensitive substrate had been imaged by the Zebra 140Xi III printer. After the 400 meters of test prints were completed, the thermal print head of the 140Xi III was opened up and cleaned. Cleaning was conducted using a lint free cloth (Sold as KimWipe, Kimberly Clark) wet with isopropyl alcohol. The alcohol wet cloth was wiped back and forth over the print head 6 times and the print head was allowed to dry. After cleaning, a second image quality print was made onto the thermographic substrates of this example. The image quality of the print was scored as follows: If no print degradation was observed the score was 10; if slight lightening in the solid fill rectangle or the seven perpendicular lines was noticeable in the image quality print the score was 5; if significant lightening in the solid fill rectangle or the seven perpendicular lines was noticeable in the image quality print the score as 3; if a total loss or printing in the solid fill rectangle or the seven perpendicular lines was noticeable in the image quality print of if physical damage to the print was observed, then the score was 0.

Table 8 summarizes the image quality extended print results for the thermographic coatings of this example.

TABLE 8

Extended Print Test Results

| Barrier Binder | Supplier | Chemistry | Image Quality after 400M Thermal Printing |
|---|---|---|---|
| No Barrier Layer | — | — | 5 |
| Airflex 4500 | Air Products | Ethylene Vinyl Chloride | 10 |

Example 8

This example illustrates the preparation of a thermographic substrate that comprises a base of a 3.2 mil synthetic paper (Sold as FPG-80, Yupo, Chesapeake, Va.), a color layer (black), an opaque (white) thermographic layer, a barrier layer and a heat resistant topcoat. These layers together when heated produced a visually colored (black) image.

The black color layer described in Example 1 was coated onto the synthetic paper substrate with a #4 Meyer rod and dried, the Rd was measured to be 1.80.

The opaque (white) thermographic layer as described in Example 6 (without clay) was coated over the described black layer with a #15 Meyer rod for and let dry for a dry coating weight of 8.50 grams per square meter and a Rd of 0.15.

The barrier layer as described in Example 7 was coated over the described opaque thermographic layer. The barrier layer was coated with a #4 Meyer rod and let dry for a coating weight of 1.00 grams per square meter.

Five topcoatings comprised of five different binders were prepared in this example, the details of which are summarized in Table 9.

TABLE 9

Binders of Example 8

| Binder | Supplier | Chemistry |
|---|---|---|
| Joncryl 1982 | BASF | Self Crosslinking Acrylic |

TABLE 9-continued

Binders of Example 8

| Binder | Supplier | Chemistry |
|---|---|---|
| Neocryl XK-12 | DSM NeoResins | Self Crosslinking Acrylic |
| Celvol 103 | Celanese | Polyvinyl Alcohol |
| Bariastar B-2000 | Mitsui | Acrylic Sphere Dispersion |

Each heat resistant topcoating solution of this example was prepared by mixing 87.30 grams of each such binder, each adjusted to 15 percent solids in water, in a plastic vessel. To each binder 5.63 grams of a 15 percent solids dispersion of precipitated silica (sold as Perkasil SM660, Grace Davison), 5.51 grams of silicone emulsion (sold as SF-48E, Cross Chemical), 0.48 grams of silicone emulsion (sold as HV495, Dow Chemical), and 1.08 grams of fluoro-surfactant (Sold as Chemwet 29, Chemcor) were added and stirred until homogeneous.

Each of the four heat resistant topcoating solutions was then coated onto the barrier layer of the thermographic substrate with a #7 Meyer rod and dried with a hot air gun; they each had a dry coating weight of 2.25 grams per square meter. The coated substrates were oven dried at 45 degrees Celsius for 24 hours. The image quality after extended printing was evaluated for each topcoated thermographic substrate in the same fashion as those tested in Example 7 and is summarized in Table 10.

TABLE 10

Extended Print Testing of Binders in Topcoat

| Binder | Supplier | Chemistry | Image Quality after 400M Thermal Printing |
|---|---|---|---|
| Joncryl 1982 | BASF | Self Crosslinking Acrylic | 10 |
| Neocryl XK-12 | DSM NeoResins | Self Crosslinking Acrylic | 10 |
| Celvol 103 | Celanese | Polyvinyl Alcohol | 3 |
| Bariastar B-2000 | Mitsui | Acrylic Sphere Dispersion | 10 |

Example 9

This example illustrates the preparation of a thermographic substrate that comprises a synthetic paper (PB1HG polypropylene film) layer, an opaque (white) thermosensitive layer, and a heat resistant topcoating that together, when heated to a temperature range, produced a visually colored image by transparency of the opaque thermosensitive layer and that maintained significant contrast when exposed to ultraviolet and visible light illumination.

The black color layer described in Example 1 was coated onto the synthetic paper via Meyer rod #4 and dried with a heat gun. The black color layer reflective density was measured to be 2.0.

A thermosensitive coating fluid was prepared as described in Example 6 using Burgess 17 clay. Then, using a #15 coating rod, the thermosensitive fluid was coated over the top of the black color layer coated synthetic paper and dried using a heat gun to form a white, opaque thermosensitive layer.

Similar to the procedure described in Example 8, a heat resistant topcoating was prepared and coated over the thermosensitive layer and dried at 50 degrees Celsius for 12 hours to form a thermographic substrate.

Both the thermographic substrate prepared in this example as well as a conventional leuco dye containing thermographic substrate (PolyPro 4000D 3.8 mil Receipt supplied by Zebra Technologies Lincolnshire, Ill. 60069 USA) were thermally imaged with a Zebra LP2824-Z printer set to a printing speed of 3 inches per second and a printer energy of 20.

The Rd's of the background (white) and printed area (black) for each of the two substrates, as well as the calculated contrast ratios are shown in Table 11.

TABLE 11

Reflection Densities and Contrast Ratios for Example 9

| Substrate | RD (background) | RD (Image) | Contrast Ratio |
|---|---|---|---|
| Thermographic Example | 0.18 | 1.55 | 7.61 |
| PolyPro 4000 D | 0.05 | 1.56 | 30.2 |

To evaluate the thermal image stability of each of these substrates, the thermally imaged samples described in Table 11 were placed in the QUV chamber (QUV Accelerated Weathering Tester, Q-Lab, Cleveland, Ohio) containing UVB-313 light bulbs (Q-Lab, Cleveland, Ohio) which was set to 60 degrees Celsius for 24 hours and then allowed to cool to room temperature. The background and image Rd's were then re-measured after this exposure and the contrast ratios calculated. These data are summarized in Table 12.

TABLE 12

Reflection Densities and Contrast Ratios after QUV Exosure

| Substrate | RD (background) | RD (Image) | Contrast Ratio (Original) | Contrast Ratio (QUV) |
|---|---|---|---|---|
| Thermographic Example | 0.41 | 1.59 | 7.33 | 2.87 |
| PolyPro 4000 D | 0.55 | 1.43 | 30.6 | 1.60 |

As can be seen in Table 12, while the contrast ratio of the PolyPro 4000 D was originally much higher than that of the thermosensitive substrate prepared in this example, the decrease in contrast ratio of the thermosensitive substrate was much less significant after exposure to both heat and UV in the QUV chamber than the leuco dye containing PolyPro 4000D substrate.

Applicants have described certain preferred processes and the products produced thereby. Many variations of these processes and products will be apparent to those skilled in the art; and they are intended to be comprehended within the scope of the invention.

There are many applications in which applicants' novel thermographic substrate can be advantageously used. These include, by way of illustration, pipe identification labels (the durability of such labels makes them useful for many years after the installation of the pipe), electrical wiring labels (the durability of the labels is similarly advantageous in this use), fiber optic cable labels, nursery tags (the resistance of the tags to weathering makes them advantageous for this use), livestock tags (the labels are inedible and resistant to livestock), receipt printing, VIN # labels (where the fading resistance property is advantageous), shelf labelling (where the fading resistance makes the labels advantageous for both indoor and outdoor uses), part labelling, address labels, bar codes, inventory asset tags, fruit labeling, street and traffic signage, license plates, driver licenses, hunting licenses, identification cards, and the like.

We claim:

1. A thermographic substrate assembly comprised of a colorant, a flexible substrate, a thermosensitive layer comprised of a binder, a multiplicity of hollow sphere organic pigments, and a thermal solvent, wherein said thermographic substrate assembly also comprises a barrier layer, wherein said thermosensitive layer is disposed on said colorant, wherein said barrier layer is disposed on said thermosensitive layer, and wherein said barrier layer is comprised of a polymeric binder having a coating weight of from about 0.1 grams per square meter to about 4 grams per square meter.

2. The thermographic substrate assembly as recited in claim 1, wherein said polymeric binder is a chlorine containing binder.

3. A process for producing visible printing on a thermographic imaging substrate assembly, wherein said thermographic imaging substrate assembly is comprised of a colorant, a flexible substrate, and a thermosensitive layer, wherein said thermosensitive layer is comprised of a binder, a multiplicity of hollow sphere organic pigments, and a thermal solvent, wherein said thermosensitive layer is disposed on said colorant, and wherein said thermal solvent has a Hildebrand solubility parameter from about 16 megapascals$^{1/2}$ to about 28 square megapascals$^{1/2}$, comprising the steps of applying heat to a selected portion of said thermosensitive layer and inducing said selected portion of said thermosensitive layer to change from opaque to translucent, whereby a contrasting visual mark is produced.

4. The process as recited in claim 3, wherein said thermosensitive layer is comprised of from about 10 to about 66 weight percent of said hollow sphere organic pigments.

5. The process as recited in claim 4, wherein said thermosensitive layer is comprised of from about 25 to about 50 weight percent of said hollow sphere organic pigments.

6. The process as recited in claim 5 wherein from about 0.5 to about 1.5 parts of said thermal solvent are present in said thermosensitive layer for each part of said hollow sphere organic pigment.

7. A thermographic imaging substrate assembly that is comprised of a colorant, a flexible substrate, an opaque thermosensitive layer, and a heat resistant topcoating, wherein:

(a) said thermographic imaging substrate assembly has an unimaged color saturation of less than 0.5 Rd, (b) said heat resistant top-coating is disposed above said opaque thermosensitive layer;

(c) said opaque thermosensitive layer is comprised of a binder, a multiplicity of hollow sphere organic pigments, and a thermal solvent, (d) said hollow sphere organic pigments have an average particle size of from about 0.1 micron to about 2.0 microns, (e) said thermal solvent has a Hildebrand solubility parameter of from about 16 megapascals$^{1/2}$ to about 28 square megapascals$^{1/2}$, (f) said thermosensitive layer is disposed on said colorant, and (g) when heat is applied to a selected portion of said thermosensitive layer, said selected portion changes from opaque to translucent, thereby producing a contrasting visual mark.

8. The thermographic imaging substrate assembly as recited in claim 7, wherein said hollow sphere organic pigments are comprised of synthetic organic polymers.

9. The thermographic imaging substrate assembly as recited in claim 7, wherein said hollow sphere organic pigments are comprised of an addition polymer.

10. The thermographic imaging substrate assembly as recited in claim 9, wherein said addition polymer is comprised of a monoethylenically unsaturated monomer.

11. The thermographic imaging substrate assembly as recited in claim 7, wherein said hollow sphere organic pigments are comprised of polymers comprising acrylic polymers, styrenic polymers, vinyl polymers, and copolymers thereof.

12. The thermographic imaging substrate assembly as recited in claim 7, wherein said thermal solvent is comprised of an aromatic moiety.

13. The thermographic imaging substrate assembly as recited in claim 7, wherein said opaque thermosensitive layer is comprised of solid particles with a average particle size of less than 2 microns and a refractive index of from about 1.35 to about 1.65.

14. The thermographic imaging substrate assembly as recited in claim 7, wherein said binder in said opaque thermosensitive layer is comprised of a polymer with a glass transition temperature less than about 50 degrees Celsius.

15. The thermographic imaging substrate assembly as recited in claim 7, wherein said binder in said opaque thermosensitive layer is comprised of a polymer with a refractive index in the range from about 1.30 to about 1.7.

16. The thermographic imaging substrate assembly as recited in claim 7, wherein said heat resistant topcoating is comprised of a binder, a lubricant, and an abrasive particle.

17. The thermographic imaging substrate assembly as recited in claim 7, wherein said heat resistant topcoat is comprised of acrylic binder, lubricant and an abrasive particle.

18. The thermographic imaging substrate assembly as recited in claim 17, wherein said lubricant is comprised of a silicone compound.

19. The thermographic imaging substrate assembly as recited in claim 17, wherein said lubricant is comprised of the salt of a fatty acid.

20. The thermographic imaging substrate assembly as recited in claim 19, wherein said salt of a fatty acid is a salt of stearic acid.

21. The thermographic imaging substrate assembly as recited in claim 17, wherein said abrasive particle is selected from the group consisting of inorganic particles and organic particles.

22. The thermographic imaging substrate assembly as recited in claim 17, wherein said abrasive particle has a Mohs hardness of less than about 7.

23. The thermographic imaging substrate assembly as recited in claim 7, wherein said hollow sphere organic pigments have a wall thickness of from about 5 nanometers to about 1 micron.

24. The thermographic imaging substrate assembly as recited in claim 7, wherein said hollow sphere organic pigments have a wall thickness of from about 50 to about 500 nanometers.

25. The thermographic imaging substrate assembly as recited in claim 7, wherein said hollow sphere organic pigments have an average particle size of from about 0.1 to 10 microns.

26. The thermographic imaging substrate assembly as recited in claim 7, wherein said hollow sphere polymer pigments have a glass transition temperature greater than 50 degrees Celsius.

27. The thermographic imaging substrate assembly as recited in claim 7, wherein said hollow sphere organic pigments have a dry density of less than 0.9 grams per cubic centimeter.

28. The thermographic imaging substrate assembly as recited in claim 7, wherein said opaque thermosensitive layer is comprised of from about 10 to about 66 weight percent of said hollow sphere organic pigments.

29. The thermographic imaging substrate assembly as recited in claim 7, wherein said opaque thermosensitive layer is comprised of from about 25 to about 50 weight percent of said hollow sphere organic pigments.

30. The thermographic imaging substrate assembly as recited in claim 7, wherein from about 0.5 to about 1.5 parts by weight of said thermal solvent are present in said opaque thermosensitive layer for each part of said hollow sphere organic pigment.

31. The thermographic imaging substrate assembly as recited in claim 30, wherein said thermal solvent is an emulsified liquid.

32. The thermographic imaging substrate assembly as recited in claim 30, wherein said thermal solvent is a liquid thermal solvent that is dissolved in a binder.

33. The thermographic imaging substrate assembly as recited in claim 7, wherein said thermal solvent is selected from the group consisting of dibenzyl oxalate, propylene carbonate, benzyl alcohol, triethylene glycol, triethylene glycol, dipropylene glycol, dibutyl phthalate, carnauba wax, 1,2-bis(3-methylphenoxy)ethane, polar waxes, and mixtures thereof.

34. The thermographic imaging substrate assembly as recited in claim 7, wherein said opaque thermosensitive layer is comprised of from about 5 to about 50 weight percent of said thermal solvent.

* * * * *